US011673069B2

(12) United States Patent
Kim et al.

(10) Patent No.: US 11,673,069 B2
(45) Date of Patent: Jun. 13, 2023

(54) TRANSFORMABLE TOY AND TOY SET INCLUDING TRANSFORMABLE TOY

(71) Applicant: DAEWON MEDIA CO., LTD., Seoul (KR)

(72) Inventors: Sun Il Kim, Gyeonggi-do (KR); Isao Kokubun, Tokyo (JP)

(73) Assignee: DAEWON MEDIA CO., LTD., Seoul (KR)

( * ) Notice: Subject to any disclaimer, the term of this patent is extended or adjusted under 35 U.S.C. 154(b) by 227 days.

(21) Appl. No.: 17/142,709

(22) Filed: Jan. 6, 2021

(65) Prior Publication Data

US 2021/0205724 A1 Jul. 8, 2021

(30) Foreign Application Priority Data

Jan. 8, 2020 (KR) ..... 10-2020-0002723

(51) Int. Cl.
*A63H 33/00* (2006.01)
*A63H 17/26* (2006.01)

(52) U.S. Cl.
CPC ..... *A63H 33/003* (2013.01); *A63H 17/26* (2013.01)

(58) Field of Classification Search
CPC ..... A63H 17/21; A63H 17/25; A63H 17/26; A63H 33/003
USPC ..... 446/72, 93, 94, 95, 97, 269, 279, 321, 446/376, 465, 487, 268
See application file for complete search history.

(56) References Cited

U.S. PATENT DOCUMENTS 4,095,367 A * 6/1978 Ogawa ..... A63H 33/003 446/73
4,516,948 A * 5/1985 Obara ..... A63H 33/003 446/376
4,599,078 A * 7/1986 Obara ..... A63H 33/003 446/376

(Continued)

FOREIGN PATENT DOCUMENTS

CN 1909948 A 2/2007
CN 1978022 A 6/2007

(Continued)

OTHER PUBLICATIONS

Office Action issued in Japanese Patent Application No. 2021-002040 dated Nov. 22, 2021.

(Continued)

*Primary Examiner* — Alexander R Niconovich
(74) *Attorney, Agent, or Firm* — Marshall, Gerstein & Borun LLP

(57) ABSTRACT

A transformable toy transformable so as to be coupled to a model toy and a toy set including the model toy and the transformable toy are provided. The transformable toy includes a transformable body. The transformable body is configured to be transformable into a first state where the transformable body is independent from the model toy and a second state where the transformable body at least partially covers the model toy and is releasably coupled to the model toy. The transformable body includes a pair of grip portions. The pair of grip portions are configured to be rotatable in opposite directions about one rotation axis or a pair of rotation axes and are configured to releasably grip the model toy by being moved toward each other.

11 Claims, 54 Drawing Sheets

(56) References Cited

U.S. PATENT DOCUMENTS 5,310,379 A * 5/1994 Hippely ..... A63H 33/003 446/376
7,121,917 B2 * 10/2006 Hardouin ..... A63H 30/04 446/470
7,568,965 B2 * 8/2009 Toriyama ..... A63H 17/21 446/376
7,722,426 B2 * 5/2010 Campbell ..... A63H 33/003 446/4
7,722,429 B2 * 5/2010 Campbell ..... A63H 17/00 446/376
8,128,450 B2 * 3/2012 Imai ..... A63H 33/003 446/470
8,337,271 B2 * 12/2012 Campbell ..... A63H 33/003 446/376
8,348,715 B2 * 1/2013 Miyake ..... A63H 17/02 446/321
8,784,153 B2 * 7/2014 Sugimoto ..... A63H 33/003 446/72
8,992,284 B2 * 3/2015 Weidetz ..... A63H 33/003 446/310
9,205,341 B2 * 12/2015 Higuchi ..... A63H 3/46
9,415,322 B2 * 8/2016 Kanauchi ..... A63H 33/003
9,675,899 B2 * 6/2017 Nishimoto ..... A63H 33/003
10,071,320 B2 * 9/2018 Levine ..... A63H 17/002
10,220,325 B1 * 3/2019 Kelley ..... A63H 17/25
10,561,957 B2 * 2/2020 Choi ..... A63H 17/25
11,325,050 B2 * 5/2022 Womack ..... A63H 17/05
2006/0270310 A1 * 11/2006 Campbell ..... A63H 33/003 446/268
2006/0270316 A1 * 11/2006 Campbell ..... A63H 33/003 446/268
2006/0270317 A1 * 11/2006 Campbell ..... A63H 17/02 446/268
2006/0270318 A1 * 11/2006 Campbell ..... A63H 33/003 446/268
2006/0270319 A1 * 11/2006 Campbell ..... A63H 33/003 446/268
2006/0270320 A1 * 11/2006 Proch ..... A63H 33/003 446/470
2006/0270321 A1 * 11/2006 Benedict ..... A63H 33/003 446/465
2007/0060019 A1 * 3/2007 Friedman ..... A63H 17/264 446/465
2014/0370777 A1 * 12/2014 Minassian ..... A63H 33/003 446/102
2015/0352457 A1 12/2015 Kanauchi

FOREIGN PATENT DOCUMENTS

CN 209596559 U 11/2019
JP S60-253481 A 12/1985
JP S61-222475 A 10/1986
JP H0626987 U 4/1994
JP 2005-224253 A 8/2005
JP 2010-131367 A 6/2010
WO WO-2005/068035 A1 7/2005

OTHER PUBLICATIONS

Office Action issued in Chinese Patent Application No. 202110020032.8 dated Apr. 26, 2022.

* cited by examiner

TRANSFORMABLE TOY AND TOY SET INCLUDING TRANSFORMABLE TOY

CROSS-REFERENCE TO RELATED APPLICATION

This application claims the benefit of Korean Patent Application No. 10-2020-0002723, filed on Jan. 8, 2020, in the Korean Intellectual Property Office, the disclosure of which is incorporated herein in its entirety by reference.

TECHNICAL FIELD

The present disclosure relates to a transformable toy whose form is transformable, and to a toy set including such a transformable toy.

BACKGROUND

A transformable toy whose form can be transformed is known in the art. Such a transformable toy may be composed of a plurality of manipulatable members. As a user manipulates a plurality of members of a conventional transformable toy, the transformable toy can be transformed from one form to another form. For example, a transformable robot toy is known as a conventional transformable toy. However, the conventional transformable toy has a limitation in that the convention transformable toy is configured so as to change its shape under restriction of only the transformation of the transformable toy itself.

SUMMARY

Embodiments of the present disclosure provide a user with an opportunity of differentiated and creative experiences through a novel transformation form which is different from a limited transformation form of a conventional transformable toy itself. Embodiments of the present disclosure provide a transformable toy which is not only transformable in itself, but also can give a user a variety of fun through the combination of the transformable toy with a model toy. Embodiments of the present disclosure provide a transformable toy which is easily coupled to a model toy in one transformed form by a user's simple manipulation.

One aspect of the embodiments disclosed herein relates to a transformable toy which is transformable in itself and can be combined with a model toy. A transformable toy according to one embodiment includes a transformable body. The transformable body is configured to be transformable into a first state where the transformable body is independent from a model toy and a second state where the transformable body at least partially covers the model toy and is releasably coupled to the model toy. The transformable body includes a pair of grip portions. The pair of grip portions are configured to be rotatable in opposite directions about one rotation axis or a pair of rotation axes and are configured to releasably grip the model toy by being moved toward each other.

In one embodiment, the transformable body further includes at least one spring configured to bias the pair of grip portions such that the pair of grip portions are moved toward each other. The at least one spring may include a pair of springs disposed in the pair of rotation axes respectively and configured to bias one of the pair of grip portions toward the other of the pair of grip portions.

In one embodiment, the transformable body further includes a pair of manipulation portions protruding from the pair of grip portions, respectively, and configured to be moved toward each other when the pair of grip portions are moved away from each other.

In one embodiment, the pair of grip portions may be configured to partially cover the model toy in the second state.

In one embodiment, the transformable body may further include a frame portion configured to partially cover the model toy in the second state. The pair of grip portions may include: a first grip portion coupled to the frame portion so as to be rotatable about a first rotation axis which is one of the pair of rotation axes; and a second grip portion coupled to the frame portion so as to be rotatable about a second rotation axis which is the other of the pair of rotation axes.

In one embodiment, each of the pair of the grip portions includes: a support portion in which the one rotation axis or one of the pair of rotation axes is disposed; and a rotation portion rotatably coupled to the support portion and configured to partially cover the model toy in the second state.

In one embodiment, the transformable body further includes at least one covering portion configured to partially cover the model toy in the second state.

In one embodiment, the pair of grip portions may be configured to grip the at least one covering portion in the first state.

In one embodiment, the at least one covering portion may include a rotating covering portion rotatably coupled to the frame portion.

In one embodiment, the at least one covering portion may include an accessory covering portion removably coupled to the transformable body.

In one embodiment, the transformable body includes an accessory body removably coupled to a first position of the transformable body in the first state and releasably coupled to a second position of the transformable body different from the first position or a predetermined position of the model toy in the second state. The accessory body may be configured to be engaged with the pair of grip portions moved toward each other in the first state. The accessory body may be configured to cover a portion of the model toy in the second state.

In one embodiment, each of the pair of grip portions includes an engaging portion protruding toward the other of the pair of grip portions and configured to be engaged with the model toy in a state where the pair of grip portions are moved toward each other.

Another aspect of the embodiments disclosed herein relates to a toy set. The toy set according to one embodiment includes the model toy and the transformable toy according to the aforementioned one embodiment. In one embodiment, each of the pair of grip portions of the transformable toy includes an engaging portion, and the model toy includes a counter engaging portion complementarily coupled to the engaging portion.

BRIEF DESCRIPTION OF DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

DETAILED DESCRIPTION

Figure 1:
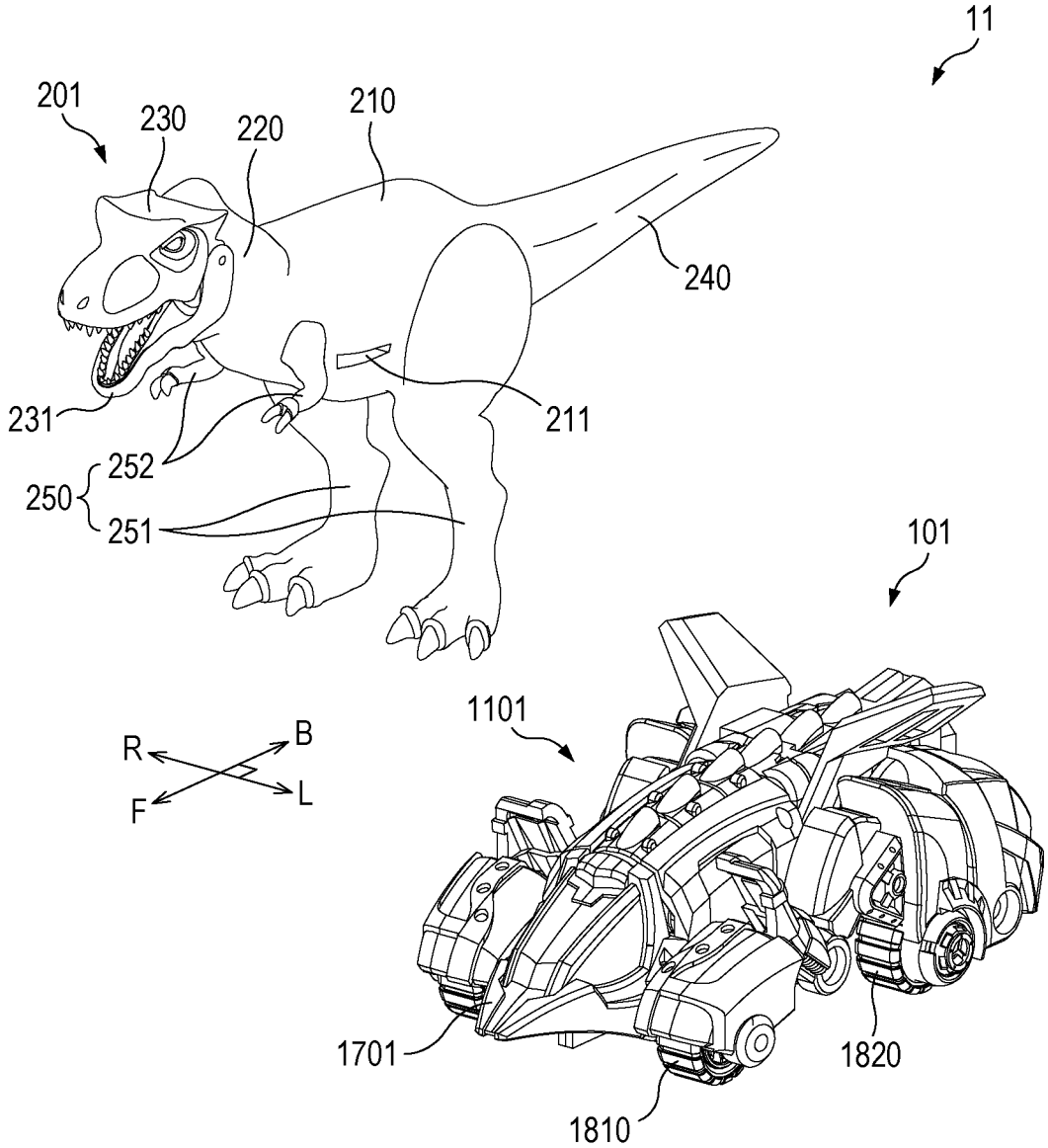
FIG. 1 is a perspective view showing a toy set according to a first embodiment of the present disclosure.

Embodiments of the present disclosure are illustrated for the purpose of explaining the technical idea of the present disclosure. The scope of the rights according to the present disclosure is not limited to the embodiments presented below or the detailed descriptions of such embodiments.

All the technical terms and scientific terms used in the present disclosure include meanings that are commonly understood by those of ordinary skill in the technical field to which the present disclosure pertains unless otherwise defined. All terms used in the present disclosure are selected for the purpose of describing the present disclosure more clearly, and are not selected to limit the scope of the rights according to the present disclosure.

The expressions such as "comprising," "including," "having," and the like used in the present disclosure are to be understood as open-ended terms having the possibility of encompassing other embodiments, unless otherwise mentioned in the phrase or sentence containing such expressions.

The singular expressions that are described in the present disclosure may encompass plural expressions unless otherwise stated, which will also be applied to the singular expressions recited in the claims.

The expressions such as "first," "second," etc. used in the present disclosure are used to separate a plurality of elements from each other, and are not intended to limit an order or importance of the elements.

In the present disclosure, the description that one element is "connected" or "coupled" to another element should be appreciated to indicate that one element may be directly connected, or coupled, to another element, and should be further understood that a novel element may be interposed between one element and another element.

As used in the present disclosure, a "left and right direction" means two directions in which a pair of grip portions are moved toward and moved away from each other. One direction in the left and right direction is defined as a "left direction" and the other is defined as a "right direction." As used in the present disclosure, a "front and rear direction" means two directions perpendicular to the left and right direction. One direction in the front and rear direction is defined as a "front direction" and the other is defined as a "rear direction." As used in the present disclosure, an "up and down direction" means two directions perpendicular to both the left and right direction and the front and rear direction. One direction in the up and down direction is defined as an "upward direction" and the other is defined as a "downward direction." In the disclosed embodiments, the direction, in which a portion of a model toy that can be recognized as a head is oriented, is indicated as the "front direction," and the direction in which a model toy comes into contact with the ground is indicated as the "downward direction." However, this is merely for purposes of understanding the present disclosure. The indication of the directions may change depending on where the reference of the directions is set.

Descriptions are made hereinafter as to the embodiments of the present disclosure with reference to the accompanying drawings. Like reference numerals in the drawings denote like or corresponding elements. Further, in the following description of the embodiments, duplicate descriptions for the same or corresponding elements may be omitted. However, even if the descriptions of the elements are omitted, such elements are not intended to be excluded in any embodiment.

The embodiments described below and the examples shown in the accompanying drawings relate to a transformable toy and a toy set including a model toy and a transformable toy. The model toy according to the present disclosure is an object that imitates a known animal, a person or animal appearing in a movie or cartoon, or a virtual person or animal. The model toy can be manufactured using a metal material, a resin material, or a wooden material. Such a model toy may be a figure in the related art. The model toy may be formed as an immovable integral body, or may be formed to have a plurality of portions connected by joints. The transformable toy according to the present disclosure is configured such that a plurality of members connected in a relatively detachable, relatively rotatable or relatively movable manner can be transformed in its form or state by a user's manipulation.

The transformable toy 101, 102, 103 or 104 according to embodiments of the present disclosure includes a transformable body 1101, 1102, 1103 or 1104 that is transformable in form. The transformable toy according to the embodiments may be composed of only the transformable body, or may further include an accessory body 1701, 1702, 1703 or 1704 that is removably or detachably coupled to the transformable body. According to the embodiments, the accessory body may not be transformable, or may be transformed independently of the transformable body.

The transformable body of the transformable toy according to the embodiments is configured to have a first state where the transformable body is separated and independent from the model toy 201, 202, 203 or 204, and a second state where the transformable body is coupled to the model toy. The transformable toy is configured to be transformable so as to have one distinctive form (first form) in the first state and another distinctive form (second form) in the second state. The transformable toy can be reversibly transformed into the first form in the first state and the second form in the second state. Further, in the first state and the second state, the transformable toy can be reversibly transformed into an intermediate form partially corresponding to the first form or the second form. Further, the transformable body may be transformable so as to have a form that forms at least a portion of the first form in the first state and to have a form that forms at least a portion of the second form in the second state. Further, the accessory body may be coupled to a predetermined first position in the first state to constitute at least a portion of the first form, and may be coupled to a predetermined second position in the second state to constitute at least a portion of the second form.

The first form may include a form corresponding to a shape of a transport machine. For example, the first form may have a form corresponding to a shape of a transport machine such as a vehicle, an airplane, a spacecraft, a ship or a submarine. As another example, the first form may have a form corresponding to an animal shape or a human shape.

The transformable toy may have the second form corresponding to a shape of the model toy in the second state. The second form may correspond to an animal shape or a human shape. For example, the second form may have a form corresponding to a dinosaur shape. The dinosaur shape may be the shape of a land dinosaur, a water dinosaur or a flying dinosaur.

In the second state, the transformable body according to the embodiments may be releasably coupled to the model toy while covering the outer surface of the model toy according to the embodiments. Thus, the transformable toy according to the embodiments can give novel experience and interest to the user. For example, the user can have fun that the model toy is wearing a protector (e.g., an armor or an armor and helmet) which is made by the transformed transformable toy.

According to the embodiments, the transformable toy includes the transformable body 1101, 1102, 1103 or 1104 configured to be transformable into the above-described first and second states. The transformable body 1101, 1102, 1103 or 1104 may be an assembly in which members rotatable for transformation are joined by hinge joints. The transformable body is configured to be transformable into the first state where the transformable body is independent from the model toy and the second state where the transformable body covers the model toy at least partially and is releasably coupled to the model toy. The transformable body shown in each of FIGS. 1, 19, 34 and 50 is in the first state where the transformable body is independent from the model toy, and the transformable body shown in each of FIGS. 2, 20, 35 and 53 is in the second state, different from the first state, where the transformable body partially covers the model toy.

According to the embodiments, the transformable body includes a pair of grip portions 1200 configured to releasably grip the model toy. In the transformable body, the pair of grip portions 1200 are configured to be rotatable in opposite directions about one rotation axis or a pair of rotation axes R1. In the second state of the transformable body, the pair of grip portions 1200 can grip the model toy by being rotated so as to move toward each other. Accordingly, the transformable body can cover the model toy and, at the same time, can be releasably coupled to the model toy by the pair of grip portions 1200 gripping the model toy. According to the embodiments, the pair of grip portions 1200 may be configured to partially cover a portion of the model toy in the second state of the transformable body.

The rotations in opposite-directions of the pair of grip portions may include that one of the pair of grip portions is rotated clockwise about one rotation axis or a pair of rotation axes R1 and the other of the pair of grip portions is rotated counterclockwise substantially simultaneously or sequentially about one rotation axis or a pair of rotation axes R1. Therefore, the pair of grip portions may be provided in the transformable body 1101 so as to be moved away from or moved toward each other about the rotation axis R1. That is, the pair of grip portions 1200 can releasably grip the model toy by being relatively rotated so as to be moved toward each other. Accordingly, the transformable body may be configured to be releasably coupled to the model toy by the pair of grip portions 1200 in the second state. Further, the pair of grip portions 1200 can be released from the model toy by being relatively rotated so as to be moved away from each other. If the pair of grip portions 1200 are released from the model toy, the transformable body can be transformed from the second state to the first state so as to be independent from the model toy.

With regard to the rotations of the pair of grip portions 1200, the rotation axis R1 means a virtual axis extending in the front direction F and the rear direction B of the transformable toy. The transformable toy according to the embodiments may include the rotation axis R1 that may be composed of one rotation axis, first and second parallel rotation axes, or first and second rotation axes inclined toward each other. When the rotation axis R1 is one rotation axis, the pair of grip portions 1200 may be provided in the transformable body 1101 so as to be rotated in opposite directions about one rotation axis. When the rotation axis R1 includes the first and second rotation axes, the pair of grip portions 1200 may be provided in the transformable body so as to be rotated in opposite directions about the first and second rotation axes, respectively. The pair of grip portions 1200 are rotated about the rotation axis R1 in the transformable body so as to be moved away from or moved toward each other. The pair of grip portions 1200 may be rotated to an insertion position where the pair of grip portions 1200 are moved away from each other to allow a portion of a torso portion of the model toy to be inserted between the pair of grip portions 1200 and to a grip position where the pair of grip portions 1200 are moved toward each other to releasably grip a portion of the torso portion of the model toy.

According to the embodiments, the pair of grip portions 1200 may be configured to partially cover a portion of the model toy in the second state of the transformable body. In one embodiment, the pair of grip portions 1200 are configured to partially cover each side portion of the torso portion of the model toy by being rotated about the rotation axis R1.

According to the embodiments, the transformable body of the transformable toy may include at least one spring 1300 configured to bias the pair of grip portions 1200 toward each other, i.e., toward the grip position. The pair of grip portions 1200 are biased by the spring 1300 so as to be moved toward each other. The spring 1300 may be coupled to the pair of grip portions 1200 in the transformable body of the transformable toy. The transformable body of the transformable toy may include one or more springs disposed between the pair of grip portions 1200. Alternatively, the transformable body of the transformable toy may include a pair of springs that are disposed at the pair of rotation axes R1, respectively, and bias one of the pair of grip portions 1200 toward the other. The spring 1300 may include a torsion spring, a tension spring, or a compression spring.

According to the embodiments, the transformable body of the transformable toy may include manipulation portions

1211 which a user can manipulate so as to move the pair of grip portions 1200 away from each other. That is, the transformable body of the transformable toy includes a pair of manipulation portions 1211 that can be manipulated to rotate the pair of grip portions 1200. When the transformable body includes the spring 1300, the manipulation portions 1211 may be manipulated to rotate the grip portions 1200 against the biasing force of the spring 1300. The manipulation portions 1211 may be disposed in the respective grip portions 1200. The pair of grip portions 1200 may be rotated about the rotation axis R1 in the direction of a force applied to the manipulation portions 1211. The pair of manipulation portions 1211 may be configured to be moved toward each other when the pair of grip portions 1200 are rotated to be moved away from each other. The pair of manipulation portions 1211 may be configured to be moved away from each other when the pair of grip portions 1200 are rotated to be moved toward each other. In some embodiments, the pair of grip portions 1200 may not include the manipulation portions 1211, and the user may rotate the pair of grip portions 1200 by pinching bodies that constitute the pair of grip portions 1200.

According to the embodiments, the pair of grip portions 1200 and the model toy may be releasably coupled to each other by engaging portions that are complementarily engaged with each other. Each of the pair of grip portions 1200 may include an engaging portion 1212 configured to be engaged with the model toy, and the model toy may include, at its some portion (e.g., a torso portion or leg extension portions), counter engaging portions 211 and 253 configured to be complementarily coupled to the respective engaging portions 1212. Each engaging portion of the pair of grip portions 1200 may be formed to protrude toward the other of the pair of grip portions 1200 in the state where the pair of grip portions 1200 are moved toward each other. That is, the engaging portions of the grip portions 1200 may be formed as a male engaging portion having a shape of a protrusion or a pin. The counter engaging portions of the model toy may be formed as a female engaging portion that releasably fits with the male engaging portion and has a shape of a groove or a hole. In an alternative embodiment, the engaging portions of the pair of grip portions 1200 may be formed as the aforementioned female engaging portions, and the counter engaging portions of the model toy may be formed as the aforementioned male engaging portions.

According to the embodiments, the transformable body of the transformable toy may include a frame portion 1400 capable of functioning as a base portion of the transformable body, and at least one covering portion configured to partially cover the model toy in the second state of the transformable body. The frame portion 1400 can function as a spine of the transformable body. In some embodiments, the frame portion 1400 may be configured to partially cover a portion of the model toy in the second state of the transformable body. In some embodiments, the frame portion 1400 may be formed as a plate-shaped body having a surface that can be recognized as a portion of a vehicle shape or a portion of an airplane shape. In some embodiments, the frame portion 1400 may be formed as a bar-shaped shaft. In some embodiments, the frame portion 1400 may function as a structure for rotatably supporting the pair of grip portions 1200. The at least one covering portion may be a member that constitutes the transformable body of the transformable toy. In some embodiments, the at least one covering portion may be rotatably or movably coupled to the frame portion 1400, or may be rotatably or movably coupled to the pair of grip portions 1200.

According to the embodiments, the at least one covering portion may be configured to partially cover the model toy in the state where the at least one covering portion is fixed at a specific position in the second state of the transformable body. In some embodiments, the transformable body of the transformable toy may include one covering portion or may include two or more covering portions so as to cover different portions of the model toy. The covering portion may include a rotating covering portion that is rotatably coupled to the frame portion 1400. Further, the covering portion may include an accessory covering portion that is removably coupled to the transformable body. Furthermore, the covering portion may be formed to extend from the frame portion 1400. The above-described covering portion may be formed so as to correspond to the shape of a portion of the model toy. For example, when the model toy includes a torso portion and an extension portion extending from the torso portion and having the shape of a head, a leg or a tail, the covering portion may be formed so as to correspond to the shape of a portion of the torso portion or the shape of a portion of each extension portion.

According to the embodiments, each grip portion 1200 may include a support portion 1220 and a rotation portion 1230, 1240, 1250, 1260 or 1270 rotatably coupled to the support portion 1220. The support portion 1220 of the grip portion has a predetermined shape and may constitute a main body of the grip portion. The support portion 1220 may function as a support which is provided with the engaging portion 1212 of the grip portion, rotatably supports the rotation portion, and supports the frame portion 1400 and the model toy with respect to the rotation center of the grip portion 1200. The support portion 1220 may be configured to have a component that constitutes a hinge joint between the grip portion 1200 and the frame portion 1400. Therefore, a rotation axis serving as the rotation center of the grip portion 1200 may be disposed in the support portion 1220. The support portion 1220 may have a bar shape while connecting the engaging portion 1212 and the hinge joint. Alternatively, the support portion 1220 may have a shape of a flat plate or a curved plate while connecting the engaging portion 1212 and the hinge joint.

According to the embodiments, the support portion 1220 may be configured to cover a portion of the model toy in the second state of the transformable body. Further, one of the pair of rotation axes R1 may be disposed in the support portion 1220. In one embodiment, the rotation portion 1230 may be configured to partially cover the model toy in the second state of the transformable body. In one embodiment, the rotation portion of the grip portion 1200 may be positioned at a position substantially parallel to the ground in the first state of the transformable body, and may be positioned at an upright position substantially perpendicular to the ground in the second state of the transformable body. In another embodiment, the rotation portion of the grip portion 1200 may be configured to be folded in the first state of the transformable body and to be unfolded in the left direction or the right direction when the transformable body is transformed into the second state.

According to the embodiments, the pair of grip portions 1200 are configured to grip at least one of the aforementioned covering portions in the first state of the transformable body. When the transformable body is transformed from the second state to the first state, at least one of the covering portions of the transformable body may be at least partially accommodated within a space defined by the frame portion and the pair of grip portions, and the pair of grip portions can grip the accommodated covering portion.

Therefore, in the first state of the transformable body, the covering portion of the transformable body can be prevented from rotating by the pair of grip portions, and the transformable body can be configured more compactly in the first state.

According to the embodiments, the transformable toy may include the accessory body 1701, 1702, 1703 or 1704 removably coupled to the transformable body 1101. The accessory body may be removably coupled to a first position of the transformable body in the first state of the transformable body. In one embodiment, the accessory body may be releasably coupled to the transformable body at a second position different from the first position in the second state of the transformable body. In another embodiment, the accessory body may be configured to cover a portion of the model toy, and may be releasably coupled to a predetermined position of the model toy in the second state of the transformable body. In a further embodiment, the accessory body may be configured to be engaged with the pair of grip portions moved toward each other in the first state of the transformable body.

Figure 2:
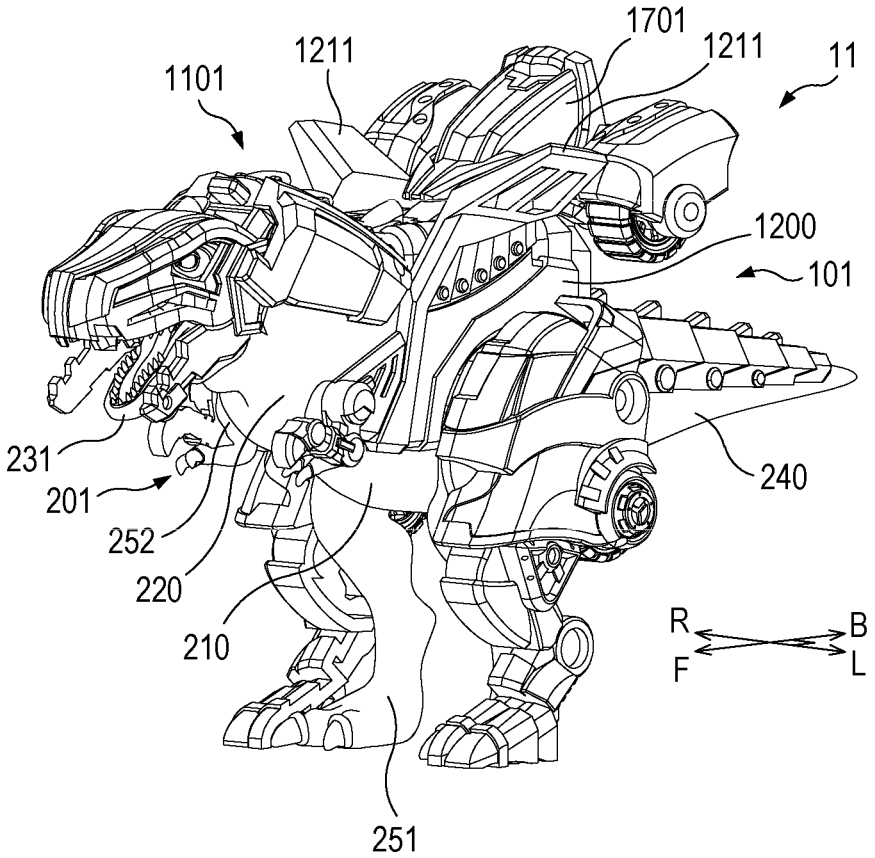
FIG. 2 is a perspective view showing a combination of a model toy and a transformable toy shown in FIG. 1.
Figure 3:
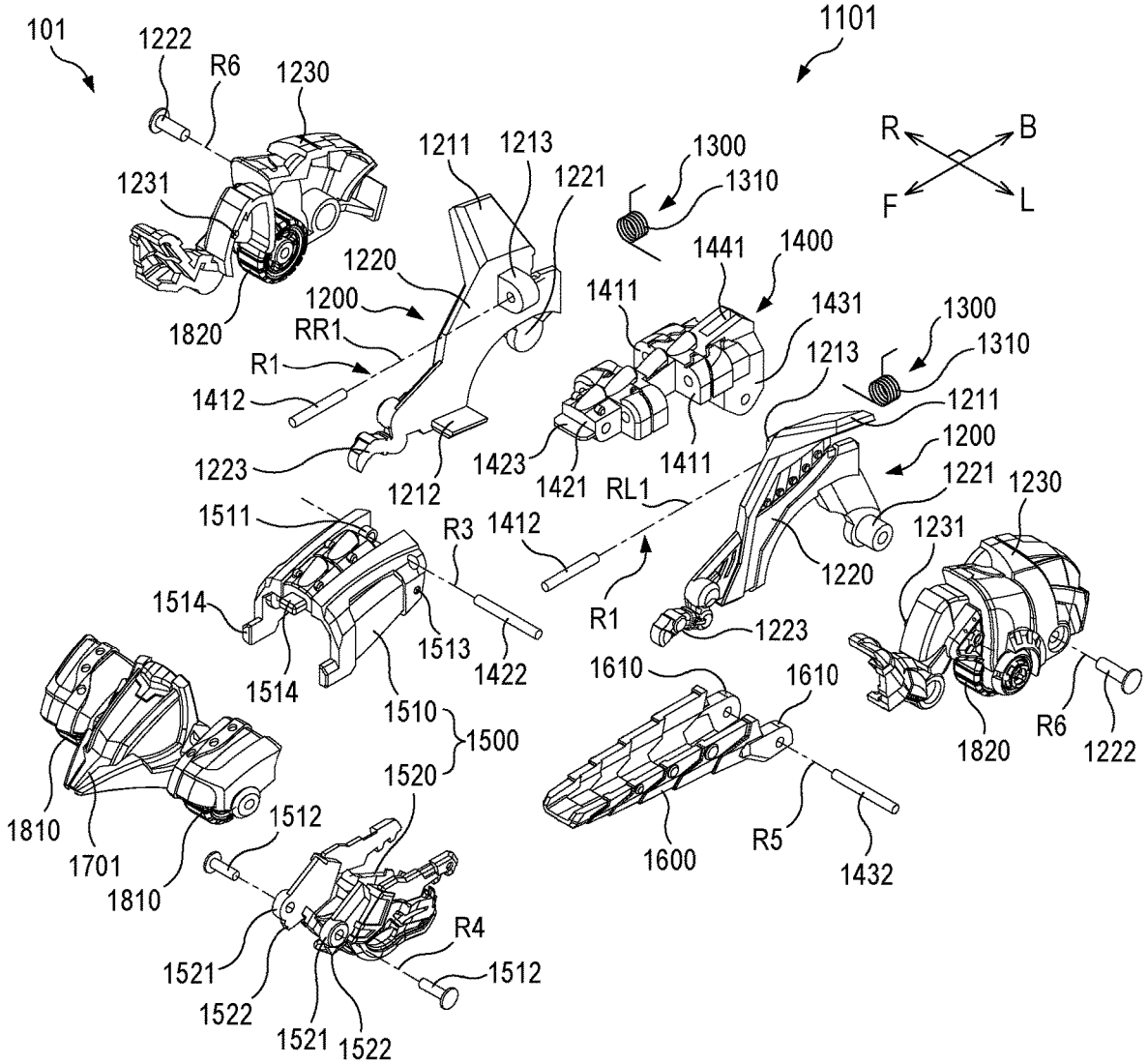
FIG. 3 is an exploded perspective view of the transformable toy shown in FIG. 1.
Figure 4:
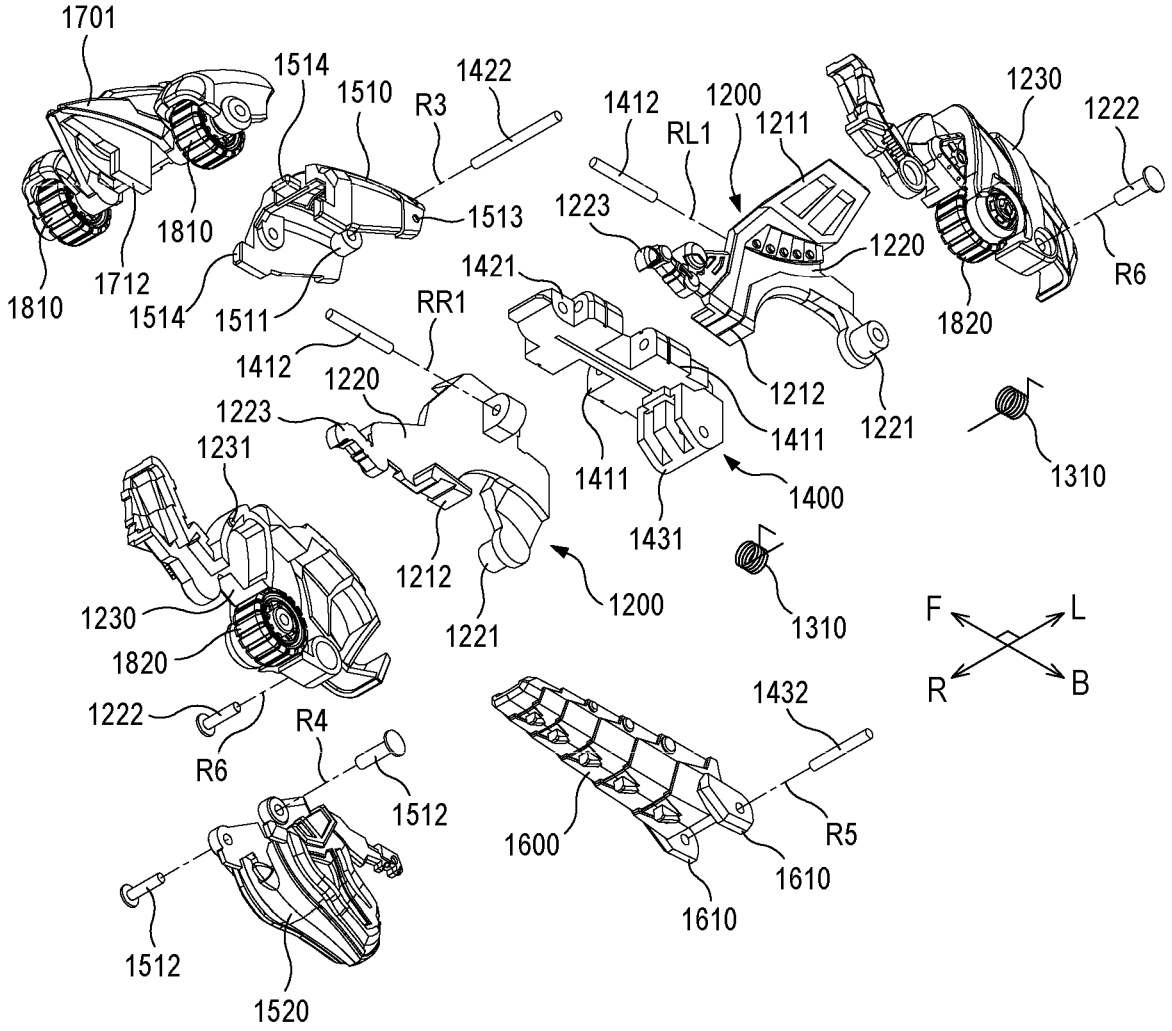
FIG. 4 is another exploded perspective view of the transformable toy shown in FIG. 1.

Hereinafter, a transformable toy 101, a model toy 201 and a toy set 11 according to a first embodiment of the present disclosure are described with reference to FIGS. 1 to 18. FIGS. 1 and 2 show a toy set and a transformable toy according to the first embodiment. FIGS. 3 and 4 are exploded perspective views of the transformable toy shown in FIG. 1. FIGS. 5 to 10 are a front lower perspective view, a rear lower perspective view, a plan view, a side view, a front view, and a rear view of the transformable toy shown in FIG. 1, respectively. FIGS. 11 to 17 show examples where the transformable toy according to the first embodiment is transformed and examples where the transformable toy is coupled to the model toy.

Referring to FIGS. 1 and 2, the toy set 11 includes the transformable toy 101 and the model toy 201. The model toy 201 may have an appearance corresponding to a shape of a land animal, for example, an appearance corresponding to a shape of a dinosaur which may be called a tyrannosaurus. FIG. 1 shows the transformable toy 101 independent from the model toy 201, and FIG. 2 shows a combination of the model toy and the transformable toy that is formed by coupling the transformable toy 101 to the model toy 201.

The model toy 201 may include: a torso portion 210; a neck extension portion 220 extending frontward from the torso portion 210; a head extension portion 230 extending frontward from the neck extension portion 220; a tail extension portion 240 extending rearward from the torso portion 210; and leg extension portions 250 extending downward from the torso portion 210. The torso portion 210 may have a shape of a torso of a tyrannosaurus. Further, the model toy 201 has, at the torso portion 210, a counter engaging portion 211 that functions for releasably coupling the transformable toy 101 and the model toy 201. The neck extension portion 220 may have a shape of a neck of a tyrannosaurus. The head extension portion 230 may have a shape of a head of a tyrannosaurus. The head extension portion 230 may have a chin portion 231 rotatably attached to the lower side thereof, and the chin portion 231 may have a shape of a lower jaw of a tyrannosaurus. The tail extension portion 240 may have a shape of a tail of a tyrannosaurus. The leg extension portions 250 include hind leg extension portions 251 that may have a shape of hind legs of the tyrannosaurus, and front leg extension portions 252 that may have a shape of front legs of the tyrannosaurus.

Referring to FIGS. 3 and 4, the transformable body 1101 includes a pair of grip portions 1200 configured to releasably grip the model toy. In the transformable body 1101, the pair of grip portions 1200 are configured to be rotatable in opposite directions about one rotation axis or a pair of rotation axes R1 (see FIG. 7). In the second state of the transformable toy 101, the pair of grip portions 1200 can grip the model toy by being rotated so as to be moved toward each other. Therefore, the transformable body 1101 can be releasably coupled to the model toy by the pair of grip portions 1200 which grip the model toy while covering the model toy. The pair of grip portions 1200 are configured to partially cover a portion of the model toy in the second state of the transformable body 1101. In this embodiment, the pair of grip portions 1200 are configured to partially cover each side portion of the torso portion of the model toy (see FIG. 1) by being rotated about first and second rotation axes RL1 and RR1.

The transformable body 1101 includes a pair of springs 1300 respectively disposed in the pair of grip portions 1200. The pair of grip portions 1200 are biased by the biasing force of the springs 1300 so as to be moved toward each other. Therefore, the transformable body 1101 may be stably coupled to the model toy in the state where the grip portions 1200 biased toward each other are coupled to the torso portion of the model toy. Further, since the rotatable members of the transformable body 1101 can be maintained by the biasing force of the springs 1300, the transformable body 1101 can be stably maintained in the first state by the biasing force of the springs 1300.

The transformable body 1101 includes a pair of manipulation portions 1211. Each manipulation portion 1211 is formed as a protrusion protruding from a base end of each grip portion 1200. The manipulation portion 1211 may have a shape that can be recognized as a wing. The manipulation portion 1211 extends from the base end of each grip portion 1200 in an oblique direction between a lateral side and an upper side. For example, as the user pinches the pair of manipulation portions 1211 and manipulates the pair of manipulation portions 1211 to move the pair of manipulation portions 1211 toward each other, the pair of grip portions 1200 can be rotated to the insertion position in the direction of moving them away from each other. In the state where the pair of grip portions 1200 are moved away from each other by the pair of manipulation portions 1211, the torso portion of the model toy can be inserted between the pair of grip portions 1200. Thereafter, as the manipulation portions 1211 are released, the pair of grip portions 1200 are moved toward each other by the biasing force of the springs 1300 and can grip the torso portion of the model toy (see FIGS. 1 and 2).

The pair of grip portions 1200 have engaging portions 1212 releasably engaged with the torso portion of the model toy, and the engaging portions 1212 are formed as a protrusion protruding from a distal end of the grip portion 1200. The model toy has, at each of left and right sides of the torso portion, a counter engaging portion 211 (see FIG. 1) corresponding to the engaging portion 1212. The counter engaging portion 211 is formed as a groove recessed from the lateral surface of the torso portion 210. In the second state of the transformable body 1101, the engaging portions 1212 are fitted to the counter engaging portions 211, thereby coupling the transformable body 1101, which is transformed into the second state, to the model toy.

The transformable body 1101 of the transformable toy includes: a frame portion 1400 that can function as a base portion of the transformable body 1101; and at least one covering portion configured to partially cover the model toy in the second state of the transformable body 1101. The frame portion 1400 functions as a spine of the transformable body. Further, the frame portion 1400 functions as a structure that rotatably supports the pair of grip portions 1200. The frame portion 1400 is configured to partially cover a back portion of the torso portion of the model toy (see FIG. 1) in the second state of the transformable body 1101, and is formed in a plate shape capable of partially covering the back portion. The pair of grip portions 1200 and the at least one covering portion that constitute the transformable body 1101 may be rotatably connected or coupled to the frame portion 1400.

A pair of rotation axes (R1), which are the rotation centers of the pair of grip portions 1200, include first and second rotation axes RL1 and RR1 (see FIG. 7) that are spaced apart from each other and pass through the frame portion 1400 or the pair of grip portions 1200 in the front direction F and the rear direction B. Therefore, the pair of grip portions 1200 include a first grip portion coupled to the frame portion 1400 so as to be rotatable about the first rotation axis RL1, which is one of the pair of rotation axes, and a second grip portion coupled to the frame portion 1400 so as to be rotatable about the second rotation axis RR1, which is the other of the pair of rotation axes. For example, the grip portion 1200 disposed at the left side of the frame portion 1400 may be the first grip portion, and the grip portion 1200 disposed at the right side of the frame portion 1400 may be the second grip portion.

The pair of grip portions 1200 releasably couple the transformable body 1101 transformed into the second state to the model toy, and the at least one covering portion covers a portion of the model toy. Therefore, when the transformable body 1101 transformed into the second state is coupled to the model toy, the at least one covering portion covers a portion of the model toy 201. Thus, the user can recognize the at least one covering portion as a portion of a kind of protector (armor) that covers the model toy 201.

The frame portion 1400 and each grip portion 1200 are connected by a first hinge joint. In this embodiment, the first hinge joint for connecting the frame portion 1400 and each grip portion 1200 may be composed of a hinge portion 1411 provided at each lateral side of the frame portion 1400, a counter hinge portion 1213 provided at the base end of each grip portion 1200, and a hinge shaft 1412 passing through the hinge portion 1411 and the counter hinge portion 1213. Each hinge shaft 1412 may correspond to the first rotation axis RL1 and the second rotation axis RR1. The hinge shaft constituting the first hinge joint may include a pin, a bolt or a screw.

The springs 1300 of this embodiment include a pair of torsion springs 1310. The torsion springs 1310 are disposed between the frame portion 1400 and the grip portions 1200 such that the hinge shafts 1412 pass through the respective insides of the torsion springs 1310. For example, one end of each torsion spring 1310 may be engaged on the surface of the frame portion 1400, and the other end of each torsion spring 1310 may be engaged on the counter hinge portion 1213 of the grip portion. An inner surface of each grip portion 1200 biased by each of the torsion springs 1310 makes contact with each side surface of the frame portion 1400, whereby the rotation of the grip portions toward the inside of the frame portion can be restricted.

Figure 7:
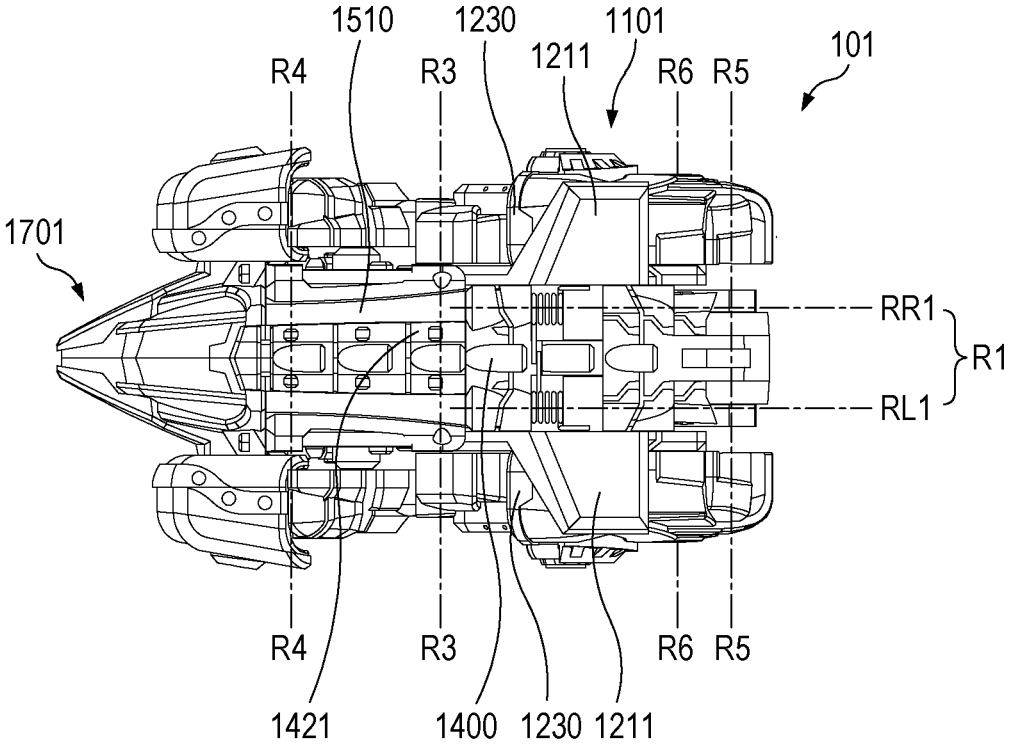
FIG. 7 is a plan view of the transformable toy shown in FIG. 1.
Figure 8:
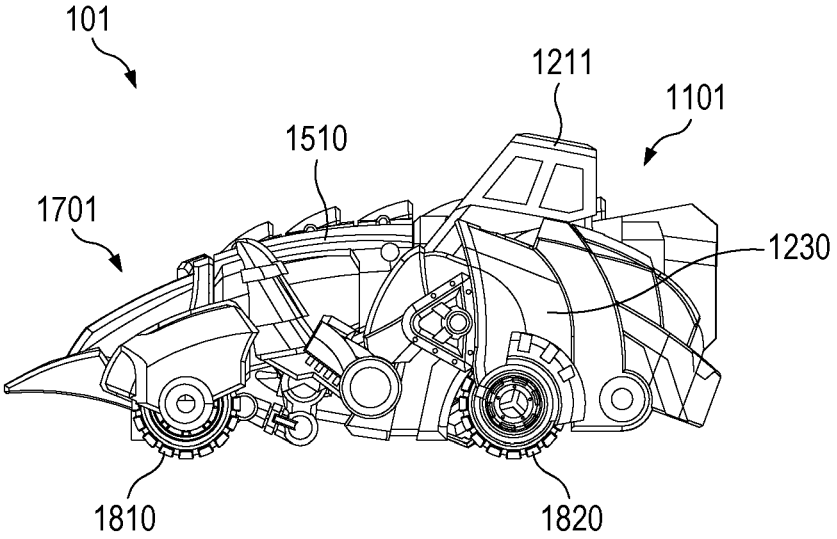
FIG. 8 is a side view of the transformable toy shown in FIG. 1.
Figure 9:
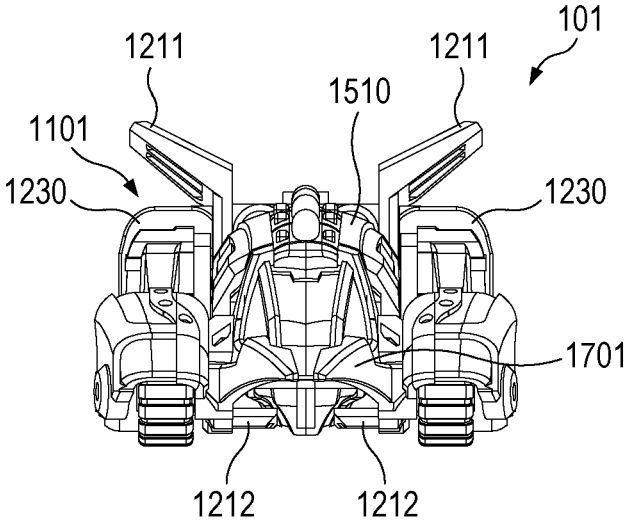
FIG. 9 is a front view of the transformable toy shown in FIG. 1.
Figure 10:
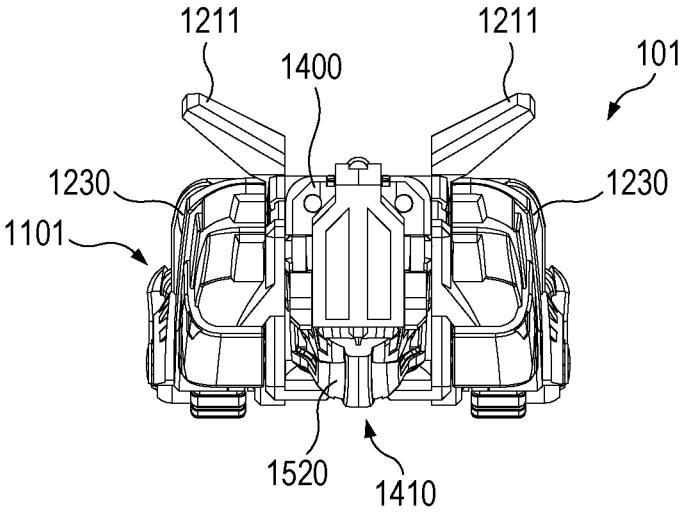
FIG. 10 is a rear view of the transformable toy shown in FIG. 1.

The transformable body 1101 includes, as a rotating covering portion of the at least one covering portion, a first covering portion 1500 coupled to a front end of the frame portion 1400 so as to be rotatable about a third rotation axis R3 (see FIG. 7). The third rotation axis R3 may be orthogonal to the first and second rotation axes RL1 and RR1. The first covering portion 1500 is configured to partially cover the neck extension portion 220 and the head extension portion 230 of the model toy (see FIG. 1).

The first covering portion 1500 includes a link portion 1510 coupled to the frame portion 1400 so as to be rotatable about the third rotation axis R3, and a distal end portion 1520 coupled to the vicinity of a front end of the link portion 1510 so as to be rotatable about a fourth rotation axis R4 (see FIG. 7) parallel to the third rotation axis R3. The link portion 1510 may be configured to partially cover the neck extension portion of the model toy. The distal end portion 1520 may be configured to partially cover the head extension portion and the chin portion of the model toy, and may have, for example, a shape that can be recognized as a helmet by the user.

The frame portion 1400 and the link portion 1510 are connected by a second hinge joint. The second hinge joint may be composed of a hinge portion 1421 provided at the front end of the frame portion 1400, a counter hinge portion 1511 provided at a rear end of the link portion 1510, and a hinge shaft 1422 passing through the hinge portion 1421 and the counter hinge portion 1511. The link portion 1510 can be rotated upward and downward with respect to the frame portion 1400. A stopper portion 1423 protrudes from a front end of the hinge portion 1421, and can restrict the downward rotation of the link portion 1510. Further, a portion of the rear end surface of the counter hinge portion 1511 makes contact with the front end surface of the frame portion 1400, whereby the upward rotation of the link portion 1510 can be restricted.

The link portion 1510 and the distal end portion 1520 are connected by a third hinge joint. The third hinge joint may be composed of a hinge portion 1521 provided at a base end of the distal end portion 1520, and a hinge shaft 1512 passing through a front end portion of the link portion 1510 and the hinge portion 1521. The distal end portion 1520 has a width narrower than that of the link portion 1510, and can be rotated into an inner space of the link portion 1510 in the first state of the transformable body 1101. A stopper portion 1522 protrudes from the hinge portion 1521. The stopper portion 1522 makes contact with the front end edge of the link portion 1510, whereby the upward rotation of the distal end portion 1520 can be restricted.

The transformable toy 101 includes, as a rotating covering portion of the at least one covering portion, a second covering portion 1600 coupled to a rear end of the frame portion 1400 so as to be rotatable about a fifth rotation axis R5 (see FIG. 7). The second covering portion 1600 is configured to partially cover the tail extension portion 240 (see FIG. 1) of the model toy. The fifth rotation axis R5 is spaced rearward from the third rotation axis R3.

The frame portion 1400 and the second covering portion 1600 are connected by a fourth hinge joint. The fourth hinge joint may be composed of a hinge portion 1431 provided at the rear end of the frame portion 1400, a counter hinge portion 1610 provided at a base end of the second covering portion 1600, and a hinge shaft 1432 passing through the hinge portion 1431 and the counter hinge portion 1610. The second covering portion 1600 can be rotated frontward and rearward with respect to the frame portion 1400. The base end of the second covering portion 1600 adjacent to the counter hinge portion 1610 makes contact with the hinge portion 1431, whereby the upward rotation and rearward rotation of the second covering portion 1600 can be restricted. The second covering portion 1600 can be folded into the frame portion 1400 so as to make contact a lower surface of the frame portion 1400 in the first state of the transformable body 1101.

Each grip portion 1200 includes a support portion 1220 and a rotation portion 1230. The support portion 1220 is configured to cover a portion of each side surface of the torso portion 210 of the model toy (see FIG. 1) in the second state of the transformable body 1101. The support portion 1220 constitutes a main body of each grip portion 1200. An engaging portion 1212 protrudes from a distal end of the support portion 1220. The rotation portion 1230 is coupled to the support portion 1220 so as to be rotatable about a sixth rotation axis R6 (see FIG. 7). The rotation portion 1230 is configured to partially cover the hind leg extension portion 251 of the model toy (see FIG. 1). A distal end portion of the rotation portion 1230 may be formed to correspond to the shape of a foot of the hind leg extension portion 251. The sixth rotation axis R6 may be parallel to the fifth rotation axis R5.

The support portion 1220 and the rotation portion 1230 are connected by a fifth hinge joint which may be composed of a hinge portion 1221 protruding downward and laterally from a rear end of the support portion 1220, and a hinge shaft 1222 coupled to the hinge portion 1221 through the rotation portion 1230 in the vicinity of a base end of the rotation portion 1230. A stopper portion may be provided in the hinge portion 1221, and an arc-shaped groove into which the stopper portion is inserted may be provided in an inner surface of the rotation portion 1230. The stopper portion of the hinge portion 1221 makes contact with the groove of the rotation portion 1230, whereby the rotation portion 1230 can be restricted at an upright position.

A fitting protrusion 1231 protruding inward is formed at an edge of the rotation portion 1230. The link portion 1510 of the first covering portion 1500 has, at the lateral surface thereof, a fitting hole 1513 into which the fitting protrusion 1231 is fitted. In the first state of the transformable body 1101, the fitting protrusion 1231 is fitted into the fitting hole 1513, whereby the rotation portion 1230 can be maintained at a traveling position parallel to the ground. Further, the support portion 1220 has a protruding portion 1223 protruding frontward, and the protruding portion 1223 is formed to partially cover the front leg extension portion 252 of the model toy (see FIG. 1).

Figure 5:
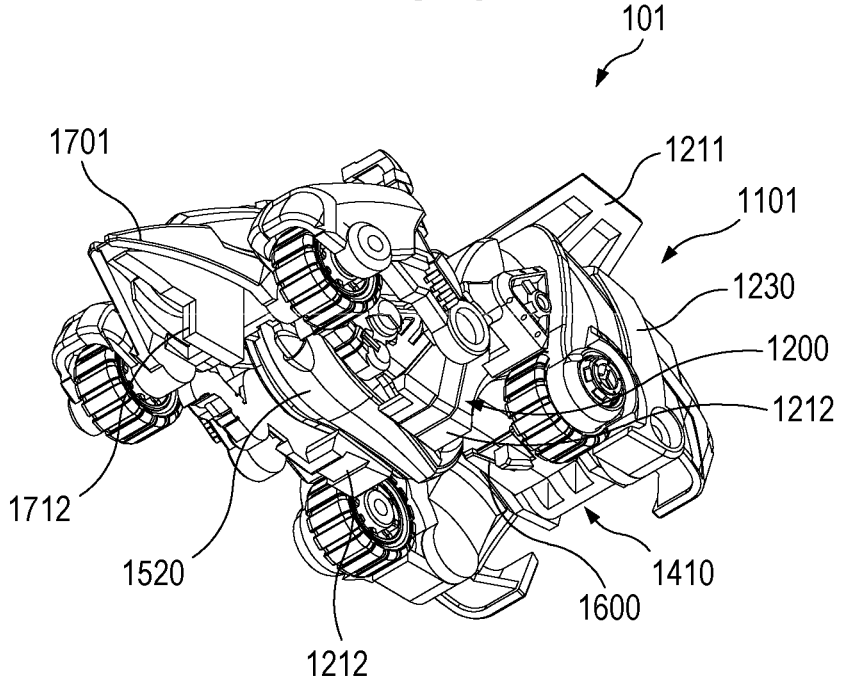
FIG. 5 is a front lower perspective view of the transformable toy shown in FIG. 1.
Figure 6:
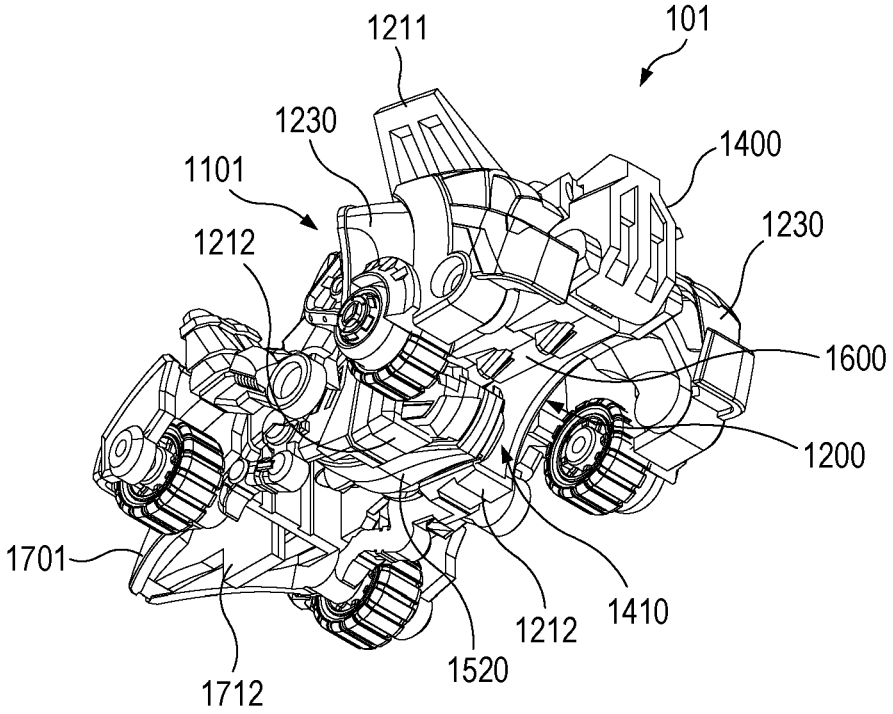
FIG. 6 is a rear lower perspective view of the transformable toy shown in FIG. 1.

As shown in FIGS. 5 and 6, in the first state of the transformable body 1101, the transformable body 1101 has a covering accommodation portion 1410 defined by the lower surface of the frame portion 1400 and the inner surfaces of the grip portions 1200. When the transformable body 1101 is transformed from the second state to the first state, the second covering portion 1600 can be rotated into the covering accommodation portion 1410. Further, the distal end portion 1520 of the first covering portion can be rotated into the covering accommodation portion 1410 while covering the second covering portion 1600. Further, in the state where the second covering portion 1600 and the distal end portion 1520 of the first covering portion are accommodated in the covering accommodation portion 1410, the engaging portions 1212 of the grip portions 1200 are located below the distal end portion 1520 and can grip the distal end portion 1520. Since the pair of grip portions 1200 are biased toward the inside of the frame portion by the biasing force of the torsion springs, the engaging portion 1212 can prevent the first covering portion 1500 and the second covering portion 1600 from being rotated from the covering accommodation portion 1410, and the transformable body 1101 can be maintained stably in the first state.

Referring to FIGS. 3 and 4, the transformable toy 101 includes an accessory body 1701 removably coupled to a front end of the transformable body 1101 in the first state of the transformable body 1101. For example, the accessory body 1701 may have a shape of a front part of a vehicle including front wheels. Further, a portion of an upper surface of the accessory body 1701 may have a shape like a canopy covering a cockpit.

Figure 11:
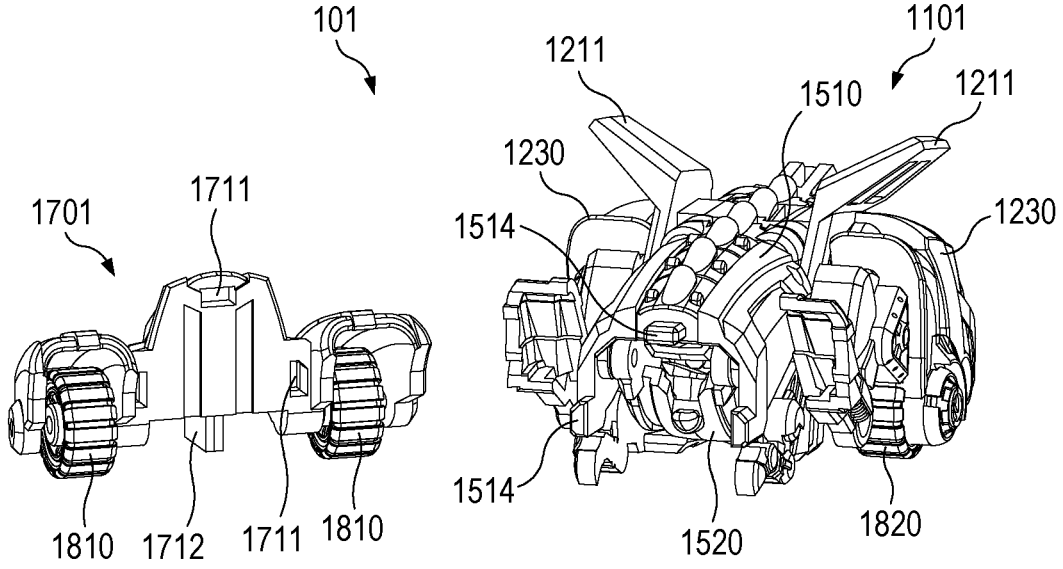
FIG. 11 is a perspective view showing a transformable body and an accessory body separated from each other in the transformable toy according to the first embodiment.

The accessory body 1701 may be removably coupled to the first covering portion 1500. Referring to FIGS. 3 and 11, the link portion 1510 has a plurality of fitting protrusions 1514 protruding frontward from a front edge, and the accessory body 1701 has fitting holes 1711 into which the respective fitting protrusions 1514 are fitted respectively. In the first state of the transformable body 1101, the fitting protrusions 1514 are fitted into the fitting holes 1711, whereby the accessory body 1701 can be removably coupled to the link portion 1510 of the first covering portion. Further, as shown in FIG. 3, the frame portion 1400 has a fitting hole 1441 in the upper surface in the vicinity of the rear end and, as shown in FIG. 4, the accessory body 1701 has a fitting protrusion 1712 protruding downward. In the second state of the transformable body 1101, the accessory body 1701 can be releasably coupled to the upper surface in the vicinity of the rear end of the frame portion 1400 through the fitting between the fitting protrusion 1712 and the fitting hole 1441.

The transformable body 1101 takes a shape different from the appearance of the model toy 201 in the first state. The second state of the transformable body 1101 of this embodiment has a form corresponding to a shape of a vehicle (see FIG. 1). For the vehicle form of the transformable body 1101, the transformable body 1101 includes a plurality of wheels for movement on the ground in the first state. The transformable body 1101 includes front wheels 1810 rotatably coupled to the accessory body 1701 and rear wheels 1820 rotatably coupled to the respective rear edges of the rotation portions 1230 of the grip portions. If the transformable body 1101 is transformed from the second state to the first state, the front wheels 1810 and the rear wheels 1820 can be placed on the ground. In the first state of the transformable body 1101, the rotation portions 1230 are rotated to the traveling position parallel to the ground, and the accessory body 1701 is coupled to the first covering portion 1500. Therefore, the front wheels 1810 and the rear wheels 1820 can be placed on the ground.

A transformation example of the transformable toy according to this embodiment and a coupling example of the transformable toy and the model toy are described with reference to FIGS. 11 to 18.

Referring to FIG. 11, in the first state of the transformable body 1101, the accessory body 1701 is separated from the transformable body 1101. The accessory body 1701 is kept in waiting to be coupled to the transformable body 1101 in the second state of the transformable body 1101.

Figure 12:
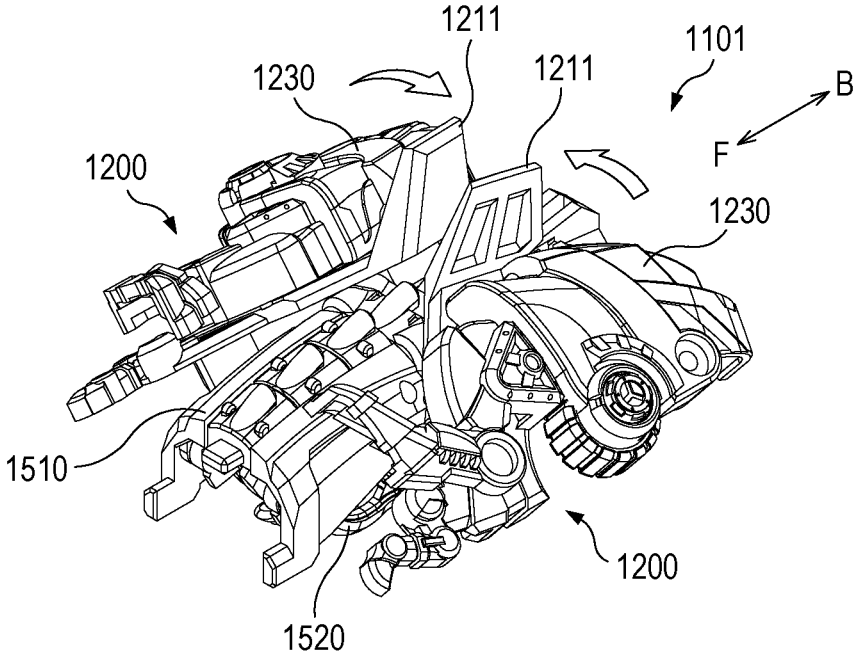
FIG. 12 is a perspective view showing a first example where the transformable body of the transformable toy according to the first embodiment is transformed.

Next, referring to FIG. 12, if an external force is applied to the manipulation portions 1211 in a direction of moving the manipulation portions 1211 toward each other, the pair of grip portions 1200 are rotated to the insertion position in opposite directions and are moved away from each other. Therefore, the distal end portion 1520 gripped by the pair of grip portions 1200 are released from the grip portions 1200.

Figure 13:
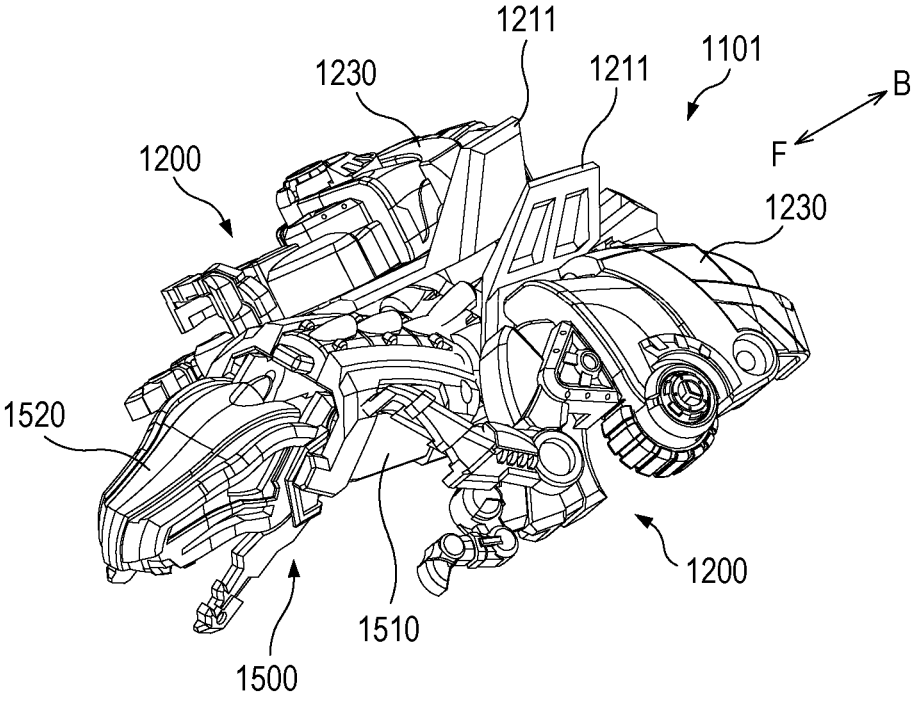
FIG. 13 is a perspective view showing a second example where the transformable body of the transformable toy according to the first embodiment is transformed.
Figure 14:
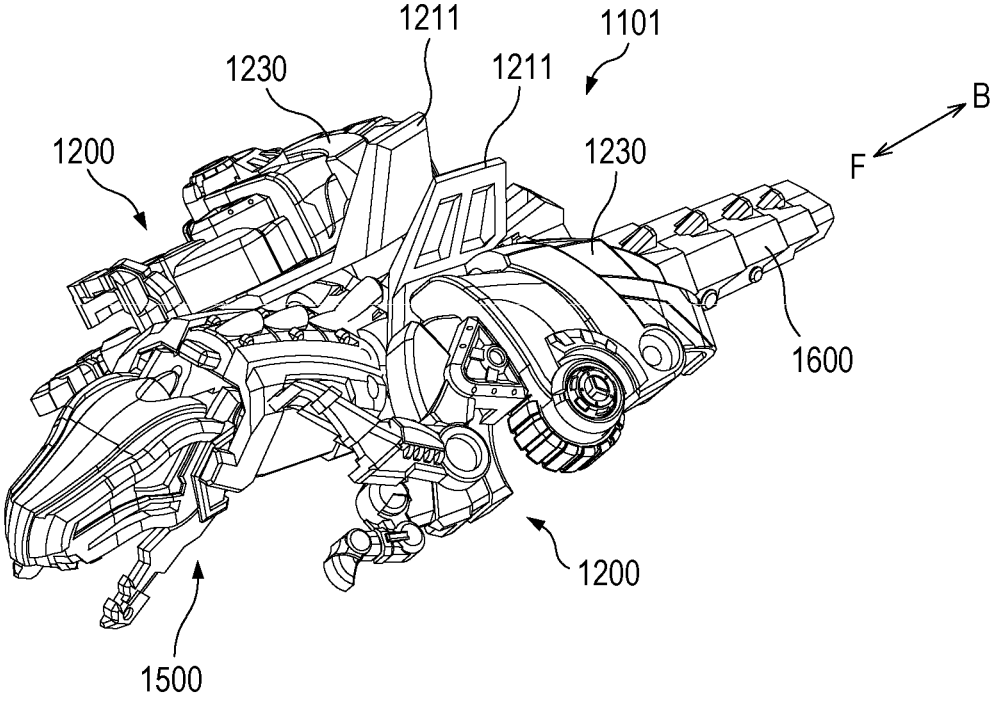
FIG. 14 is a perspective view showing a third example where the transformable body of the transformable toy according to the first embodiment is transformed.
Figure 15:
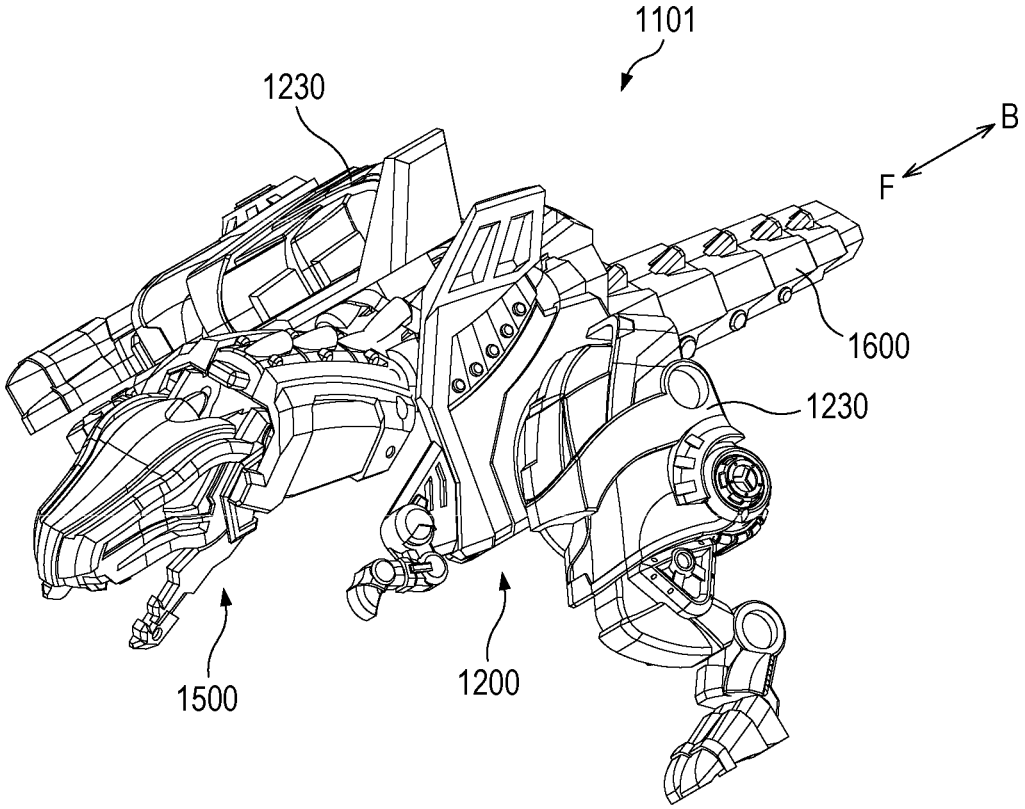
FIG. 15 is a perspective view showing a fourth example where the transformable body of the transformable toy according to the first embodiment is transformed.

Next, referring to FIG. 13, the distal end portion 1520 is rotated in the front direction F, and the link portion 1510 is rotated upward. Therefore, the first covering portion 1500 is rotated into the second state of the transformable body. Next, referring to FIG. 14, the second covering portion 1600 is rotated in the rear direction B to rotate into the second state of the transformable body. Next, referring to FIG. 15, the rotation portions 1230 of the grip portions 1200 are rotated from the traveling position and are positioned at the upright position. Therefore, the transformable body 1101 comes into the state where the pair of grip portions 1200 are moved away from each other and the first covering portion 1500, the second covering portion 1600 and the rotation portion 1230 are unfolded.

Figure 16:
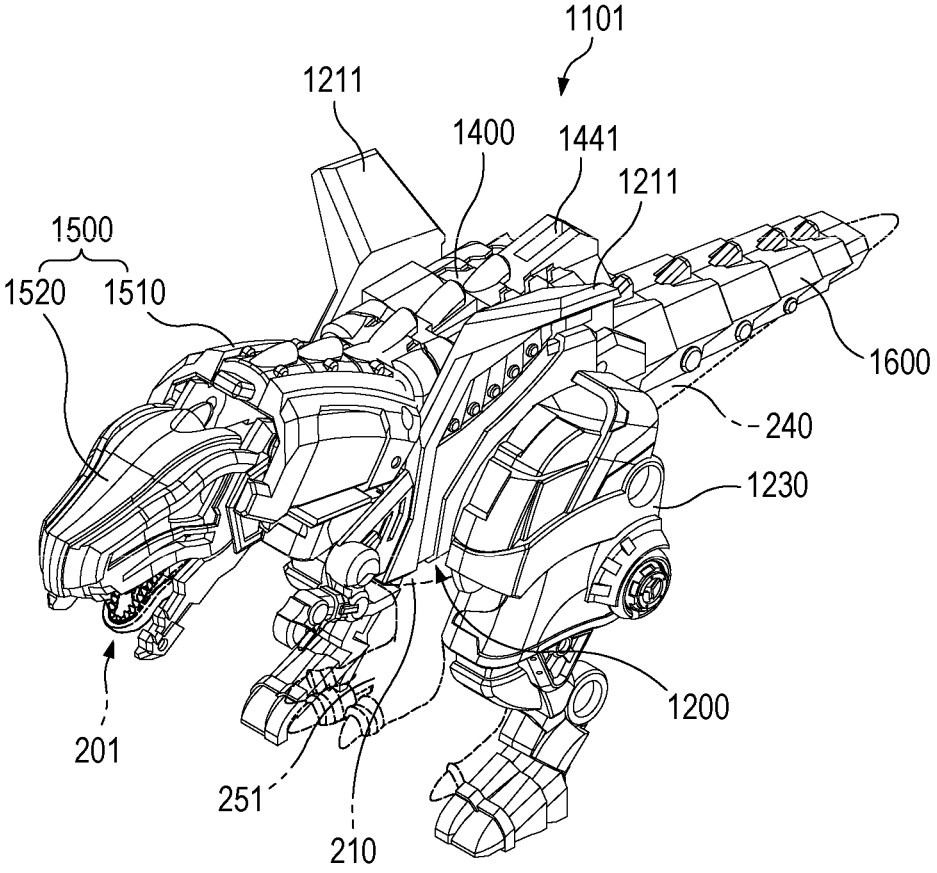
FIG. 16 is a perspective view showing a combination formed by coupling the transformable body of the transformable toy according to the first embodiment to a model toy.
Figure 17:
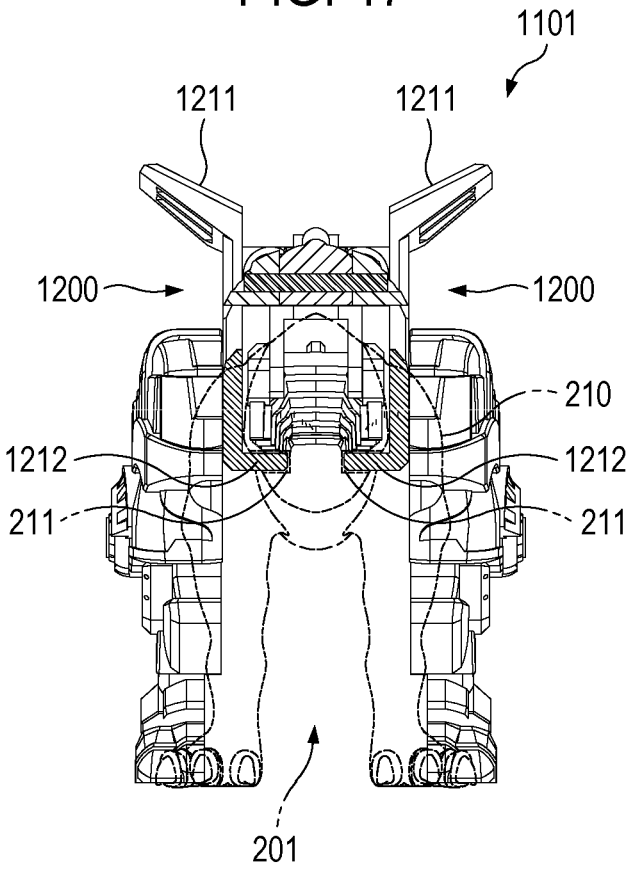
FIG. 17 is a cross-sectional view of the combination of the transformable body of the transformable toy and the model toy shown in FIG. 16.

Next, referring to FIGS. 16 and 17, the user inserts the torso portion 210 of the model toy 201 between the pair of grip portions 1200, which are moved away from each other to the insertion position by the manipulation portions 1211 (i.e., between the engaging portions moved away from each other). As the user releases the manipulation portions 1211, the pair of grip portions 1200 are rotated to the grip position by the biasing force of the torsion springs so as to be moved toward each other. Thus, the transformable body 1101 may be temporarily fixed to the model toy 201. Thereafter, the transformable body 1101 and the model toy 201 may be moved relatively such that the engaging portions 1212 of the grip portions 1200 are engaged with the counter engaging portions 211 of the torso portion 210. If the user performs the coupling between the engaging portions 1212 of the grip portions 1200 and the counter engaging portions 211 of the torso portion 210 at once, it is not necessary to perform the relative movement between the transformable body 1101 and the model toy 201. When the engaging portions 1212 of the grip portions 1200 are engaged with the counter engaging portions 211, mounting of the transformable body 1101 transformed into the second state on the model toy 201 can be completed, and the transformable body 1101 comes into the second state where the transformable body is releasably coupled to the model toy 201 and covers the model toy 201. In the state where the grip portions 1200 grip the torso portion 210, the first covering portion 1500 covers the head extension portion of the model toy, the second covering portion 1600 covers the tail extension portion of the model toy, and the rotation portions 1230 cover the hind leg extension portions of the model toy.

Figure 18:
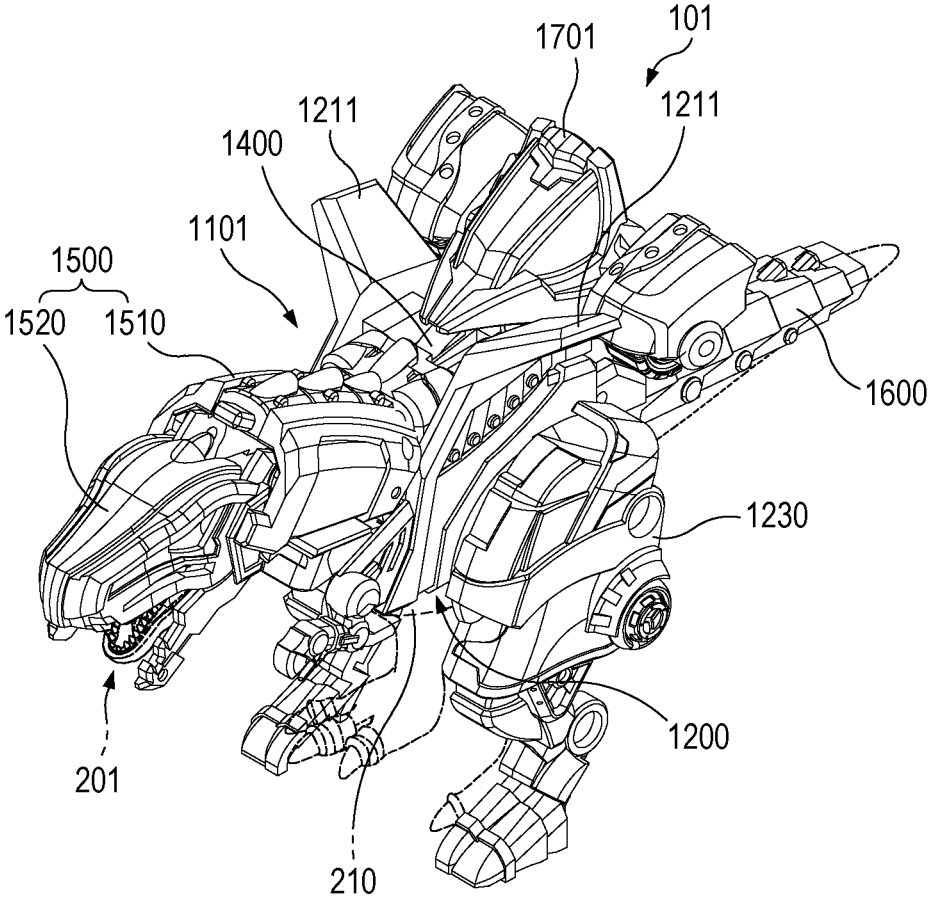
FIG. 18 is a perspective view showing that the accessory body shown in FIG. 11 is coupled to the combination shown in FIG. 17.

Next, as shown in FIG. 18, in the state where the transformable body 1101 is mounted on the model toy 201, the accessory body 1701 can be coupled to the upper surface in the vicinity of the rear end of the frame portion 1400.

The procedures in which the transformable body 1101 is transformed from the second state to the first state may be reversed from the above-described procedures. If the transformable body 1101 is transformed from the second state to the first state, the transformable body 1101 takes the form of the vehicle shown in FIG. 1. When the transformable body 1101 is reversibly transformed into the first state and the second state, the user performs the motion of pinching the manipulation portions 1211. Thus, the user can easily rotate the pair of grip portions 1200 so as to be moved away from each other. Since the pair of grip portions 1200 are easily moved away from each other by the motion of pinching the manipulation portions 1211 as described above, the transformable body 1101 can be transformed so as to be coupled to the model toy 201 by a simple manipulation and can be released from the model toy 201 by a simple manipulation.

As shown in FIGS. 2 and 18, in the second state where the transformable body 1101 covers the model toy 201, the user can recognize, from the combination of the model toy 201 and the transformable toy 101, that the model toy 201 is wearing a kind of protector (an armor and helmet) by the grip portions 1200, the rotation portions 1230 of the grip portions 1200, the first covering portion 1500 and the second covering portion 1600. The user can have fun that the transformable toy is capable of traveling from the first state of the transformable body 1101 taking the form of the vehicle. Further, the user can have fun related to the distinctive shape of the model toy 201 from the appearance of the model toy 201. In addition, from the combination of the transformable toy 101 and the model toy 201, the user can have novel fun completely different from the fun provided by the separated form of the transformable toy 101 and the model toy 201, i.e., fun that the transformable toy having the form of the vehicle is transformed so as to become the armor and helmet of the model toy and the model toy is wearing the armor and helmet made by the transformable toy. The first state and the second state of the transformable body 1101 are two distinctive states of the transformable body 1101. The intermediate form, which the transformable body 1101 takes while being reversibly transformed into the first state and the second state, can partially correspond to the shape of the model toy 201. Thus, the user can have further fun from the transformable toy 101 in such an intermediate form.

Figure 19:
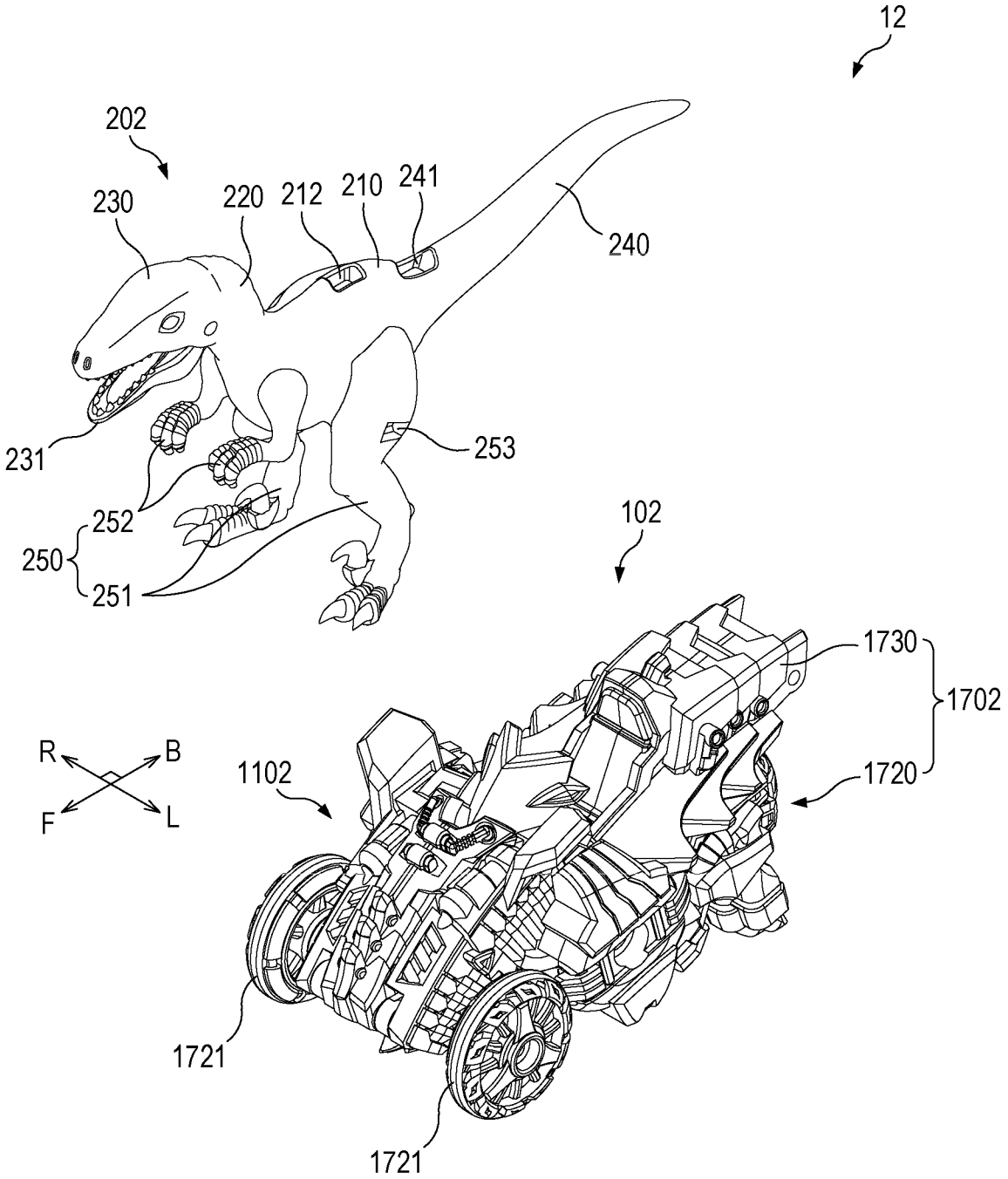
FIG. 19 is a perspective view showing a toy set according to a second embodiment of the present disclosure.
Figure 20:
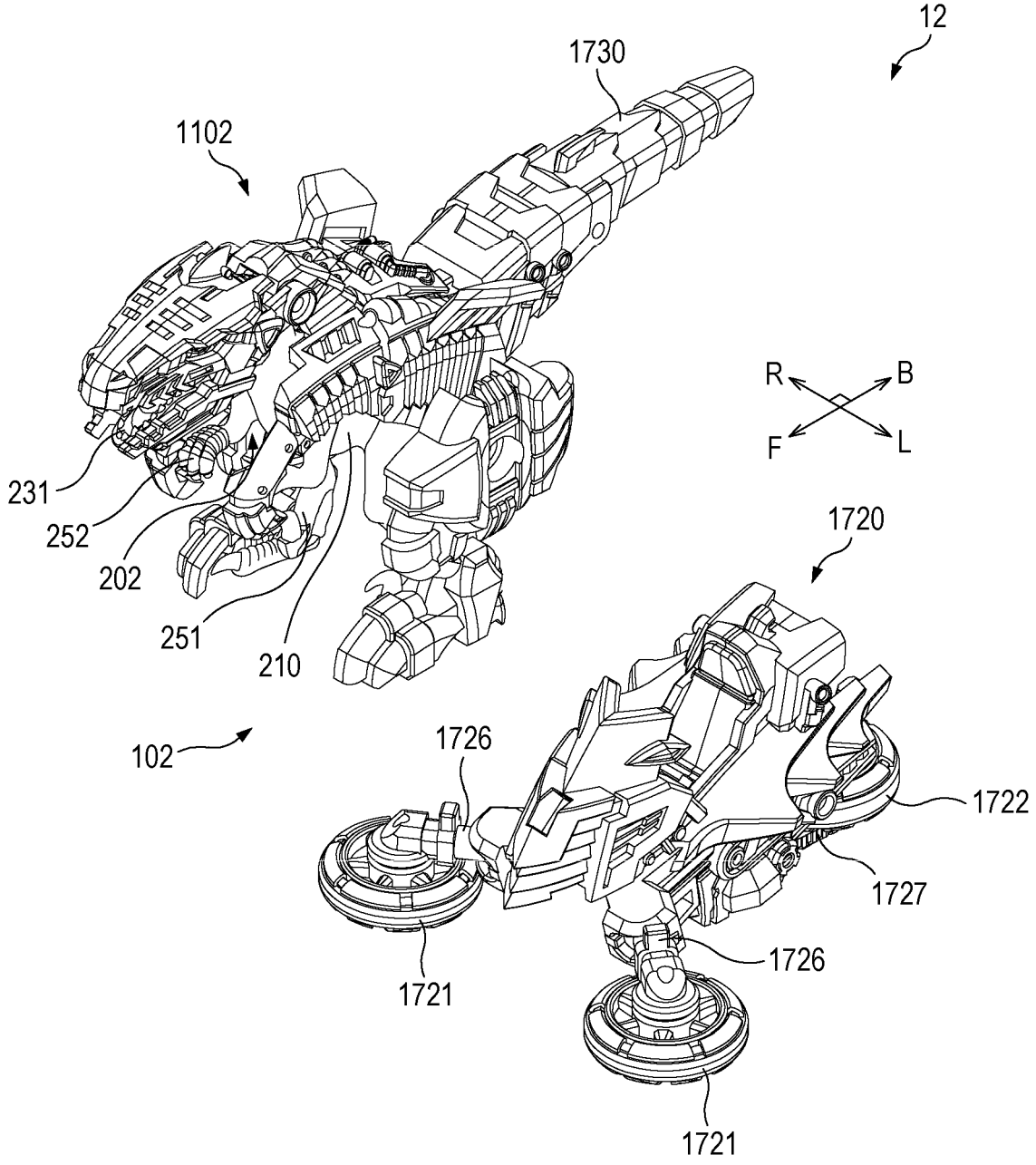
FIG. 20 is a perspective view showing a combination of a model toy and a transformable toy shown in FIG. 19 and a transformed accessory body.
Figure 21:
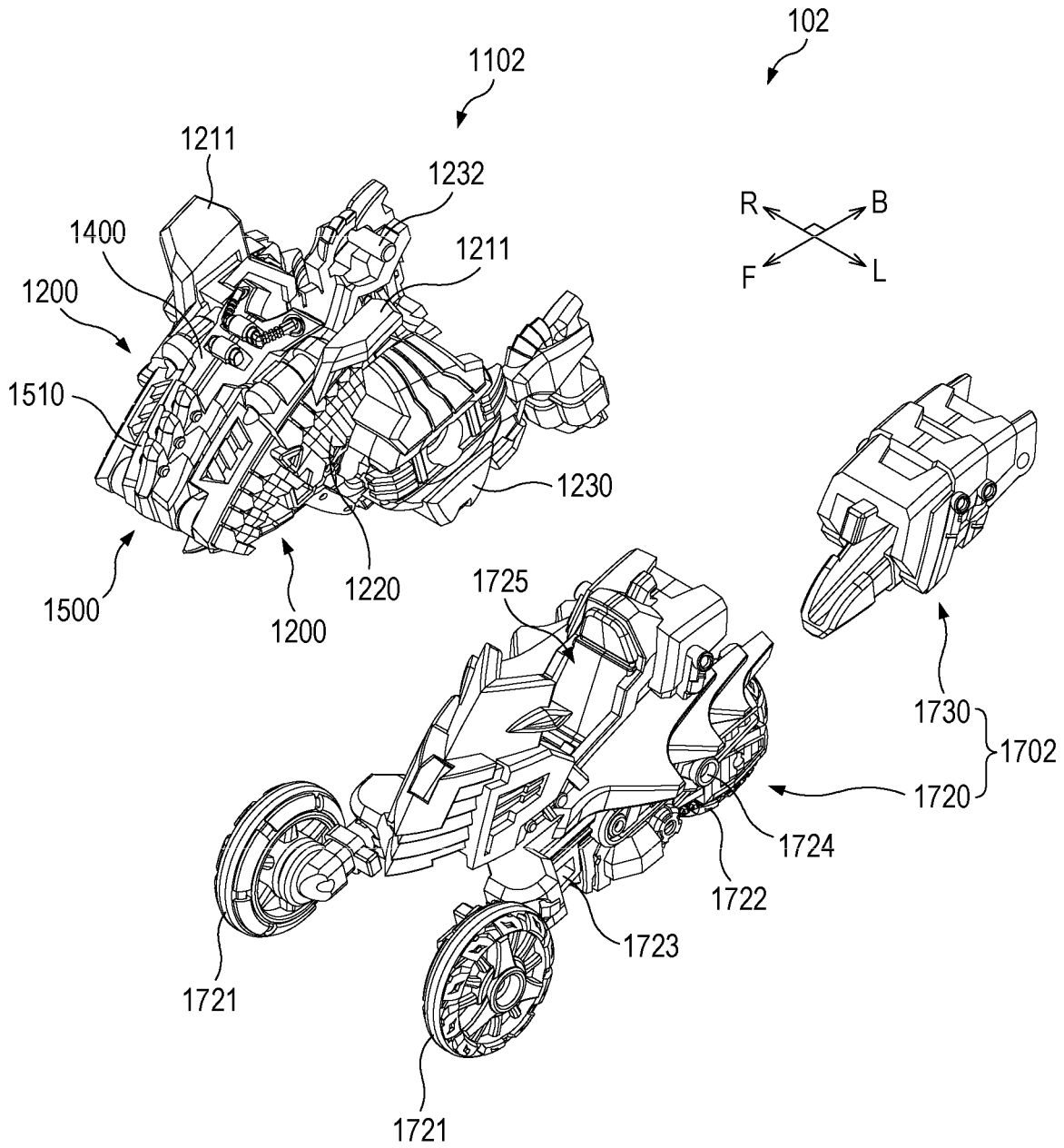
FIG. 21 is a perspective view showing a transformable body and an accessory body of the transformable toy according to the second embodiment.
Figure 22:
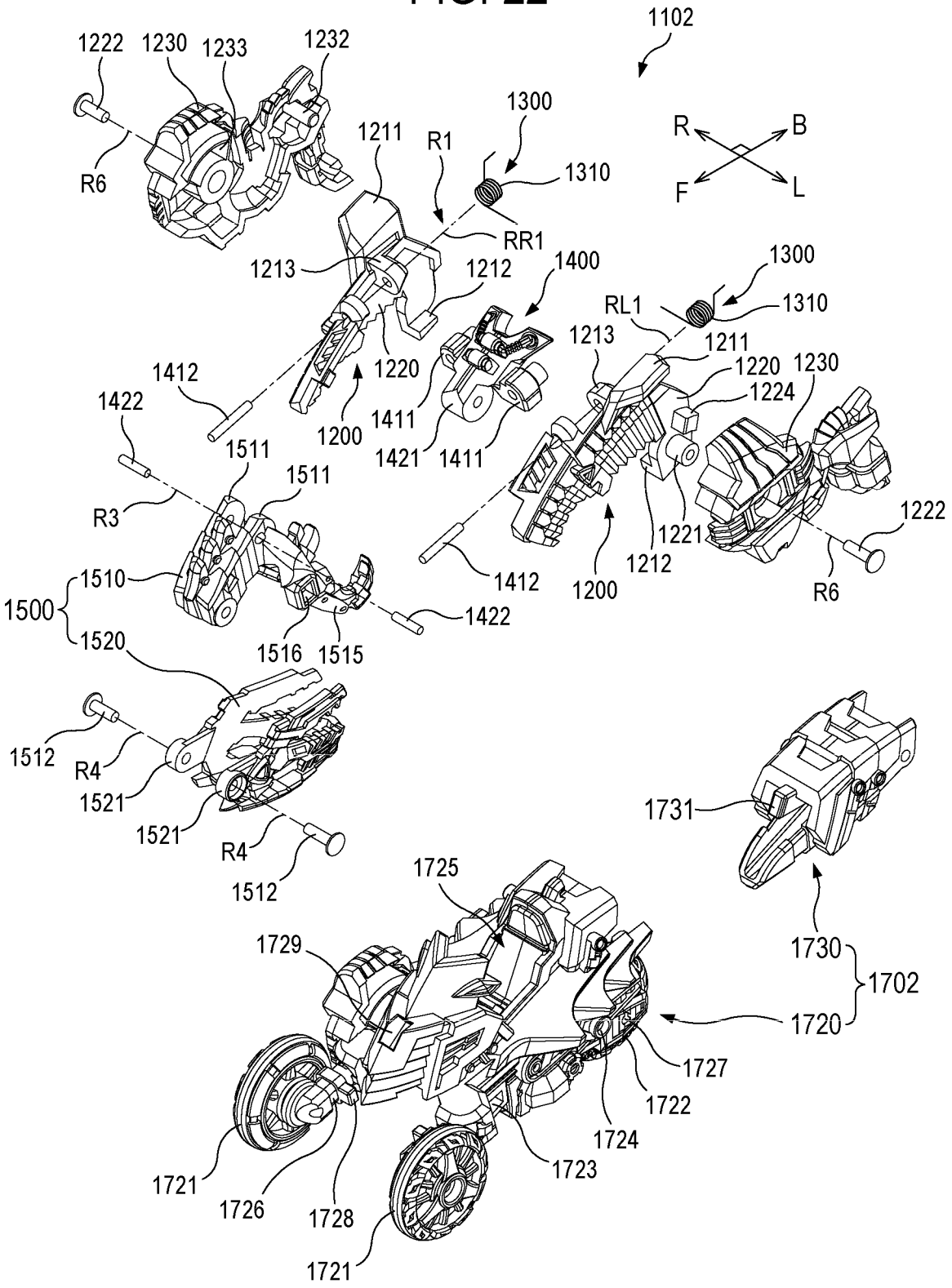
FIG. 22 is an exploded perspective view of the transformable toy shown in FIG. 19.
Figure 23:
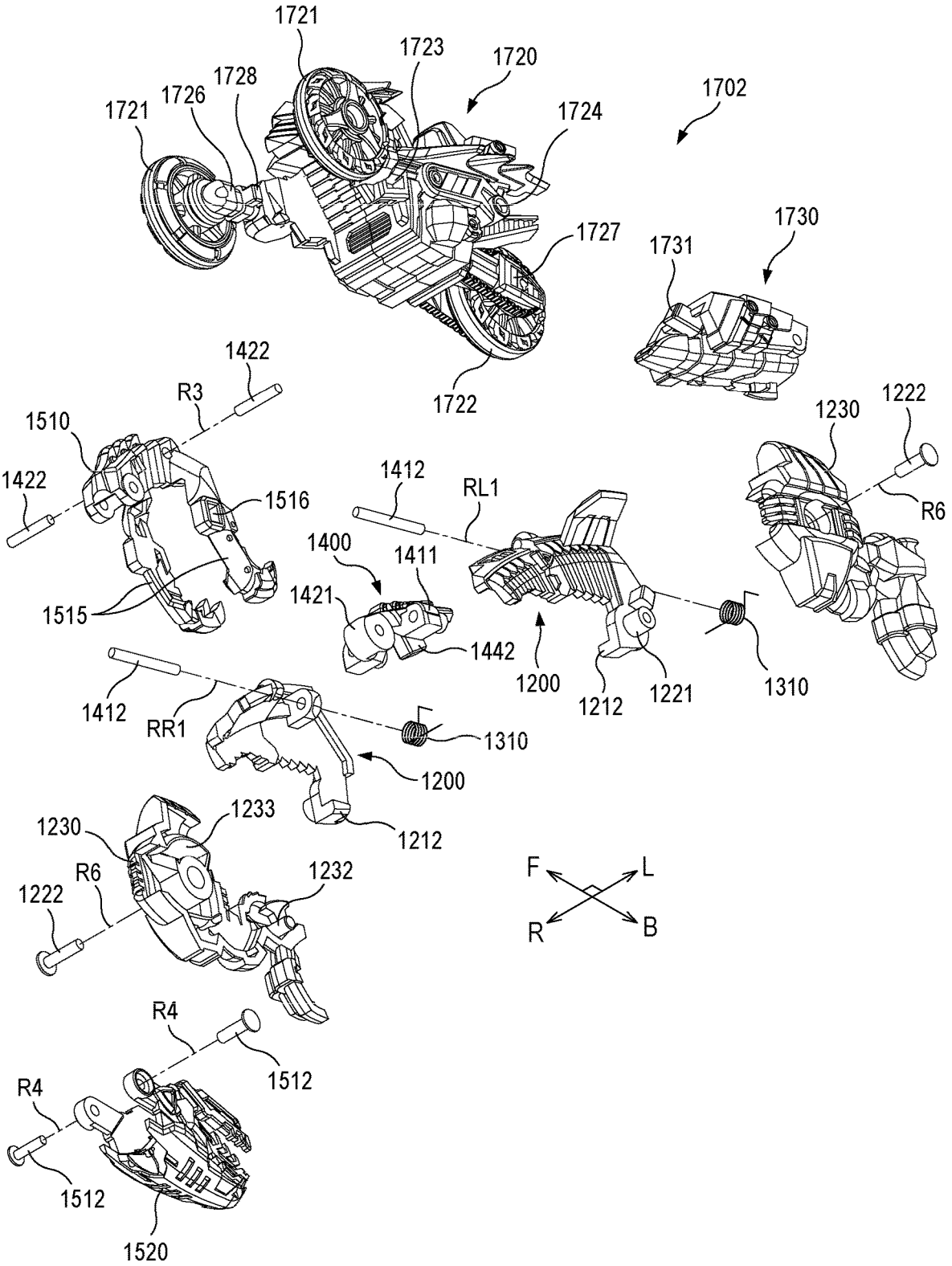
FIG. 23 is another exploded perspective view of the transformable toy shown in FIG. 19.
Figure 24:
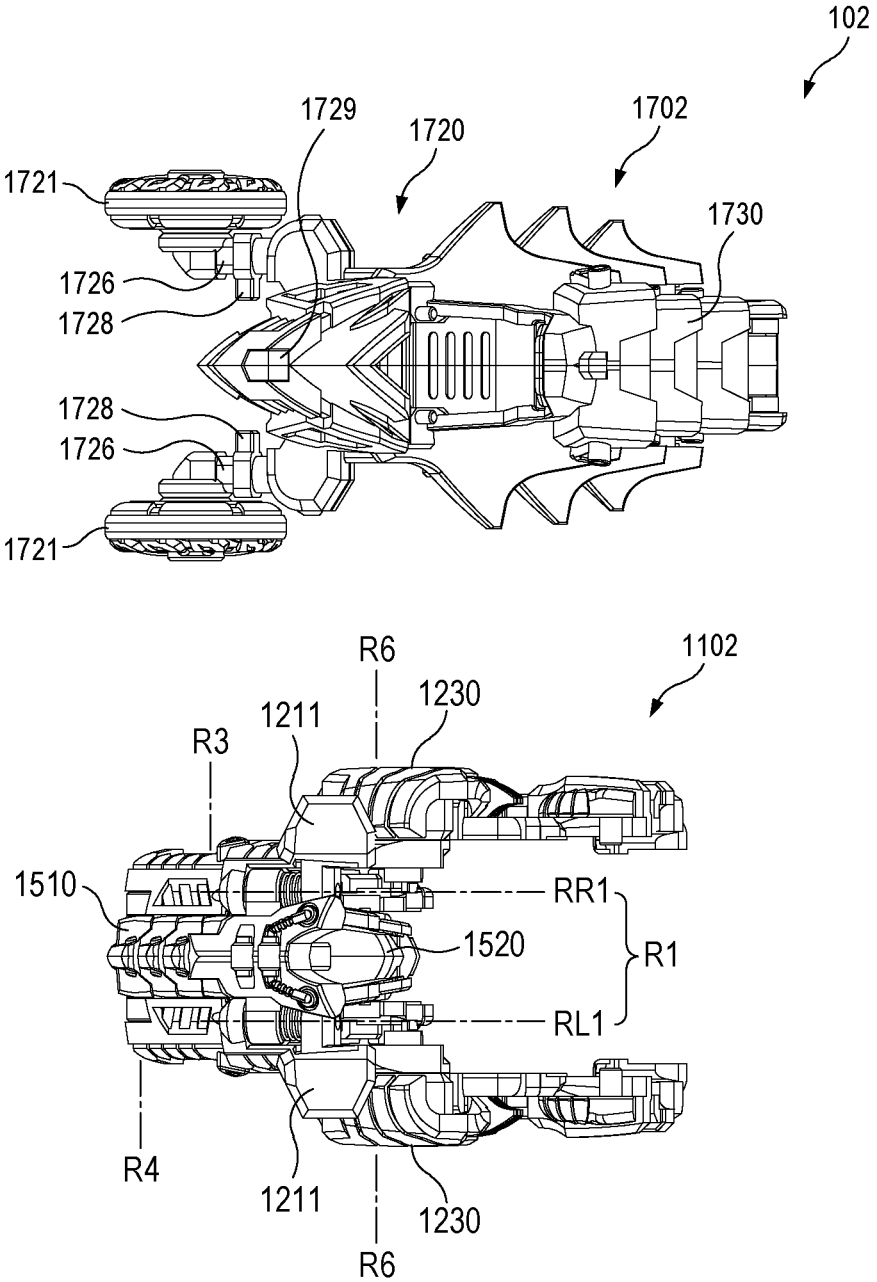
FIG. 24 is a plan view of the transformable toy shown in FIG. 21.
Figure 25:
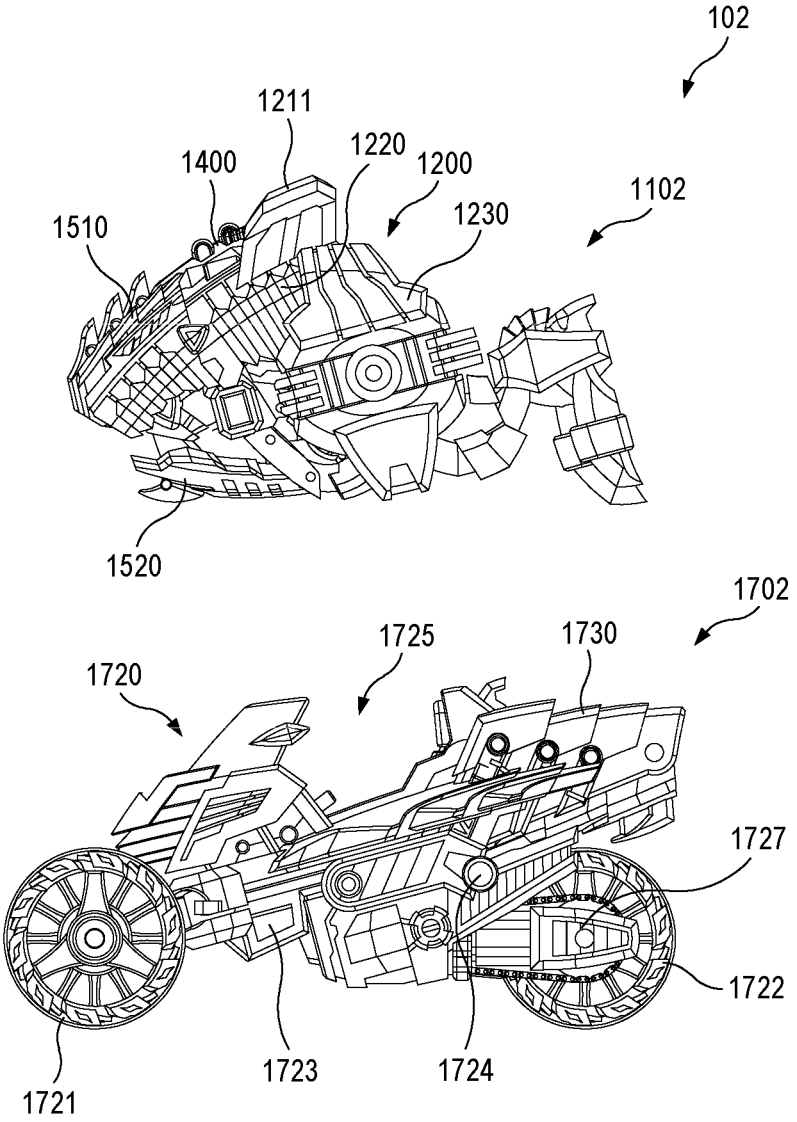
FIG. 25 is a side view of the transformable toy shown in FIG. 21.
Figure 26:
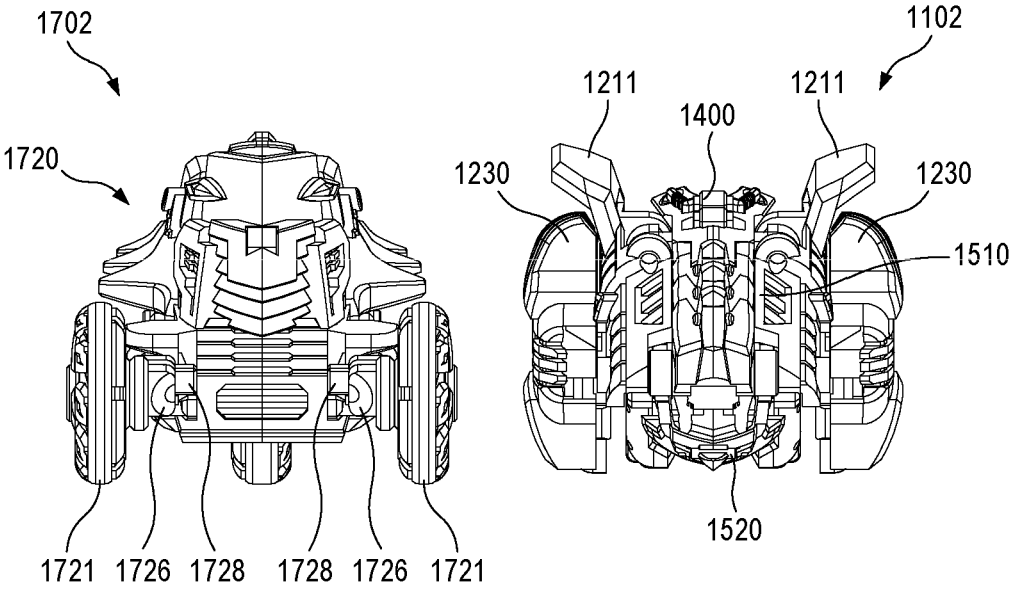
FIG. 26 is a front view of the transformable toy shown in FIG. 21.

Hereinafter, a transformable toy 102, a model toy 202, and a toy set 12 according to a second embodiment of the present disclosure are described with reference to FIGS. 19 to 33. FIGS. 19 and 20 show the toy set and the transformable toy according to the second embodiment. FIG. 21 shows a transformable body and an accessory body of the transformable toy according to the second embodiment. FIGS. 22 and 23 are exploded perspective views of the transformable toy shown in FIG. 19. FIGS. 24 to 28 are a plan view, a side view, a front view, a rear view, and a bottom view of the transformable toy shown in FIG. 21, respectively. FIGS. 29 to 33 show examples where the transformable toy according to the second embodiment is transformed and examples where the transformable toy according to the second embodiment is coupled to the model toy.

In the following descriptions related to the second embodiment, components of the second embodiment equivalent or corresponding to those of the foregoing first embodiment are denoted by like reference numerals, and descriptions thereof may be omitted. The components of the second embodiment whose description is omitted can be understood by referring to the description of the first embodiment.

Referring to FIG. 19, the toy set 12 according to the second embodiment includes the transformable toy 102 and the model toy 202. The model toy 202 has an appearance corresponding to a shape of a land animal, for example, an appearance corresponding to a shape of a dinosaur which may be called a raptor.

The model toy 202 has a shape similar to the model toy of the foregoing first embodiment. The model toy 202 has a counter engaging portion 253 formed as a fitting groove in an outward surface of each hind leg extension portion 251. The counter engaging portion 253 functions for releasably coupling the model toy 202 and the transformable toy 102. Further, a fitting hole 212 is formed in the upper surface of a torso portion 210, and a fitting hole 241 is formed in the upper surface of a tail extension portion 240. The fitting hole 212 and the fitting hole 241 function for coupling a portion of the transformable toy 102 and the model toy 202.

The transformable toy 102 shown in FIG. 19 is independent from the model toy 202. The transformable toy 102 is transformable so as to cover the model toy 202, and is releasably coupled to the model toy 202 in the transformed state. The transformable toy 102 includes a transformable body 1102 configured to be transformed so as to be releasably coupled to the model toy 202, and an accessory body 1702 removably coupled to the transformable body 1102 and configured to partially cover the model toy 202.

Referring to FIG. 20, both the transformable body 1102 of the transformable toy 102 and a portion of the accessory body 1702 of the transformable toy 102 are coupled to the model toy 203, thereby making a combination of the transformable toy and the model toy. Accordingly, the transformable body 1102 is configured to be transformed into a first state where the transformable body is independent from the model toy 202 (the state of the transformable body shown in FIG. 19) and a second state where the transformable body at least partially covers the model toy 202 and is releasably coupled to the model toy 202 (the state of the transformable body shown in FIG. 20). In this embodiment, as shown in FIG. 19, the transformable body 1102 is coupled to the accessory body 1702 in the first state. The transformable body 1102 and the accessory body 1702 coupled to each other have a form corresponding to a vehicle shape, for example, a shape that can be recognized as a motorbike.

Referring to FIGS. 21 to 23, the transformable body 1102 includes a pair of grip portions 1200 configured to releasably grip the model toy 202. The pair of grip portions 1200 can releasably grip the torso portion and the hind leg extension portions of the model toy. In the transformable body 1102, the pair of grip portions 1200 are configured to be rotated in opposite directions about a pair of rotation axes (specifically, the first rotation axis RL1 and the second rotation axis RR1) (see FIG. 24). In the second state of the transformable body 1102, since the pair of grip portions 1200 grip the torso portion and the hind leg extension portions of the model toy, the transformable body 1102 can be coupled to the model toy 202 while covering the model toy 202. The pair of grip portions 1200 may be configured to be rotated in opposite directions about one rotation axis in the transformable body 1102. The pair of grip portions 1200 can be rotated to the insertion position where the pair of grip portions 1200 are moved away from each other to allow the torso portion of the model toy and a portion of the hind leg extension portion of the model toy to be inserted between the pair of grip portions 1200, and the grip position where the pair of grip portions 1200 are moved toward each other to releasably grip the hind leg extension portions of the model toy. In this embodiment, the pair of grip portions 1200 may be configured to partially cover the left and right side surfaces of the torso portion and the left and right side surfaces of the hind leg extension portions of the model toy by being rotated about the first and second rotation axes RL1 and RR1 in the second state of the transformable body 1102.

The pair of grip portions 1200 are biased toward each other, i.e., toward the grip position by at least one spring 1300. The pair of grip portions 1200 are biased by the spring 1300 so as to be moved toward each other. The spring 1300 may be coupled to the pair of grip portions 1200 in the transformable body 1102. The transformable body 1102 may include a pair of springs disposed in the pair of rotation axes R1, respectively, and configured to bias one of the pair of grip portions 1200 toward the other of the pair of grip portions. The spring 1300 of this embodiment includes a pair of torsion springs 1310.

The pair of grip portions 1200 are biased so as to be moved toward each other by the biasing force of the torsion springs 1310. Therefore, the transformable body 1102 can be stably coupled to the model toy in the state where the grip portions 1200 biased toward each other are coupled to the hind leg extension portions of the model toy. Further, the transformable body 1102 can be stably maintained in the first state by the biasing force of the torsion springs 1310.

The transformable body 1102 includes a pair of manipulation portions 1211 that can be manipulated to rotate the pair of grip portions 1200. The pair of manipulation portions 1211 may be configured to be moved toward each other when the pair of grip portions 1200 are rotated so as to be moved away from each other. When the transformable body 1102 has the springs, the manipulation portions 1211 can be manipulated to rotate the grip portions 1200 against the biasing force of the springs 1300. The manipulation portions 1211 may be disposed at the respective grip portions 1200. The pair of grip portions 1200 can be rotated about the rotation axis R1 in the direction of the force applied to the manipulation portions 1211. The pair of manipulation portions 1211 are formed as a protrusion that protrudes from the base end of each grip portion 1200 and takes a shape of a wing. The manipulation portions 1211 extend from the base ends of the grip portions 1200 in an oblique direction between the lateral side and the upper side. In the state where the pair of grip portions 1200 are moved away from each other by the pair of manipulation portions 1211, the torso portion and the hind leg extension portions of the model toy can be inserted between the pair of grip portions 1200. Thereafter, as the manipulation portions 1211 are released, the pair of grip portions 1200 can be moved toward each other by the biasing force of the torsion springs 1310 and can grip the hind leg extension portions of the model toy.

The pair of grip portions 1200 and the model toy may be releasably coupled to each other by engaging portions that are complementarily engaged with each other. Each of the pair of grip portions 1200 includes an engaging portion 1212 configured to be engaged with the model toy, and the model toy includes, at the hind leg extension portions, counter engaging portions 253 (see FIG. 19) configured to be complementarily coupled to the engaging portions 1212. Each of the engaging portions 1212 of the pair of grip portions 1200 are formed to protrude toward the other of the pair of grip portions 1200 in the state where the pair of grip portions 1200 are moved toward each other. The engaging portions 1212 of the grip portions are formed as a male engaging portion having the shape of a protrusion or a pin protruding from the distal end of the grip portion 1200. The counter engaging portions 253 of the model toy are formed in the left and right side surfaces of the hind leg extension portion 251 as a female engaging portion that releasably fits with the engaging portion 1212 and has a shape of a groove or hole. In the second state of the transformable body 1102, the engaging portions 1212 are fitted to the counter engaging portions 253, thereby coupling the transformable body 1102, which is transformed into the second state, to the model toy.

The transformable body 1102 includes a frame portion 1400 that can function as a base portion, for example, as a spine of the transformable body 1102, and at least one covering portion configured to partially cover the model toy in the second state of the transformable body 1102.

The frame portion 1400 is configured to partially cover a portion corresponding to a back of the torso portion of the model toy (see FIG. 19) in the second state of the transformable body 1102. The frame portion 1400 has a fitting protrusion 1442 protruding downward from the lower surface thereof. When the transformable body 1102 in the second state is coupled to the model toy, the fitting protrusion 1442 is fitted into a fitting hole 212 (see FIG. 19) formed in the torso portion of the model toy, and therefore the frame portion 1400 can be fixed to the torso portion of the model toy.

The pair of grip portions 1200 are rotatably coupled to the frame portion 1400. A pair of rotation axes R1, which are the rotation centers of the pair of grip portions 1200, includes the first rotation axis RL1 and the second rotation axis RR1 spaced apart from each other and passing through the frame portion 1400 or the pair of grip portions 1200 in the front direction F and the rear direction B. Therefore, the pair of grip portions 1200 includes the first grip portion coupled to the left side of the frame portion 1400 so as to be rotatable about the first rotation axis RL1, and the second grip portion coupled to the right side of the frame portion 1400 so as to be rotatable about the second rotation axis RR1.

The pair of grip portions 1200 releasably couple the transformable body 1102 transformed into the second state to the model toy, and the at least one covering portion covers a portion of the model toy 202. Accordingly, since the at least one covering portion covers a portion of the model toy 201 after the transformable body 1102 transformed into the second state is coupled to the model toy 201, the at least one covering portion can be recognized by the user as a portion of a protector (an armor) that covers the model toy.

The frame portion 1400 and each grip portion 1200 are connected by a first hinge joint in the transformable body 1102. The transformable body 1102 is provided with a pair of first hinge joints through which the first rotation axis RL1 and the second rotation axis RR1 pass respectively. The first hinge joint may be composed of a hinge portion 1411 provided in the lateral side of the frame portion 1400, a counter hinge portion 1213 provided in the base end side of each grip portion 1200, and a hinge shaft 1412 that passes through the hinge portion 1411 and the counter hinge portion 1213.

The spring 1300 of this embodiment includes a pair of torsion springs 1310. The torsion springs 1310 are disposed between the frame portion 1400 and the grip portions 1200 such that the hinge shaft 1412 passes through the inside of the torsion spring 1310. One end of each of the torsion springs 1310 is engaged on the surface of the frame portion 1400, and the other end of each of the torsion springs 1310 is engaged on the counter hinge portion 1213 of each grip portion. The inner surface of each grip portion 1200 biased by each of the torsion springs 1310 makes contact with each side surface of the frame portion 1400, whereby the rotation of the grip portions 1200 toward the inside of the frame portion 1400 can be restricted.

The at least one covering portion of the transformable body 1102 may be configured to partially cover the model toy in the state where the at least one covering portion is fixed to a specific position in the second state of the transformable body 1102. The transformable body 1102 includes a first covering portion 1500 as a rotating covering portion of the at least one covering portion. The first covering portion 1500 is coupled to the front end of the frame portion 1400 so as to be rotatable about a third rotation axis R3 (see FIG. 24), and is configured to partially cover the neck extension portion and the head extension portion of the model toy (see FIG. 19). The first covering portion 1500 includes a link portion 1510 coupled to the frame portion 1400 so as to be rotatable about the third rotation axis R3, and a distal end portion 1520 coupled to the vicinity of the front end of the link portion 1510 so as to be rotatable about a fourth rotation axis R4 (see FIG. 24). The link portion 1510 is configured to partially cover the neck extension portion of the model toy. The distal end portion 1520 is configured to partially cover the head extension portion and the chin portion of the model toy. The distal end portion 1520 has, for example, a shape that can be recognized by the user as a helmet that covers the head extension portion.

The frame portion 1400 and the link portion 1510 are connected by a second hinge joint. The second hinge joint may be composed of a hinge portion 1421 provided at the front end of the frame portion 1400, a counter hinge portion 1511 provided at the rear end of the link portion 1510, and a hinge shaft 1422 passing through the hinge portion 1421 and the counter hinge portion 1511. The link portion 1510 can be rotated upward and downward with respect to the frame portion 1400. The rear end surface of the link portion 1510 in the vicinity of the counter hinge portion 1511 makes contact with the front end surface of the frame portion 1400, whereby the downward rotation of the link portion 1510 can be restricted. A portion of the rear end surface of the counter hinge portion 1511 makes contact with the upper surface in the vicinity of the front end of the frame portion 1400, whereby the upward rotation of the link portion 1510 can be restricted.

The link portion 1510 has a pair of extension portions 1515 extending downward from the rear end thereof. Each extension portion 1515 is configured to partially cover the front leg extension portion of the model toy (see FIG. 19), and can make contact with the front surface of each grip portion 1200 at an upper surface of a portion thereof. A fitting hole 1516 is formed in each of the pair of extension portions 1515. When the accessory body 1702 and the transformable body 1102 are coupled in the first state of the transformable body 1102, a portion of the accessory body 1702 is fitted into the fitting hole 1516.

The distal end portion 1520 can be rotated and then inserted between the pair of extension portions 1515 in the first state of the transformable body 1102. The link portion 1510 and the distal end portion 1520 are connected by a third hinge joint that may be composed of a hinge portion 1521 provided at the rear end of the distal end portion 1520, and a hinge shaft 1512 passing through the front end portion of the link portion 1510 and the hinge portion 1521.

Each grip portion 1200 includes a support portion 1220 and a rotation portion 1230 rotatably coupled to the support portion 1220. The support portion 1220 is configured to cover a portion of the side surface of the torso portion of the model toy (see FIG. 19) in the second state of the transformable body 1102. The support portion 1220 constitutes a main body of each grip portion. One of the pair of rotation axes R1 (i.e., the first rotation axis RL1 or the second rotation axis RR1) is disposed in the support portion 1220. The rotation portion 1230 is configured to partially cover the hind leg extension portion (see FIG. 19) of the model toy in the second state of the transformable body 1102. In the first state of the transformable body 1102, the rotation portion 1230 can be positioned to a coupling position where the rotation portion 1230 is substantially parallel to the ground and is coupled to the accessory body 1702. In the second state of the transformable body 1102, the rotation portion 1230 can be positioned to an upright position where the rotation portion is substantially perpendicular to the ground.

Figure 27:
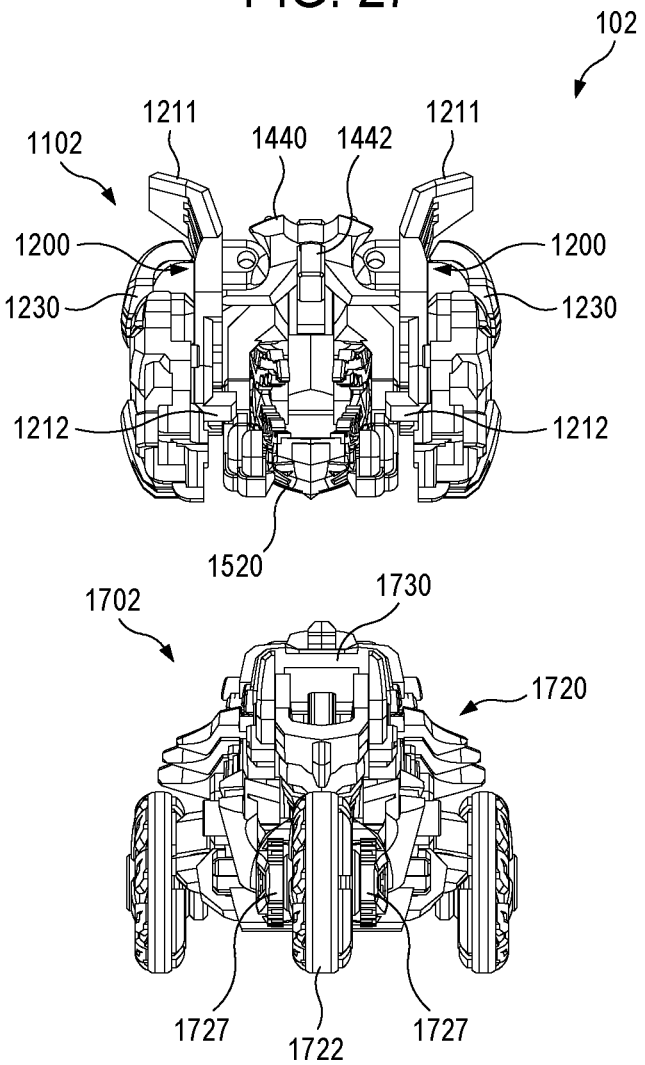
FIG. 27 is a rear view of the transformable toy shown in FIG. 21.
Figure 28:
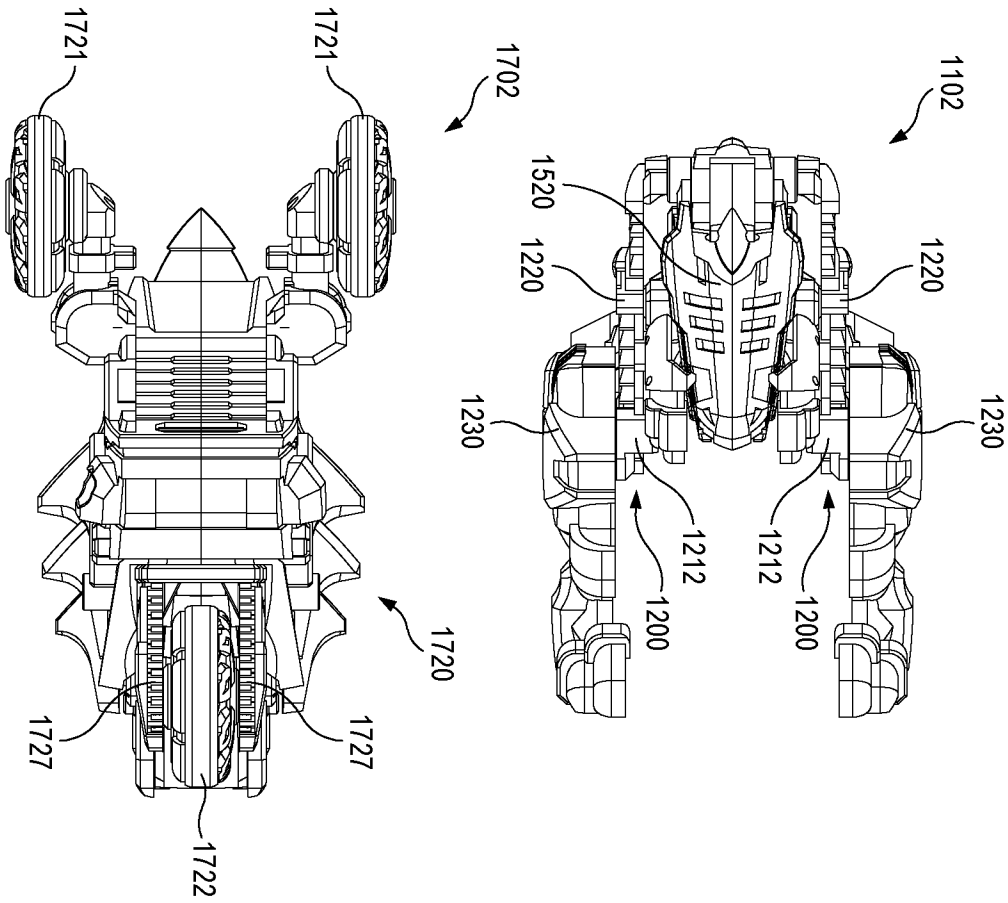
FIG. 28 is a bottom view of the transformable toy shown in FIG. 21.

The rotation portion 1230 is coupled to the support portion 1220 so as to be rotatable about a sixth rotation axis R6 (see FIG. 27). A distal end portion of the rotation portion 1230 is formed to correspond to a shape of a foot of the hind leg extension portion of the model toy. A fitting protrusion 1232 protruding inward is formed at the distal end portion of the rotation portion 1230. The fitting protrusion 1232 is fitted to a portion of the accessory body 1702 at the coupling position of the rotation portion 1230. The support portion 1220 and the rotation portion 1230 are connected by a fifth hinge joint. The fifth hinge joint may be composed of a hinge portion 1221 protruding downward and laterally from the rear end of the support portion 1220, and a hinge shaft 1222 coupled to the hinge portion 1221 through the rotation portion 1230 in the vicinity of the base end of the rotation portion 1230. A stopper portion 1224 protrudes in the vicinity of the hinge portion 1221, and an arc-shaped groove 1233 into which the stopper portion 1224 is inserted is formed in the rotation portion 1230. The stopper portion 1224 makes contact with one end of the groove 1233, whereby the rotation portion 1230 can be restricted to the upright position perpendicular to the ground.

The accessory body 1702 removably coupled to the transformable body 1102 includes an accessory transformable body 1720 and an accessory covering portion 1730. The accessory transformable body 1720 is removably coupled to a first position of the transformable body 1102 in the first state of the transformable body 1102 and is configured to be transformable independently of the transformable body 1102. The accessory covering portion 1730 is removably coupled to the accessory transformable body 1720. In the second state of the transformable body 1102, the accessory covering portion 1730 is releasably coupled to a portion of the model toy, specifically the tail extension portion of the model toy (see FIG. 19) so as to partially cover the tail extension portion.

The accessory transformable body 1720 may have a form corresponding to a shape that can be recognized by the user as a vehicle, for example, a shape that can be recognized as a motorbike. That is, the accessory transformable body 1720 has a pair of front wheels 1721 and one rear wheel 1722. Since the transformable body 1102 is coupled to the accessory transformable body 1720 in the first state, the coupled transformable body 1102 and accessory transformable body 1720 have the form corresponding to a shape of a motorbike in the first state of the transformable body 1102. The rotation portions 1230 are rotated to the coupling position in the first state of the transformable body 1102 such that the front wheels 1721 and the rear wheel 1722 can be placed on the ground in the first state of the transformable body 1102. In the first state of the transformable body 1102, the rotation portions 1230 are maintained in the state parallel to the ground. Therefore, the front wheels 1721 and the rear wheel 1722 can be placed on the ground.

The accessory transformable body 1720 has a fitting hole 1723 in each side surface thereof, and the engaging portion 1212 of each of the pair of grip portions 1200 is releasably fitted to the fitting hole 1723. Therefore, the accessory transformable body 1720 is configured to be engaged with the pair of grip portions 1200 that are moved toward each other in the first state of the transformable body 1102. That is, the pair of grip portions 1200 moved toward each other is configured to grip the accessory transformable body 1720 in the first state of the transformable body 1102. Further, the accessory transformable body 1720 has a fitting hole 1724 in each side surface thereof, and the fitting protrusion 1232 of the rotation portion 1230 of the transformable body 1102 is fitted to the fitting hole 1724 in the first state of the transformable body 1102.

The accessory transformable body 1720 has, at its upper side, a recess portion 1725 configured to be recognized by the user as a driver's seat. Further, the accessory transformable body 1720 has a pair of front arms 1726 at its front end portion, and a pair of rear arms 1727 at its lower end portion. The pair of front arms 1726 is rotatably coupled to the front end portion of the accessory transformable body 1720 in a ball-socket coupling manner. Therefore, the pair of front arms 1726 are rotatable with respect to the accessory transformable body 1720 so as to be moved away from or moved toward each other, and are rotatable with respect to the accessory transformable body 1720 about an axis of each front arm. A fitting protrusion 1728 is formed in each front arm 1726. In the first state of the transformable body 1102, the fitting protrusion 1728 is fitted into the fitting hole 1516 of the link portion 1510.

The front wheel 1721 of the accessory transformable body 1720 is rotatably coupled to a distal end of each front arm 1726, and the rear wheel 1722 of the accessory transformable body 1720 is rotatably coupled to the distal end of each rear arm 1727. The rear arms 1727 are connected to each other, and are rotatable with respect to the accessory transformable body 1720 in the state of holding the rear wheel 1722 therebetween. As shown in FIG. 20, when the accessory transformable body 1720 is transformed such that the front wheels 1721 and the rear wheel 1722 are rotated in parallel with the ground, the accessory transformable body 1720 can give the user fun that the accessory transformable body 1720 can be transformed into a flight-capable transport machine. A fitting hole 1729 is formed in the vicinity of the front end of the accessory transformable body 1720, and the fitting protrusion 1442 of the frame portion 1400 is fitted into the fitting hole 1729. Thus, when the accessory transformable body 1720 is coupled to the transformable body 1102 in the first state of the transformable body, the frame portion 1400 of the transformable body can be fixed to the accessory transformable body 1720.

The accessory covering portion 1730 may be removably fitted to an upper rear portion of the accessory transformable body 1720. The accessory covering portion 1730 has a fitting protrusion 1731 at its front end. By fitting the fitting protrusion 1731 into the fitting hole 241 (see FIG. 19) of the tail extension portion of the model toy, the accessory covering portion 1730 can be coupled to the tail extension portion so as to cover the tail extension portion. The accessory covering portion 1730 may be composed of two members connected by a hinge joint. The two members may be fitted to the upper rear end of the accessory transformable body 1720 in the state where the two members are folded to each other.

Examples where the transformable toy according to this embodiment is transformed and examples where the transformable toy and the model toy are coupled to each other are described with reference to FIGS. 21 and 29 to 33.

As shown in FIG. 21, in the first state of the transformable body 1102, the accessory body 1702 is separated from the transformable body 1102. For example, as the pair of grip portions 1200 release the accessory body 1702 by the manipulation of the manipulation portions 1211, the accessory body 1702 can be separated from the transformable body 1102. The accessory transformable body 1720 of the accessory body 1702 is separated from the transformable body 1102, and the accessory covering portion 1730 is separated from the accessory transformable body 1720. The accessory covering portion 1730 separated from the accessory transformable body 1720 is kept in waiting for coupling to the tail extension portion of the model toy. Further, the accessory transformable body 1720 separated from the transformable body 1102 can be transformed into the form that can be recognized as a flight-capable transport machine as shown in FIG. 20.

Figure 29:
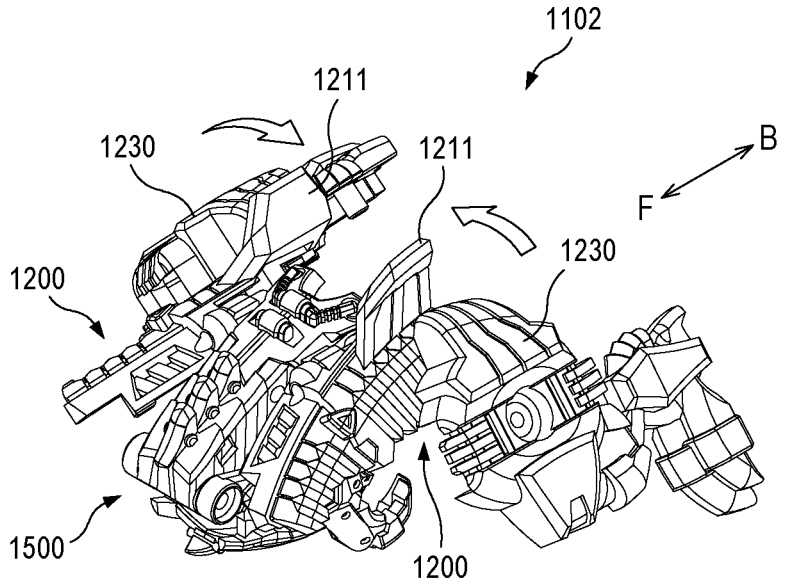
FIG. 29 is a perspective view showing a first example where the transformable body of the transformable toy according to the second embodiment is transformed.

Next, referring to FIG. 29, when an external force is applied to the manipulation portions 1211 in the direction of moving the manipulation portions 1211 toward each other in the transformable body 1102 from which the accessory body is separated (i.e., when the user performs the motion of pinching the manipulation portions 1211), the pair of grip portions 1200 are rotated to the insertion position in opposite directions and are moved away from each other.

Figure 30:
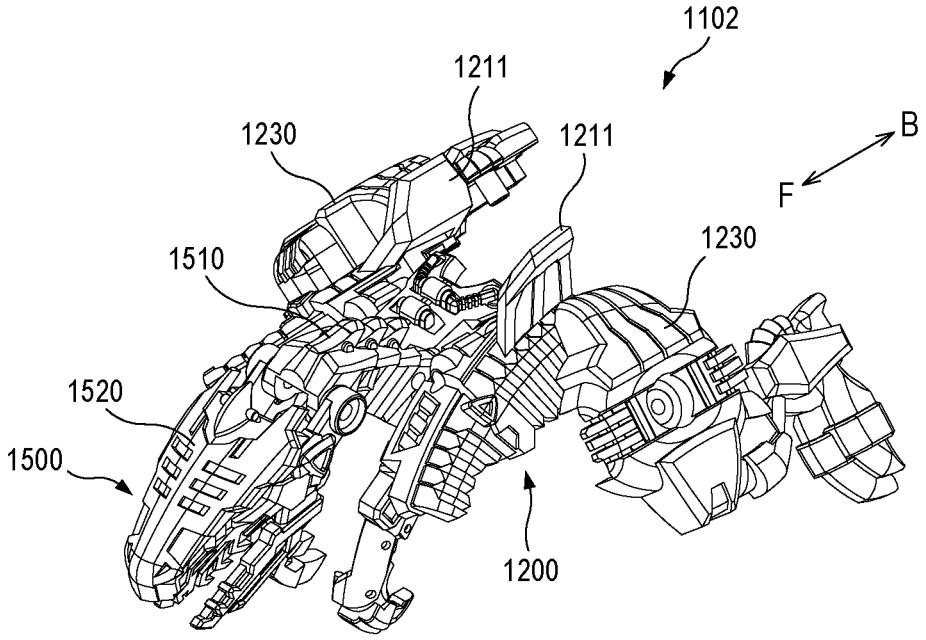
FIG. 30 is a perspective view showing a second example where the transformable body of the transformable toy according to the second embodiment is transformed.
Figure 31:
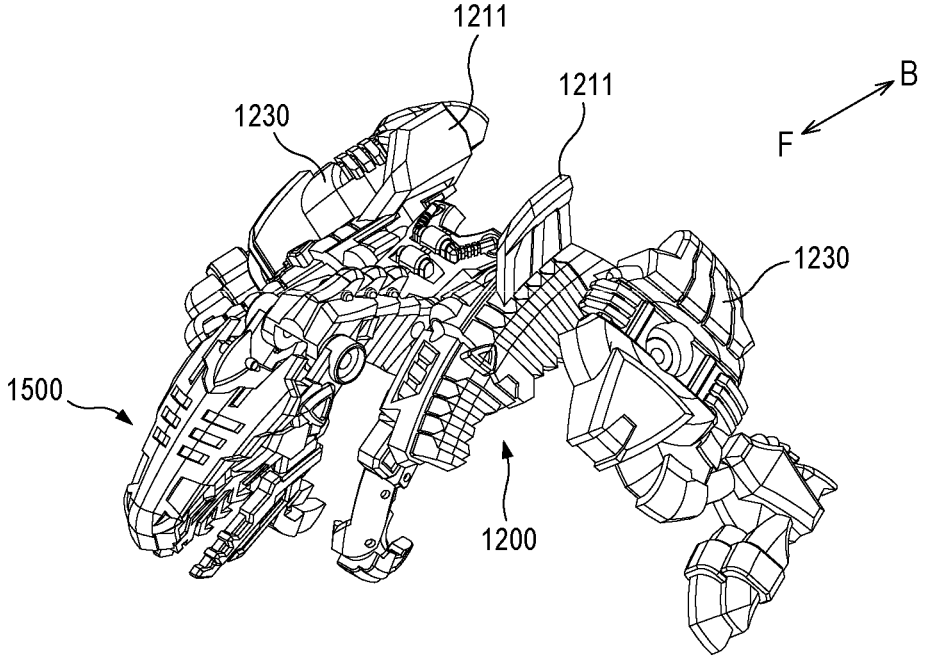
FIG. 31 is a perspective view showing a third example where the transformable body of the transformable toy according to the second embodiment is transformed.

Next, referring to FIG. 30, the distal end portion 1520 is rotated frontward, and the link portion 1510 is rotated upward. Thus, the first covering portion 1500 is rotated to the second state of the transformable body 1102. Next, referring to FIG. 31, the rotation portion 1230 of each grip portion is rotated to the upright position, i.e., to the second state of the transformable body.

Figure 32:
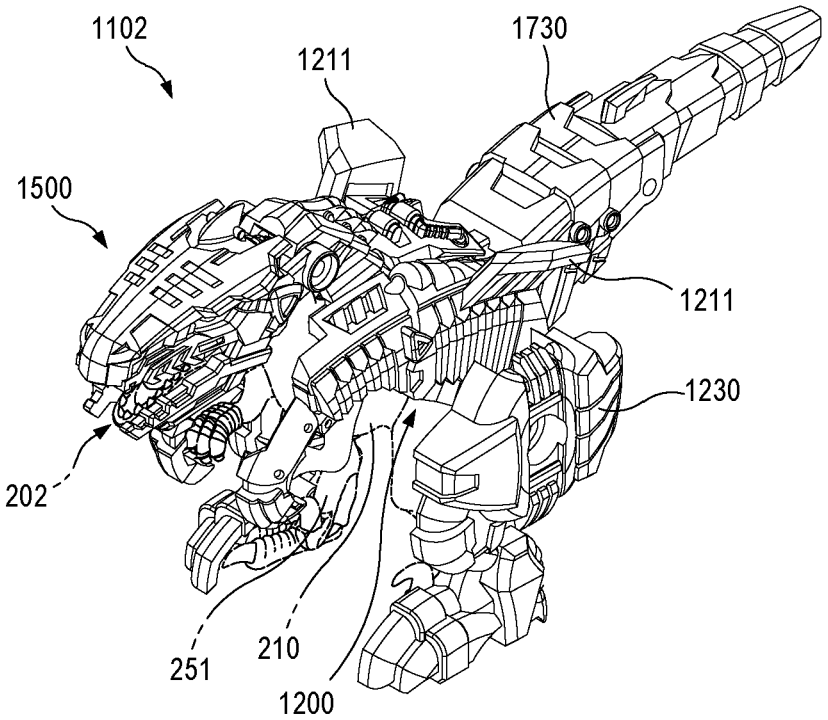
FIG. 32 is a perspective view showing a combination formed by coupling the transformable body and the accessory body of the transformable toy according to the second embodiment to a model toy.
Figure 33:
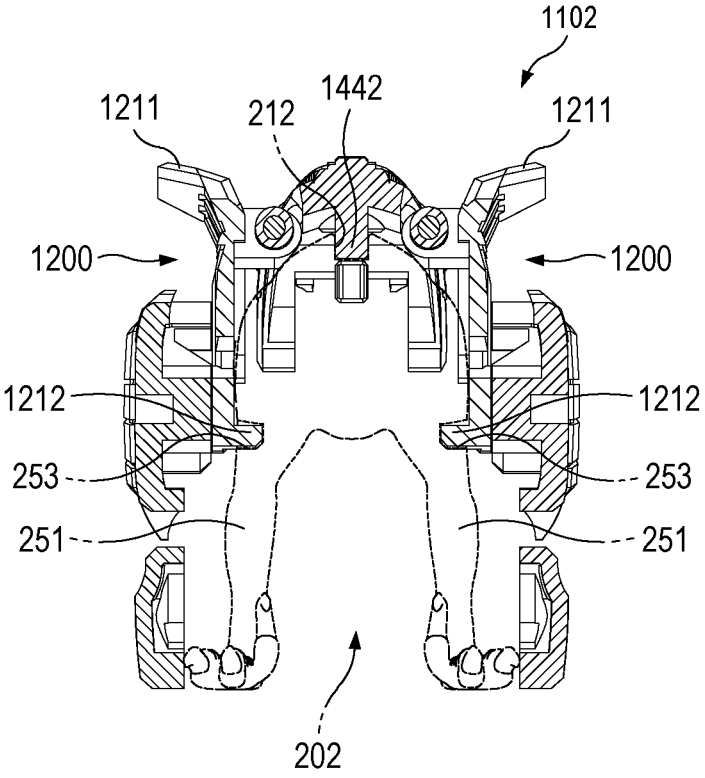
FIG. 33 is a cross-sectional view of the combination of the transformable toy and the model toy shown in FIG. 32.

Next, referring to FIGS. 32 and 33, in the state where the first covering portion 1500 and the rotation portions 1230 are unfolded, the user inserts the torso portion and the hind leg extension portions of the model toy 202 between the pair of grip portions 1200 moved to the insertion position (i.e., between the engaging portions moved away from each other). As the user releases the manipulation portions 1211, the pair of engaging portions are rotated to the grip position by the biasing force of the torsion springs so as to be moved toward each other. Therefore, the transformable body 1102 can be temporarily fixed to the model toy 202. When the engaging portions 1212 of the grip portions 1200 are engaged with the counter engaging portions 253, mounting of the transformable body 1102 on the model toy 202 can be completed, and the transformable body 1102 comes into the second state where the transformable body 1102 covers the model toy 202 and is releasably coupled to the model toy 202. In the state where the grip portions 1200 grip the hind leg extension portions, the first covering portion 1500 covers the head extension portion of the model toy, and the rotation portions 1230 cover the hind leg extension portions of the model toy. In the state where the transformable body 1102 is mounted on the model toy 202, the accessory covering portion 1730 is unfolded from the folded state, and is coupled to the tail extension portion of the model toy 202 so as to cover the tail extension portion.

The procedures in which the transformable body 1102 is transformed from the second state to the first state may be reversed from the above-described procedures. If the transformable body 1102 is transformed from the second state to the first state and the transformable body 1102 in the first state and the accessory body 1702 are coupled to each other, the transformable toy 102 including the transformable body 1102 takes the form of a motorbike shown in FIG. 19.

As shown in FIGS. 20 and 32, in the second state where the transformable body 1102 covers the model toy 202, the user can recognize, from the combination of the model toy 202 and the transformable body 1102, that the model toy 202 is wearing a protector (an armor and helmet) by the grip portions 1200, the rotation portions 1230 of the grip portions 1200, and the first covering portion 1500. Further, the user can have fun that the accessory transformable body 1720 becomes a separate transformable body independent from the transformable body 1102 and the accessory transformable body 1720 can be transformed into a flight-capable transport machine.

Figure 34:
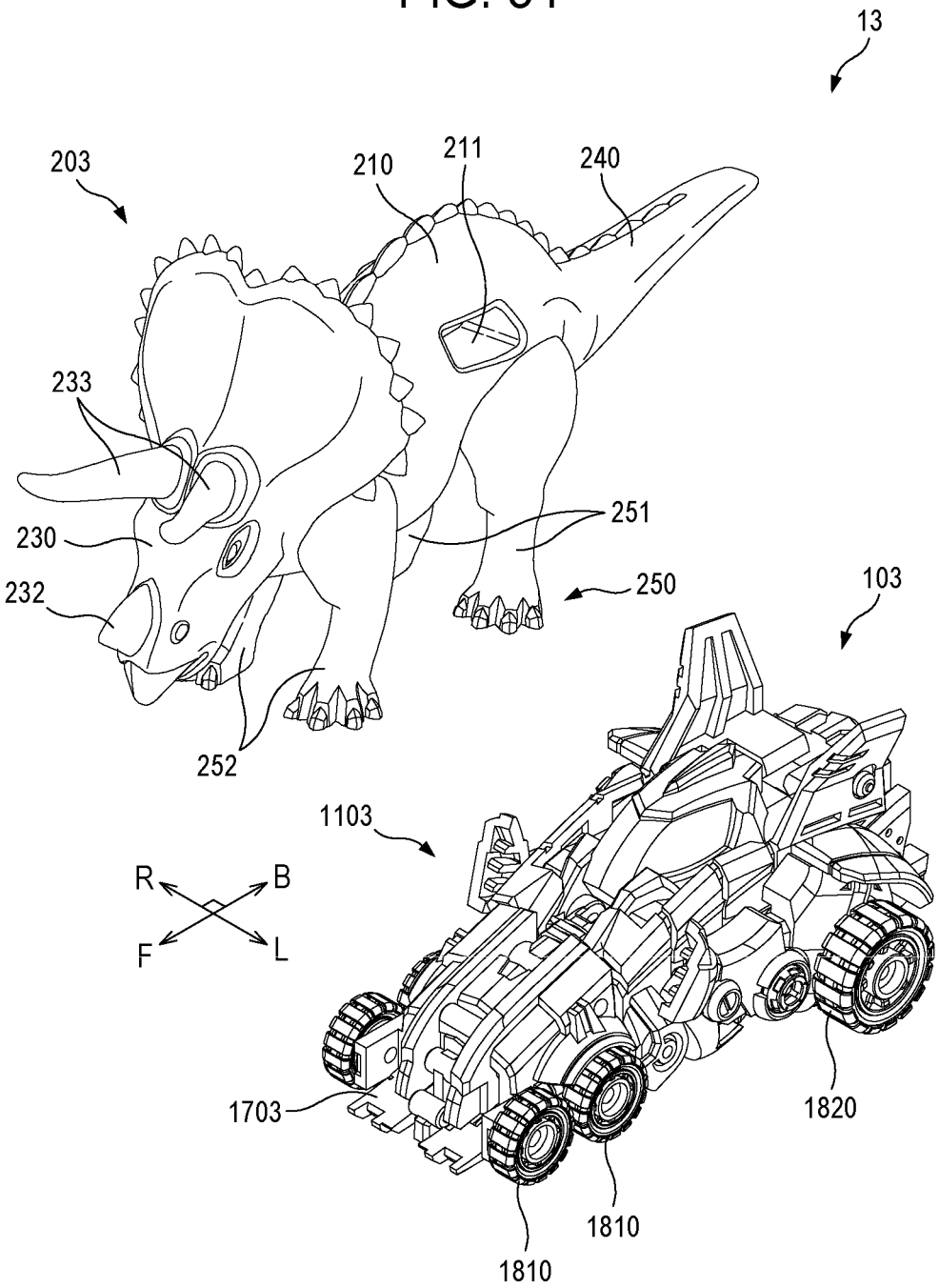
FIG. 34 is a perspective view showing a toy set according to a third embodiment of the present disclosure.
Figure 35:
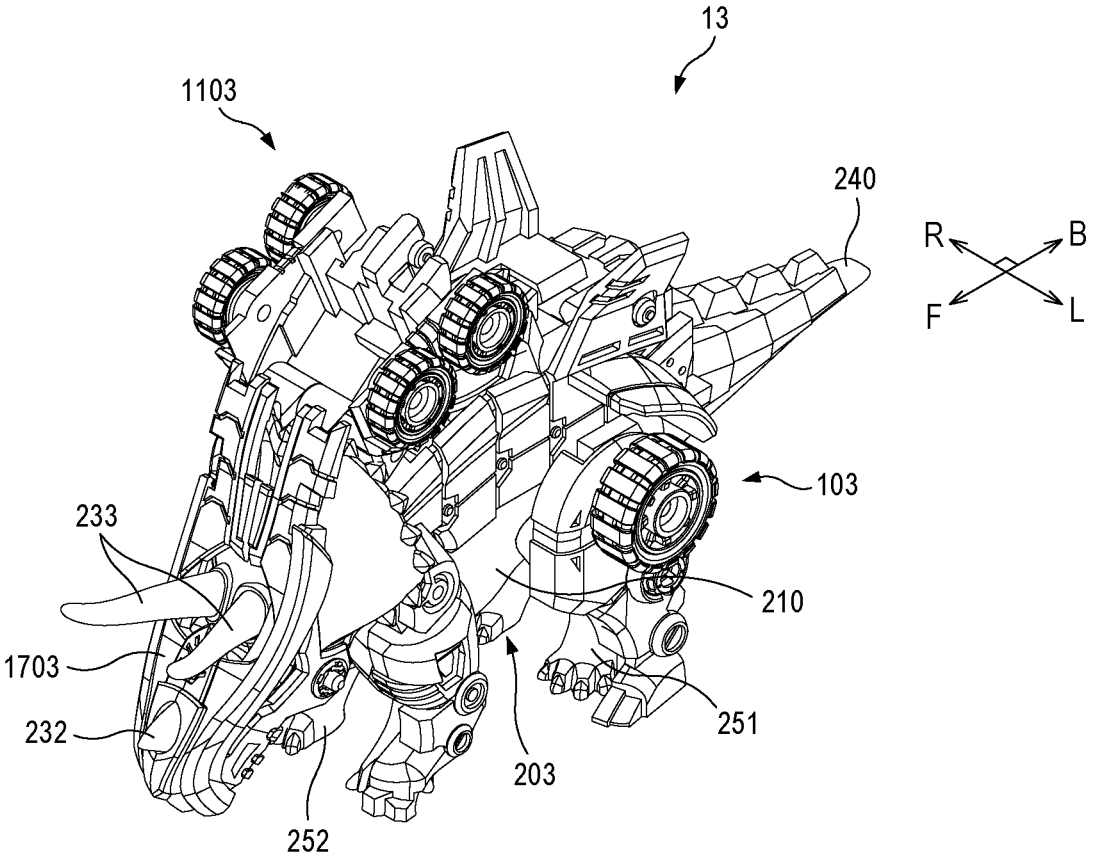
FIG. 35 is a perspective view showing a combination of a model toy and a transformable toy shown in FIG. 34.
Figure 36:
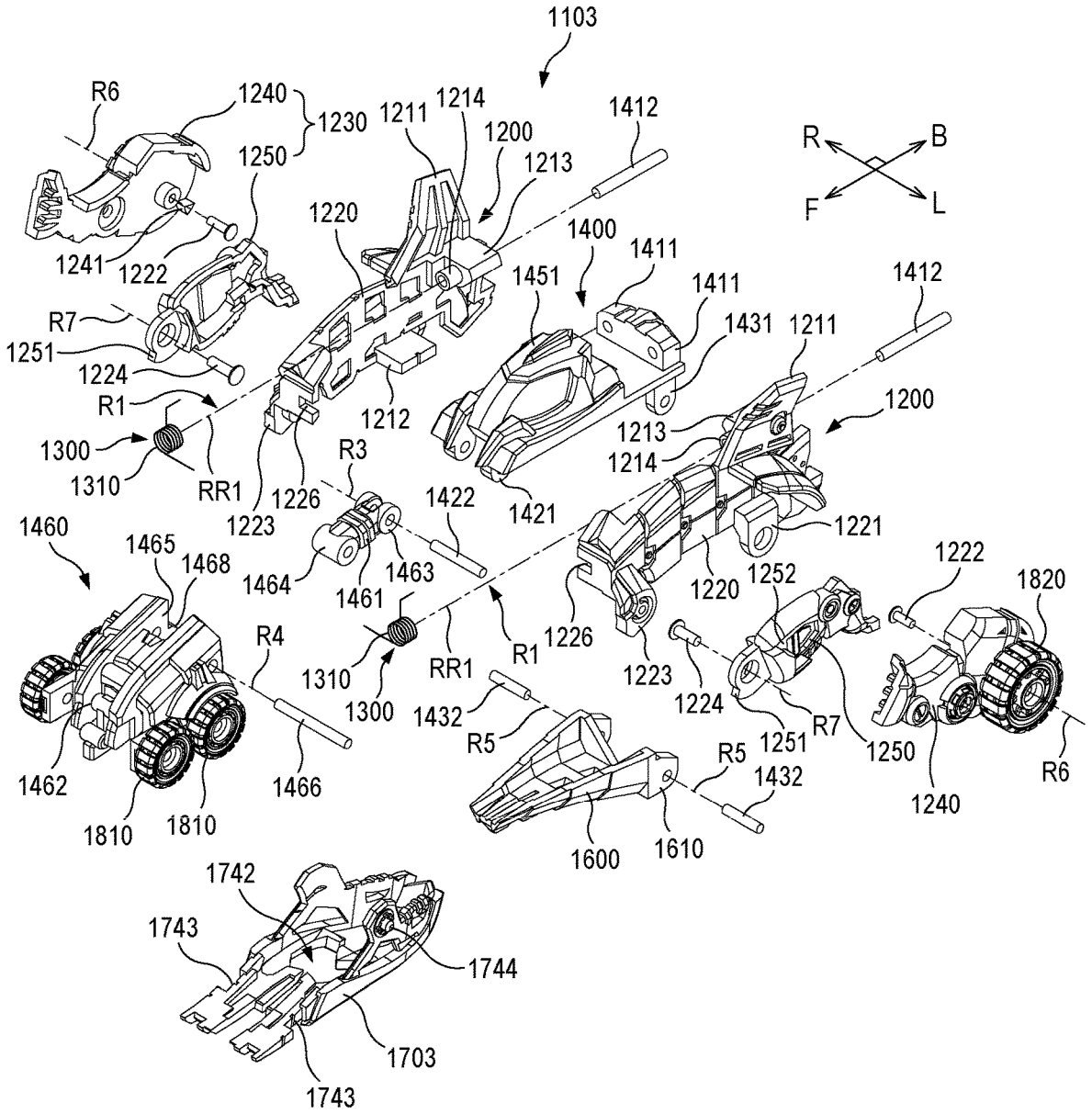
FIG. 36 is an exploded perspective view of the transformable toy according to the third embodiment shown in FIG. 34.
Figure 37:
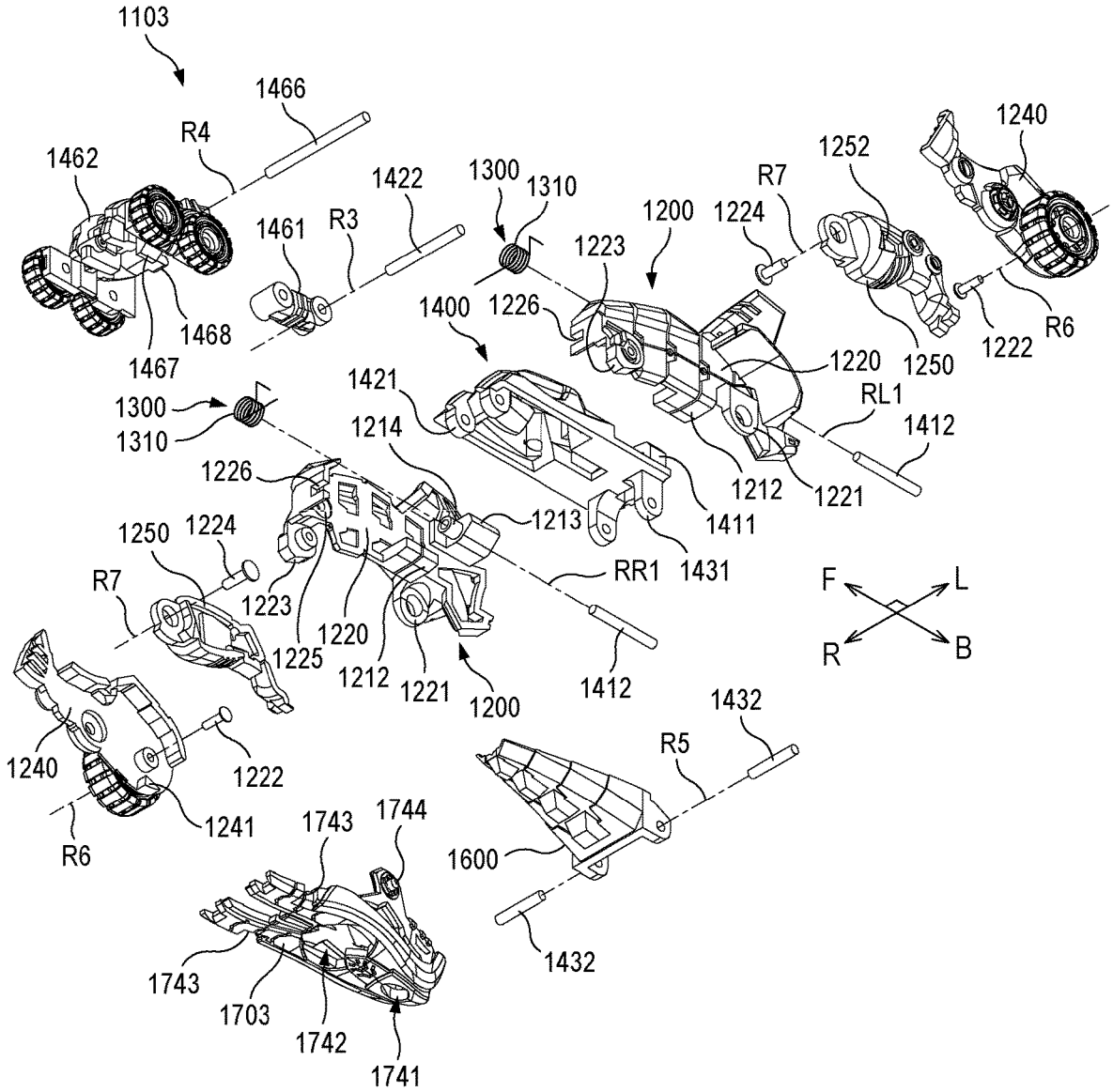
FIG. 37 is another exploded perspective view of the transformable toy according to the third embodiment shown in FIG. 34.

Hereinafter, a transformable toy 103, a model toy 203, and a toy set 13 according to a third embodiment of the present disclosure are described with reference to FIGS. 34 to 49. FIGS. 34 and 35 show a toy set and a transformable toy according to the third embodiment. FIGS. 36 and 37 are exploded perspective views of the transformable toy shown in FIG. 34. FIGS. 38 to 42 are a plan view, a side view, a front view, a rear view, and a bottom view of the transformable toy shown in FIG. 34, respectively. FIGS. 43 to 49 show examples where the transformable toy according to the third embodiment is transformed and examples where the transformable toy is coupled to a model toy.

In the following descriptions related to the third embodiment, components of the third embodiment equivalent or corresponding to those of the foregoing first embodiment are denoted by like reference numerals, and descriptions thereof may be omitted. The components of the third embodiment whose description is omitted can be understood by referring to the description of the first embodiment.

Referring to FIG. 34, the toy set 13 according to the third embodiment includes the transformable toy 103 and the model toy 203. The model toy 203 has an appearance corresponding to a shape of a land animal, for example, an appearance corresponding to a shape of a dinosaur which may be called a triceratops.

A leg extension portion 250 of the model toy 203 may have hind leg extension portions 251 and front leg extension portions 252 which extend from a torso portion 210 so as to reach the ground. The hind leg extension portions 251 may have a shape of hind legs of a triceratops, and the front leg extension portions 252 may have a shape of front legs of a triceratops. The model toy 203 may have a first protrusion 232 and a pair of second protrusions 233 which protrude from a head extension portion 230. The first protrusion 232 is provided in the vicinity of a front end of the head extension portion 230, and the second protrusions 233 are provided at an upper portion of the head extension portion 230. The first protrusion 232 may have a shape of a horn formed near the nose of a triceratops, and the second protrusions 233 may have a shape of horns formed at an upper side of the head of a triceratops. Counter engaging portions 211 are formed at the left and right sides of the torso portion 210 as a fitting groove. The counter engaging portions 211 function for releasably coupling the model toy 203 and the transformable toy 103.

The transformable toy 103 shown in FIG. 34 is independent from the model toy 203. The transformable toy 103 is transformable so as to cover the model toy 203, and is releasably coupled to the model toy 203 in its transformed state. The transformable toy 103 includes a transformable body 1103 configured to be transformed and to be releasably coupled to the model toy 203, and an accessory body 1703 removably coupled to the transformable body 1103 and configured to partially cover the model toy 203.

Referring to FIG. 35, the transformable body 1103 and the accessory body 1703 of the transformable toy 103 are coupled to the model toy 203, thereby making a combination of the transformable toy and the model toy. Therefore, the transformable body 1103 is configured to be transformed into a first state where the transformable body 1103 is independent from the model toy 203 (the state of the transformable body shown in FIG. 34) and a second state where the transformable body 1103 at least partially covers the model toy 203 and is releasably coupled to the model toy 203 (the state of the transformable body shown in FIG. 35). In this embodiment, as shown in FIG. 34, the transformable body 1103 has a form corresponding to a shape of a vehicle in the first state.

Referring to FIGS. 36 and 37, the transformable body 1103 includes a pair of grip portions 1200 configured to releasably grip the model toy. The pair of grip portions 1200 can releasably grip the torso portion of the model toy. The pair of grip portions 1200 are configured to be rotatable in opposite directions about a pair of rotation axes R1 (specifically, a first rotation axis RL1 and a second rotation axis RR1) (see FIG. 38). Since the pair of grip portions 1200 grip the torso portion of the model toy in the second state of the transformable body 1103, the transformable body 1103 can be coupled to the model toy while the pair of grip portions 1200 cover the torso portion of the model toy. The pair of grip portions 1200 may be configured to be rotated in opposite directions about one rotation axis in the transformable body 1103. The pair of grip portions 1200 can be rotated into an insertion position where the pair of grip portions 1200 are moved away from each other to allow a portion of the torso portion of the model toy to be inserted between the pair of grip portions 1200 and a grip position where the pair of grip portions 1200 are moved toward each other to releasably grip the torso portion of the model toy. The pair of grip portions 1200 may be configured to partially cover each side surface of the torso portion of the model toy (see FIG. 34) by being rotated about the first rotation axis RL1 and the second rotation axis RR1 in the second state of the transformable body 1103.

The pair of grip portions 1200 of the transformable body 1103 are biased toward each other, i.e., toward the grip position by at least one spring 1300. The pair of grip portions 1200 are biased to be moved toward each other by the spring 1300. The spring 1300 may be coupled to the pair of grip portions 1200 in the transformable body 1103. Alternatively, the transformable body 1103 may include a pair of springs disposed in the pair of rotation axes R1, respectively, and configured to bias one of the pair of grip portions 1200 toward the other of the pair of grip portions. The spring 1300 of this embodiment includes a pair of torsion springs 1310.

The pair of grip portions 1200 are biased so as to be moved toward each other by the biasing force of the torsion springs 1310. Therefore, the transformable body 1103 can be stably coupled to the model toy in the state where the grip portions 1200 biased toward each other are coupled to the torso portion of the model toy. Further, the transformable body 1103 can be stably maintained in the first state by the biasing force of the torsion springs 1310.

The transformable body 1103 includes a pair of manipulation portions 1211 that can be manipulated to rotate the pair of grip portions 1200. The pair of manipulation portions 1211 may be configured to be moved toward each other when the pair of grip portions 1200 are rotated to be moved away from each other. When the transformable body 1103 has the springs, the manipulation portions 1211 may be manipulated to rotate the grip portions 1200 against the biasing force of the springs 1300. The pair of grip portions 1200 can be rotated about the rotation axes R1 in the direction of the force applied to the manipulation portions 1211. The pair of manipulation portions 1211 are formed as a protrusion protruding from a base end of each grip portion 1200 and having a shape of a wing. The manipulation portions 1211 extend from the base ends of the grip portions 1200 in an oblique direction between the lateral side and the upper side. In the state where the pair of grip portions 1200 are moved away from each other by the pair of manipulation portions 1211, the torso portion of the model toy can be inserted between the pair of grip portions 1200. Thereafter, as the manipulation portions 1211 are released, the pair of grip portions 1200 are moved toward each other by the biasing force of the torsion springs 1310 and can grip the torso portion 210.

The pair of grip portions 1200 and the model toy may be releasably coupled to each other by engaging portions that are complementarily engaged with each other. Each of the pair of grip portions 1200 includes an engaging portion 1212 configured to be engaged with the model toy. The model toy includes, at its torso portion, counter engaging portions 211 (see FIG. 34) configured to be complementarily coupled to the engaging portions 1212. Each of the engaging portions 1212 of the pair of grip portions 1200 is formed to protrude toward the other of the pair of grip portions 1200 in the state where the pair of grip portions 1200 are moved toward each other. The engaging portions 1212 of the grip portions are formed as a male engaging portion that protrudes from the distal end of the grip portion 1200 and has a shape of a protrusion or a pin. The counter engaging portions 211 of the model toy are formed in the left and right sides of the torso portion, respectively, as a female engaging portion that releasably fits with the engaging portion 1212 and has a shape of a groove or hole. In the second state of the transformable body 1103, the engaging portions 1212 are fitted into the counter engaging portions 211, thereby coupling the transformable body 1103 transformed into the second state to the model toy.

The transformable body 1103 includes a frame portion 1400 capable of functioning as a base portion of the transformable body 1103, and at least one covering portion configured to partially cover the model toy in the second state of the transformable body 1103.

The frame portion 1400 is configured to partially cover a back portion of the torso portion of the model toy (see FIG. 34) in the second state of the transformable body 1103. The pair of grip portions 1200 are rotatably coupled to the frame portion 1400. The pair of rotation axes R1, which are the rotation centers of the pair of grip portions 1200, include a first rotation axis RL1 and a second rotation axis RR1 spaced apart from each other and passing through the frame portion 1400 or the pair of grip portions 1200 in the front direction F and the rear direction B. Therefore, the pair of grip portions 1200 includes a first grip portion coupled to the left side of the frame portion 1400 so as to be rotatable about the first rotation axis RL1, and a second grip portion coupled to the right side of the frame portion 1400 so as to be rotatable about the second rotation axis RR1. The frame portion 1400 has a protrusion 1451 protruding upward in the vicinity of its front end. The protrusion 1451 may have a shape that can be recognized as a canopy covering a cockpit.

The pair of grip portions 1200 releasably couple the transformable body 1103 transformed into the second state to the model toy 203, and the at least one covering portion covers a portion of the model toy 203. Accordingly, the user can have fun that the model toy is wearing a protector (an armor) by the covering portion covering the model toy.

In the transformable body 1103, the frame portion 1400 and each grip portion 1200 are connected by a first hinge joint. The transformable body 1103 is provided with a pair of first hinge joints through which the first rotation axis RL1 and the second rotation axis RR1 pass respectively. The first hinge joint may be composed of a hinge portion 1411 provided in each lateral side of the frame portion 1400, a counter hinge portion 1213 provided in a base end side of each grip portion 1200, and a hinge shaft 1412 passing through the hinge portion 1411 and the counter hinge portion 1213.

The torsion spring 1310 is disposed at the hinge joint connecting the frame portion 1400 and each grip portion 1200 such that the hinge shaft 1412 passes through the inside of the torsion spring 1310. The torsion spring 1310 fits with a sleeve portion 1214 provided in the counter hinge portion 1213. One end of the torsion spring 1310 is engaged on the surface of the frame portion 1400, and the other end of the torsion spring 1310 is engaged on the counter hinge portion 1213 of each grip portion. The inner surface of each grip portion 1200 biased by the torsion spring 1310 makes contact with each side surface of the frame portion 1400, whereby the inward rotation of each grip portion can be restricted.

The at least one covering portion of the transformable body 1103 may be configured to partially cover the model toy in the state of being fixed to a specific position in the second state of the transformable body 1103. The transformable body 1103 includes, as a rotating covering portion of the at least one covering portion, a second covering portion 1600 coupled to the rear end of the frame portion 1400 so as to be rotatable about a fifth rotation axis R5 (see FIG. 38). The second covering portion 1600 is configured to partially cover the tail extension portion of the model toy (see FIG. 34). The fifth rotation axis R5 may be orthogonal to the first and second rotation axes RL1 and RR1.

The frame portion 1400 and the second covering portion 1600 are connected by a fourth hinge joint that may be composed of a hinge portion 1431 provided in the rear end of the frame portion 1400, a counter hinge portion 1610 provided in a base end of the second covering portion 1600, and a hinge shaft 1432 passing through the hinge portion 1431 and the counter hinge portion 1610. The second covering portion 1600 can be rotated frontward and rearward with respect to the frame portion 1400. The base end of the second covering portion 1600 adjacent to the counter hinge portion 1610 makes contact with the hinge portion 1431, whereby the rearward and upward rotation of the second covering portion 1600 can be restricted. The second covering portion 1600 can be folded into the frame portion 1400 so as to make contact with the lower surface of the frame portion 1400 in the first state of the transformable body 1103.

Each grip portion 1200 includes a support portion 1220 and a rotation portion 1230 rotatably coupled to the support portion 1220. The support portion 1220 is configured to cover a portion of the side surface of the torso portion of the model toy (see FIG. 34) in the second state of the transformable body 1103. The support portion 1220 constitutes a main body of each grip portion. One of the pair of rotation axes R1 (i.e., the first rotation axis RL1 or the second rotation axis RR1) is disposed in the support portion 1220. The rotation portion 1230 is configured to partially cover the leg extension portion of the model toy in the second state of the transformable body 1103. The rotation portion 1230 can be positioned to a traveling position (see FIG. 39) substantially parallel to the ground in the first state of the transformable body 1103, and can be positioned to an upright position (see FIG. 35) substantially perpendicular to the ground in the second state of the transformable body 1103.

The rotation portion 1230 of each grip portion 1200 includes a first rotation portion 1240 and a second rotation portion 1250. The first rotation portion 1240 is disposed in the vicinity of the rear end of each grip portion 1200, and is configured to partially cover the hind leg extension portion of the model toy (see FIG. 34). The second rotation portion 1250 is disposed in the vicinity of the front end of each grip portion 1200, and is configured to partially cover the front leg extension portion of the model toy (see FIG. 34).

Figure 38:
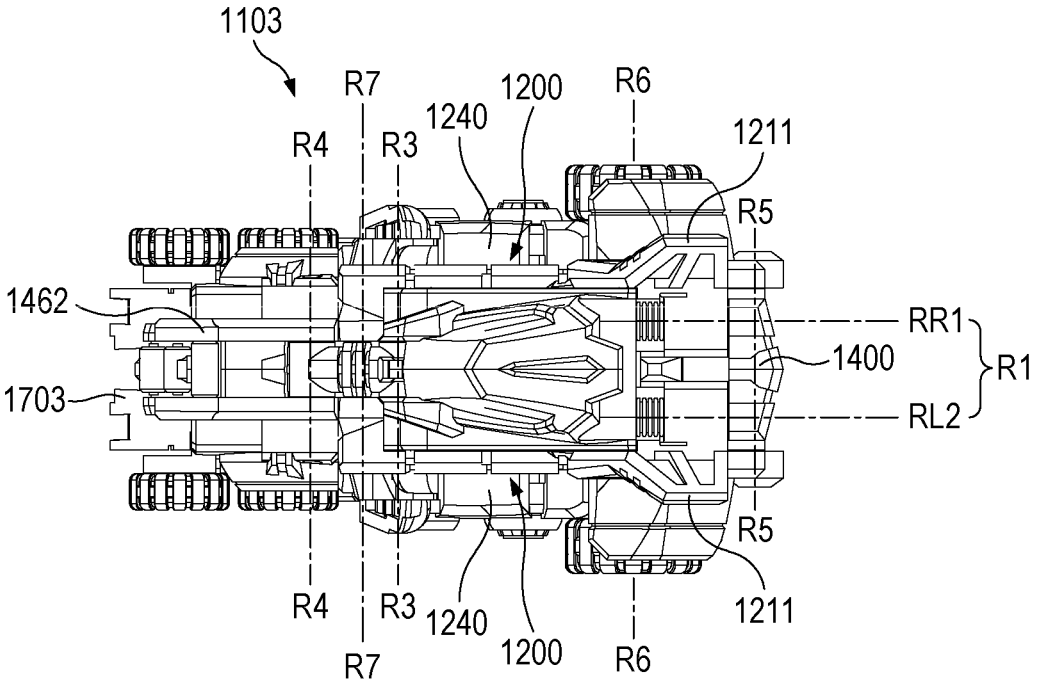
FIG. 38 is a plan view of the transformable toy shown in FIG. 34.

The first rotation portion 1240 is coupled to the support portion 1220 so as to be rotatable about a sixth rotation axis R6 (see FIG. 38). A distal end portion of the first rotation portion 1240 is formed so as to correspond to the shape of a foot of the hind leg extension portion of the model toy. The support portion 1220 and the first rotation portion 1240 are connected by a fifth hinge joint. The fifth hinge joint may be composed of a hinge portion 1221 protruding downward and laterally from the rear end of the support portion 1220, and a hinge shaft 1222 coupled to the hinge portion 1221 through the first rotation portion 1240 in the vicinity of the base end of the first rotation portion 1240. The first rotation portion 1240 has a stopper portion 1241 protruding from the base end thereof. The stopper portion 1241 makes contact with the rear edge of the hinge portion 1221, thereby restricting the first rotation portion 1240 to the upright position.

The second rotation portion 1250 is coupled to the support portion 1220 so as to be rotatable about a seventh rotation axis R7 (see FIG. 38). A distal end portion of the second rotation portion 1250 is formed to correspond to a shape of a foot of the front leg extension portion of the model toy. The support portion 1220 and the second rotation portion 1250 are connected by a sixth hinge joint. The sixth hinge joint may be composed of a hinge portion 1223 protruding downward and laterally from the front end of the support portion 1220, and a hinge shaft 1224 coupled to the hinge portion 1223 through the second rotation portion 1250 in the vicinity of the base end of the second rotation portion 1250. The second rotation portion 1250 is provided with a stopper portion 1251 that makes contact with the front edge of the hinge portion 1223 to restrict the second rotation portion 1250 to the upright position.

Figure 39:
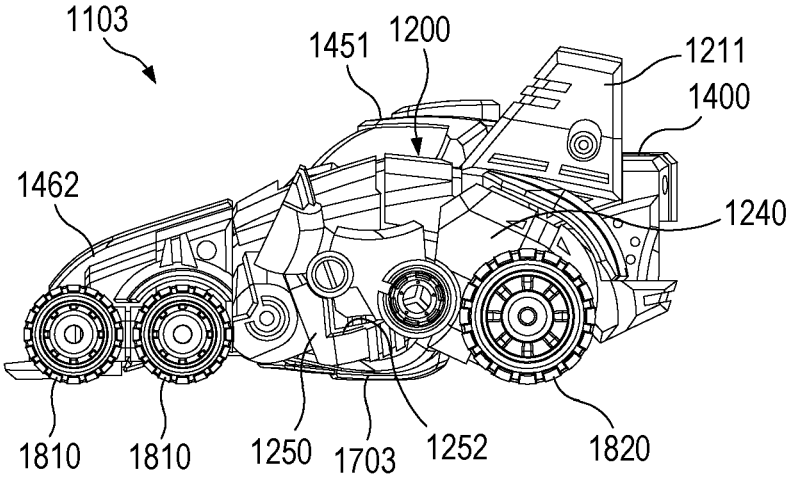
FIG. 39 is a side view of the transformable toy shown in FIG. 34.
Figure 40:
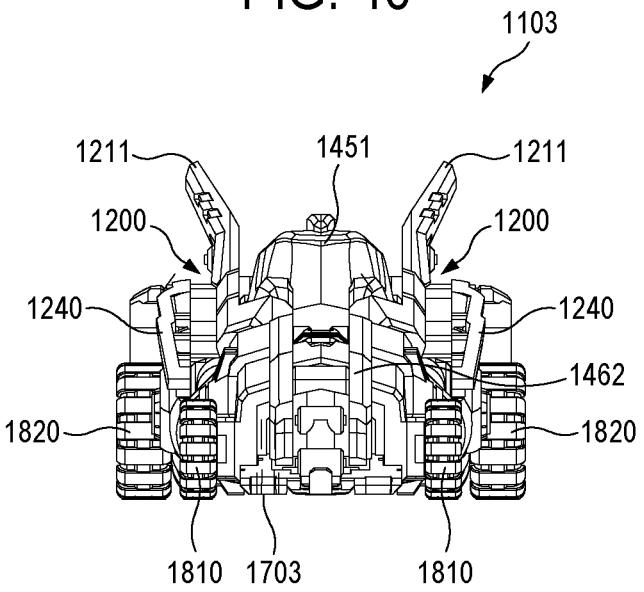
FIG. 40 is a front view of the transformable toy shown in FIG. 34.
Figure 41:
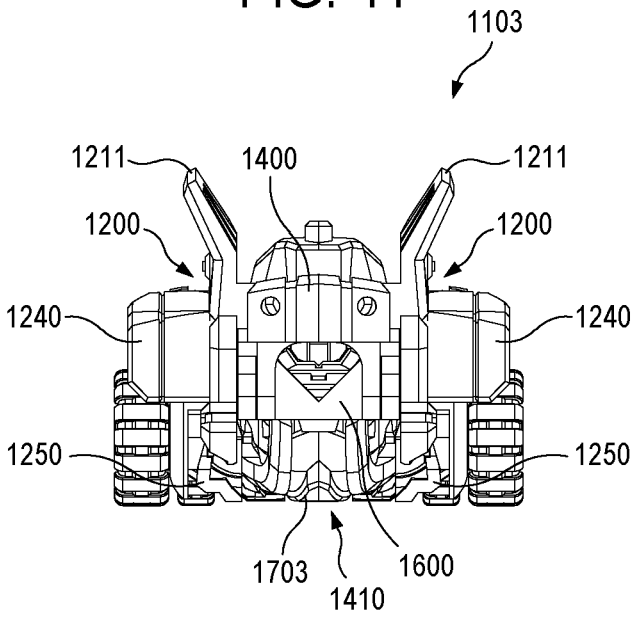
FIG. 41 is a rear view of the transformable toy shown in FIG. 34.
Figure 42:
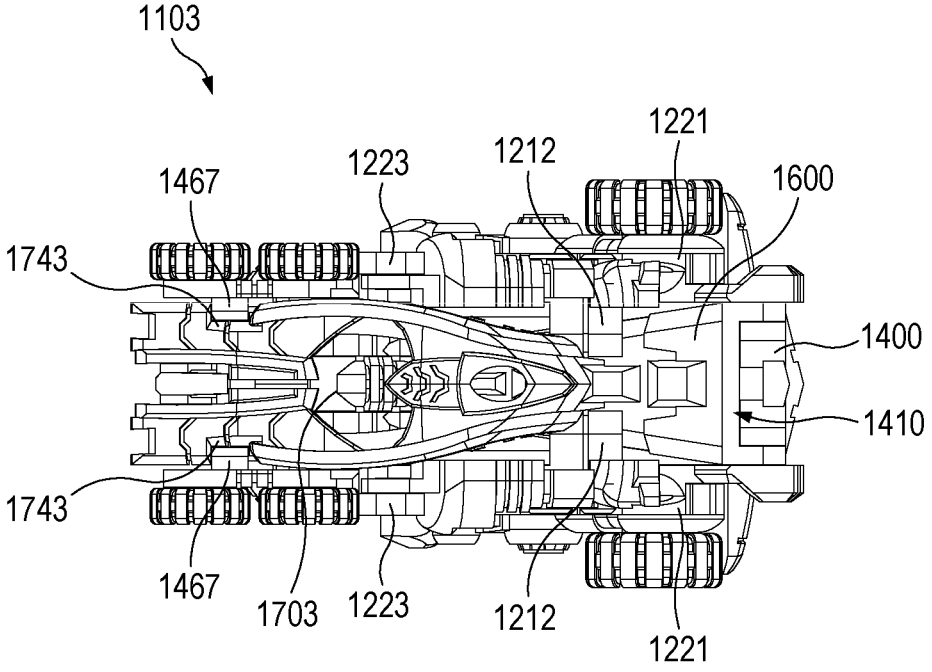
FIG. 42 is a bottom view of the transformable toy shown in FIG. 34.

The first rotation portion 1240 and the second rotation portion 1250 are positioned so as to partially overlap each other in the first state of the transformable body 1103 and at the traveling position. In this regard, the hinge portion 1223 may be positioned further inward than the hinge portion 1221, i.e., closer to the rotation axis R1 than the hinge portion 1221. Further, a recessed portion 1252 is formed on the outer surface of the second rotation portion 1250. The recessed portion 1252 is formed so as to accommodate the distal end portion of the first rotation portion 1240 and a portion adjacent thereto. Thus, as shown in FIGS. 39 and 42, the first rotation portion 1240 and the second rotation portion 1250 may be configured to overlap each other in the lateral direction in the first state of the transformable body. Accordingly, the transformable body 1103 can have a reduced width dimension in the first state.

The pair of grip portions 1200 are configured to grip the second covering portion 1600 in the first state of the transformable body 1103. When the transformable body 1103 is transformed from the second state to the first state, the second covering portion 1600 can be at least partially accommodated within a space defined by the frame portion and the pair of grip portions, and the pair of grip portions can grip the accommodated second covering portion 1600. Accordingly, the transformable body 1103 can be transformed from the second state to the first state with a more compact structure.

In the first state of the transformable body 1103, the transformable body 1103 has a covering accommodation portion 1410 (see FIGS. 41 and 42) defined by the lower surface of the frame portion 1400 and the inner surfaces of the grip portions 1200. When the transformable body is transformed from the second state to the first state, the second covering portion 1600 can be rotated into the covering accommodation portion 1410. In the state where the second covering portion 1600 is accommodated in the covering accommodation portion 1410, the engaging portion 1212 of each grip portion 1200 is located below the second covering portion 1600 and can grip the second covering portion 1600. Since the pair of grip portions 1200 are biased toward the inside of the frame portion 1400 by the biasing force of the torsion springs 1310, the engaging portions 1212 prevent the second covering portion 1600 from rotating from the covering accommodation portion 1410, and the transformable body 1103 can be stably maintained in the first state.

The transformable toy 103 includes an accessory body 1703 that is removably coupled to the transformable body 1103 at a first position in the first state of the transformable body 1103 and is releasably coupled to the model toy at a predetermined position in the second state of the transformable body 1103.

The accessory body 1703 functions as an accessory covering portion of the above-described at least one covering portion. The accessory body 1703 is configured to partially cover the head extension portion of the model toy, and has, for example, a shape that can be recognized as a helmet by the user. A first opening 1741 and a second opening 1742 are formed in the accessory body 1703. In the second state of the transformable body 1103, the first protrusion 232 (see FIG. 35) of the head extension portion of the model toy is inserted into the first opening 1741. In the second state of the transformable body 1103, the second protrusions 233 (see FIG. 35) of the head extension portion of the model toy are inserted into the second opening 1742. That is, as shown in FIG. 35, the accessory body 1703 is releasably coupled to the predetermined position of the model toy, i.e., the head extension portion 230 of the model toy in the state where the first protrusion 232 is inserted into the first opening 1741 and the second protrusions 233 are inserted into the second opening 1742.

The frame portion 1400 includes a coupling portion 1460 for coupling the accessory body 1703 to the transformable body 1103. The coupling portion 1460 is rotatably coupled to the frame portion 1400, and the accessory body 1703 may be removably coupled to the coupling portion 1460. The coupling portion 1460 includes a link portion 1461 coupled to the frame portion 1400 so as to be rotatable upward and downward about a third rotation axis R3 (see FIG. 38), and a distal end portion 1462 coupled to the link portion 1461 so as to be rotatable about a fourth rotation axis R4 (see FIG. 38). The accessory body 1703 can be removably coupled to the distal end portion 1462 in the first state of the transformable body 1103. The link portion 1461 and the distal end portion 1462 do not cover the model toy. In the second state of the transformable body 1103, the link portion 1461 is rotated downward. In the second state of the transformable body 1103, the distal end portion 1462 may be rotated rearward such that the upper surface thereof makes contact with the upper surface of the protrusion 1451.

The link portion 1461 is connected to the frame portion 1400 by a second hinge joint. The second hinge joint may be composed of a hinge portion 1421 provided in the front end of the frame portion 1400, a counter hinge portion 1463 provided in the rear end of the link portion 1461, and a hinge shaft 1422 passing through the hinge portion 1421 and the counter hinge portion 1463. The distal end portion 1462 is connected to the link portion 1461 by a third hinge joint. The third hinge joint may be composed of a hinge portion 1464 provided in the front end of the link portion 1461, a counter hinge portion 1465 provided in the rear end of the distal end portion 1462, and a hinge shaft 1466 passing through the hinge portion 1464 and the counter hinge portion 1465.

A positioning protrusion 1467 protrudes from each lateral end of the distal end portion 1462. A fitting groove 1743 corresponding to the positioning protrusion 1467 is formed in each lateral end of the accessory body 1703. As shown in FIG. 42, in the first state of the transformable body 1103, the accessory body 1703 is removably coupled to the distal end portion 1462 such that the positioning protrusions 1467 can be fitted to the fitting grooves 1743. In the first state of the transformable body 1103, the positioning protrusions 1467 and the fitting grooves 1743 are located such that the accessory body 1703 is not exposed from the lower portion of the transformable body 1103. Further, the accessory body 1703 has a fitting protrusion 1744 in each lateral end, and the support portion 1220 of each grip portion 1200 has, in the inner surface in the vicinity of its front end, a fitting hole 1225 to which the fitting protrusion 1744 is fitted. In the first state of the transformable body 1103, a portion of the accessory body 1703 is positioned within the distal end portion 1462, and the remaining portion of the accessory body 1703 is positioned between the pair of grip portions 1200 moved toward each other. Further, since the fitting protrusion 1744 of the accessory body is fitted to the fitting hole 1225 of each grip portion 1200 in the first state of the transformable body 1103, the accessory body 1703 can be gripped by the pair of grip portions 1200 moved toward each other.

Further, a pair of fitting protrusions 1468 are formed in the counter hinge portion 1465 of the distal end portion 1462, and fitting grooves 1226 fitting with the fitting protrusions 1468 are formed in the respective front ends of the support portions 1220 of the grip portions 1200. If the grip portions 1200 are moved toward each other in the first state of the transformable body 1103, the fitting protrusions 1468 are fitted to the fitting grooves 1226 in the left direction L or the right direction R. Therefore, the accessory body 1703 can be engaged with the transformable body 1103 by the pair of grip portions 1200 moved toward each other and the distal end portion 1462 coupled thereto in the first state of the transformable body 1103. Further, the pair of grip portions 1200 moved toward each other in the first state of the transformable body 1103 grip the distal end portion 1462 by means of the fitting protrusions 1468 and the fitting grooves 1226, and the distal end portion 1462 is fixed through the accessory body 1703 gripped by the pair of grip portions 1200. Thus, the distal end portion 1462 can be fixed in the first state of the transformable body 1103.

The first state of the transformable body 1103 takes a form different from the appearance of the model toy 203. The first state of the transformable body 1103 of this embodiment has a form corresponding to a shape of a vehicle (see FIG. 34). For the vehicle form of the transformable body 1103, the transformable body 1103 includes a plurality of wheels for movement on the ground in the first state. The transformable body 1103 includes front wheels 1810 rotatably coupled to the distal end portion 1462, and rear wheels 1820 rotatably coupled to the first rotation portions 1240 of the grip portions 1200. The transformable body 1103 can be transformed from the second state to the first state such that the front wheels 1810 and the rear wheels 1820 can be placed on the ground in the first state of the transformable body 1103. In the first state of the transformable body 1103, the first rotation portion 1240 and the second rotation portion 1250 are maintained to a traveling position parallel to the ground. Therefore, the front wheels 1810 and the rear wheels 1820 can be placed on the ground.

Examples where the transformable toy according to this embodiment is transformed and examples where the transformable toy and the model toy are coupled to each other are described with reference to FIGS. 43 to 49.

Figure 43:
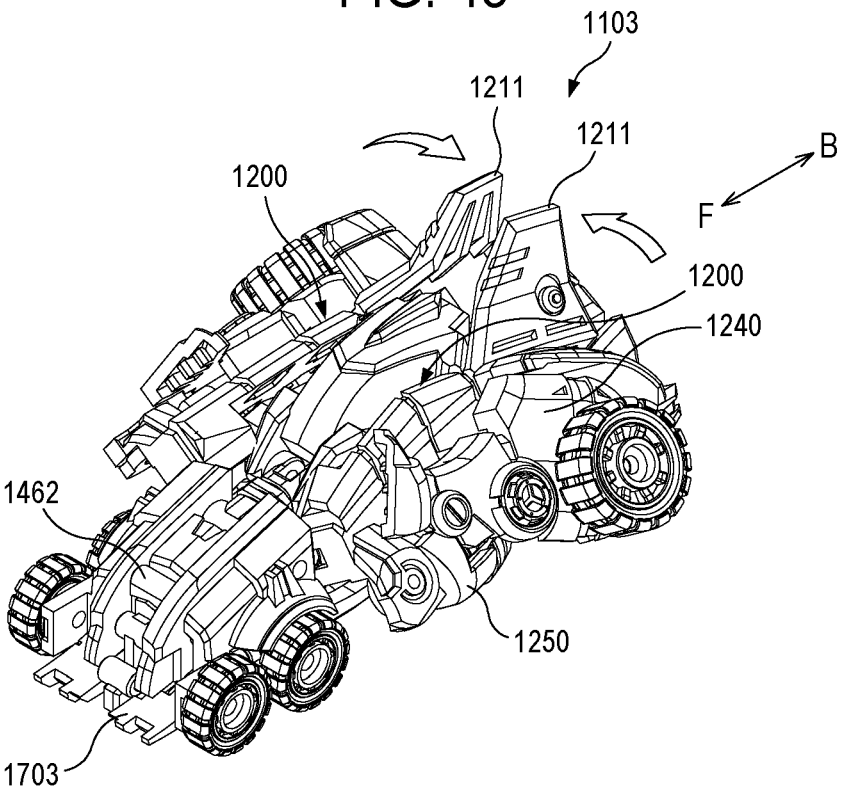
FIG. 43 is a perspective view showing a first example where the transformable body of the transformable toy according to the third embodiment is transformed.

Referring to FIG. 43, if an external force is applied to the manipulation portions 1211 in a direction of moving the manipulation portions 1211 toward each other in the transformable body 1103 (i.e., when the user performs the motion of pinching the manipulation portions 1211), the pair of grip portions 1200 are rotated to the insertion position in opposite directions and are moved away from each other.

Figure 44:
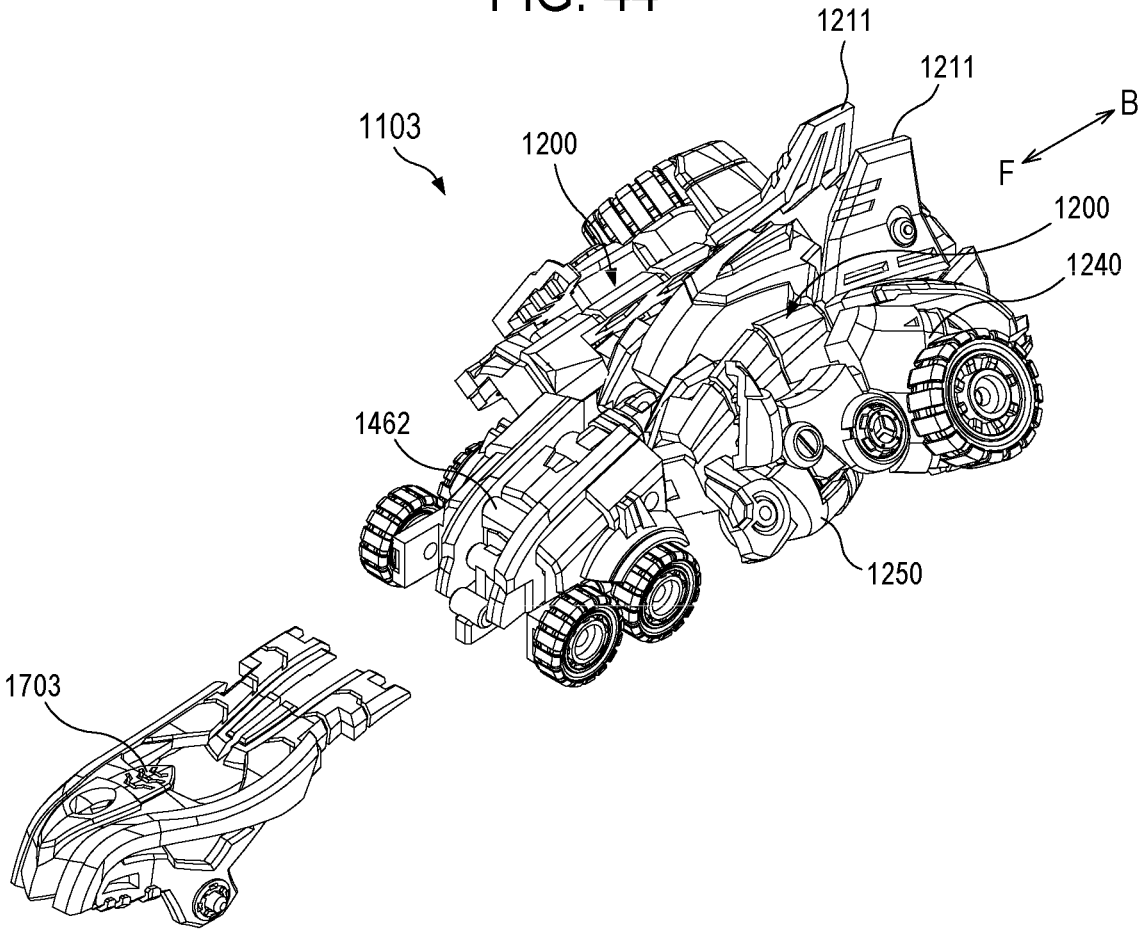
FIG. 44 is a perspective view showing a second example where the transformable body of the transformable toy according to the third embodiment is transformed.

Next, referring to FIG. 44, in the pair of grip portions 1200 moved away from each other, the accessory body 1703 is removed from the distal end portion 1462 and the pair of grip portions 1200. The accessory body 1703 is kept in waiting to cover the head extension portion of the model toy.

Figure 45:
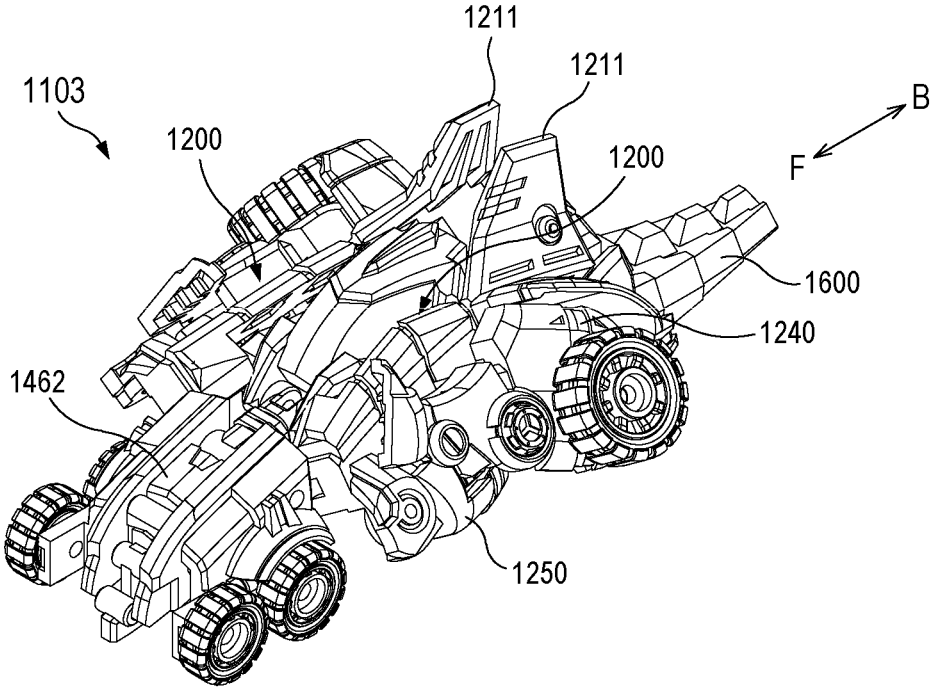
FIG. 45 is a perspective view showing a third example where the transformable body of the transformable toy according to the third embodiment is transformed.
Figure 46:
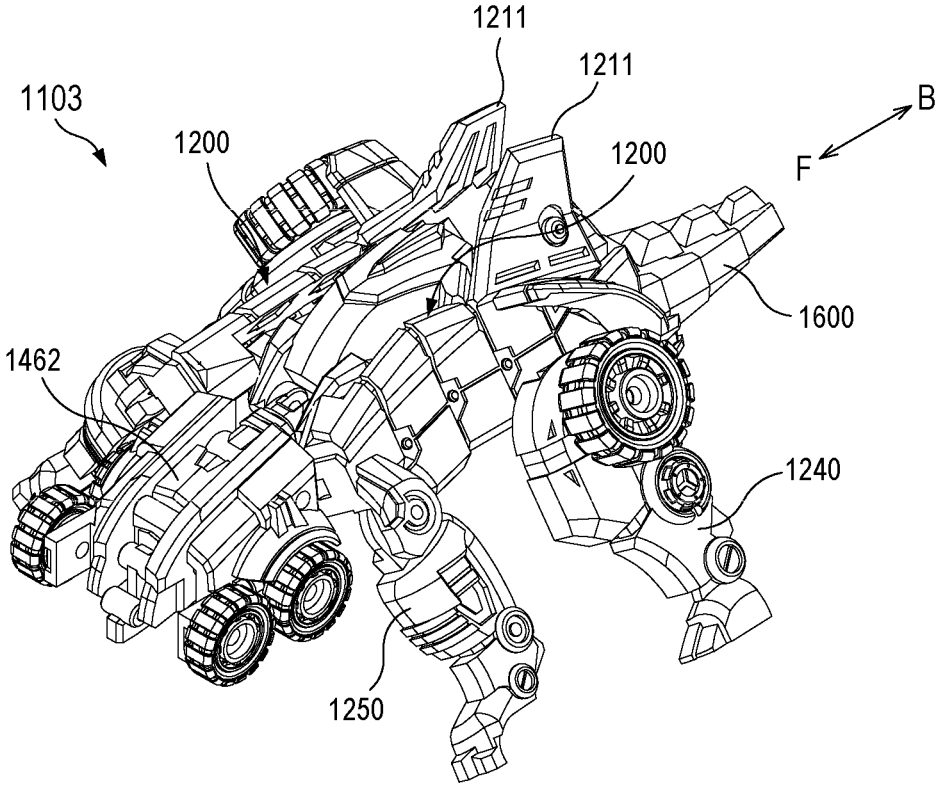
FIG. 46 is a perspective view showing a fourth example where the transformable body of the transformable toy according to the third embodiment is transformed.
Figure 47:
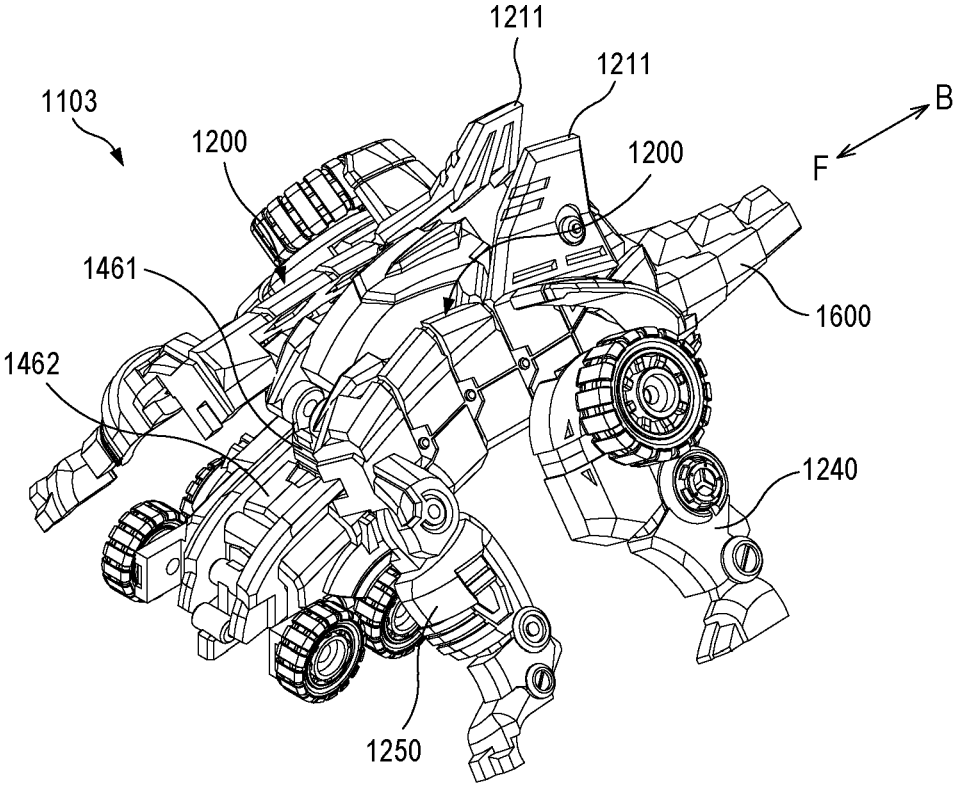
FIG. 47 is a perspective view showing a fifth example where the transformable body of the transformable toy according to the third embodiment is transformed.

Next, referring to FIG. 45, the second covering portion 1600 is rotated rearward from the frame portion 1400. Next, referring to FIG. 46, in each grip portion 1200, the second rotation portion 1250 is rotated to the upright position, and then the first rotation portion 1240 is rotated to the upright position. Next, referring to FIG. 47, the link portion 1461 of the coupling portion 1460 is rotated downward with respect to the frame portion 1400, and the distal end portion 1462 is positioned at a position lower than the position in the first state of the transformable body 1103. Next, the distal end portion 1462 is rotated toward the upper surface of the frame portion 1400.

Figure 48:
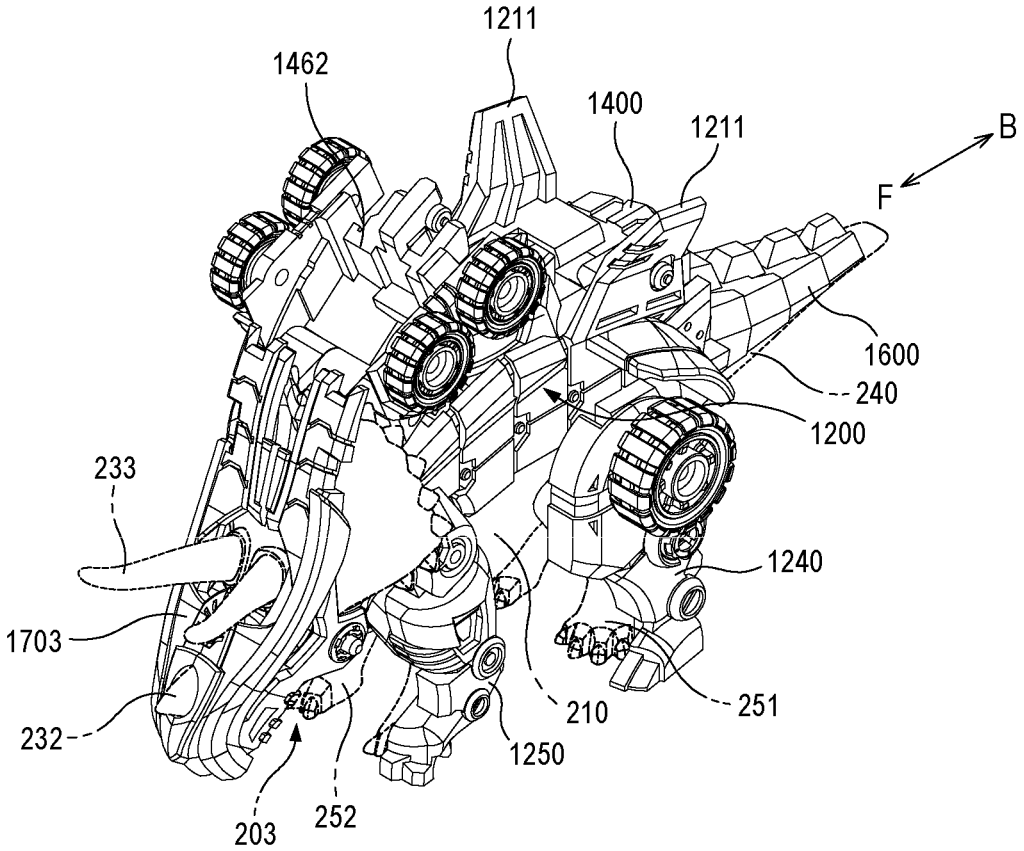
FIG. 48 is a perspective view showing a combination formed by coupling the transformable body and the accessory body of the transformable toy according to the third embodiment to the model toy.
Figure 49:
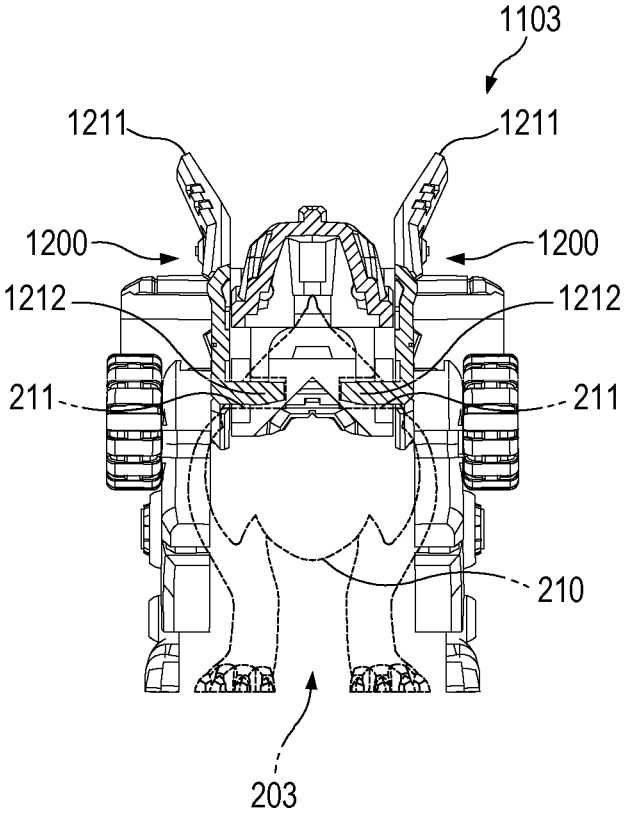
FIG. 49 is a cross-sectional view of the combination of the transformable toy and the model toy shown in FIG. 48.

Next, referring to FIGS. 48 and 49, in the state where the second covering portion 1600, the second rotation portions 1250, and the first rotation portions 1240 are unfolded and the distal end portion 1462 is rotated to the frame portion 1400, the user inserts the torso portion 210 of the model toy 203 between the pair of grip portions 1200 moved away from each other to the insertion position (i.e., between the engaging portions moved away from each other). As the user releases the manipulation portions 1211, the pair of engaging portions are rotated to the grip position by the biasing force of the torsion springs such that they are moved toward each other. Therefore, the transformable body 1103 can be temporarily fixed to the model toy 203. When the engaging portions 1212 of the grip portions 1200 are engaged with the counter engaging portions 211, mounting of the transformable body 1103 transformed into the second state on the model toy 203 can be completed, and the transformable body 1103 comes into the second state where the transformable body 1103 covers the model toy 203 and is releasably coupled to the model toy 203. In the state where the transformable body 1103 is mounted on the model toy 203, the second covering portion 1600 covers the tail extension portion of the model toy, the first rotation portions 1240 cover the hind leg extension portions of the model toy, and the second rotation portions 1250 cover the front leg extension portions of the model toy. In the state where the transformable body 1103 is mounted on the model toy 203, the accessory body 1703 is coupled to the head extension portion of the model toy 203 so as to cover the head extension portion.

The procedures in which the transformable body 1103 is transformed from the second state to the first state may be reversed from the above-described procedures. If the transformable body 1103 is transformed from the second state to the first state and the accessory body 1703 is coupled to the transformable body 1103 in the first state, the transformable toy 103 including the transformable body 1103 takes the form of a vehicle shown in FIG. 34.

As shown in FIGS. 35 and 48, in the state where the transformable body 1103 in the second state covers the model toy 203, the user can have fun, from the combination of the model toy 203 and the transformable body 1103, that the model toy 203 is wearing a protector (an armor and helmet). That is, the grip portions 1200, the first and second rotation portions 1240 and 1250 of the grip portions 1200, the second covering portion 1600, and the accessory body 1703 can be recognized as an armor and helmet covering the model toy 203.

Figure 50:
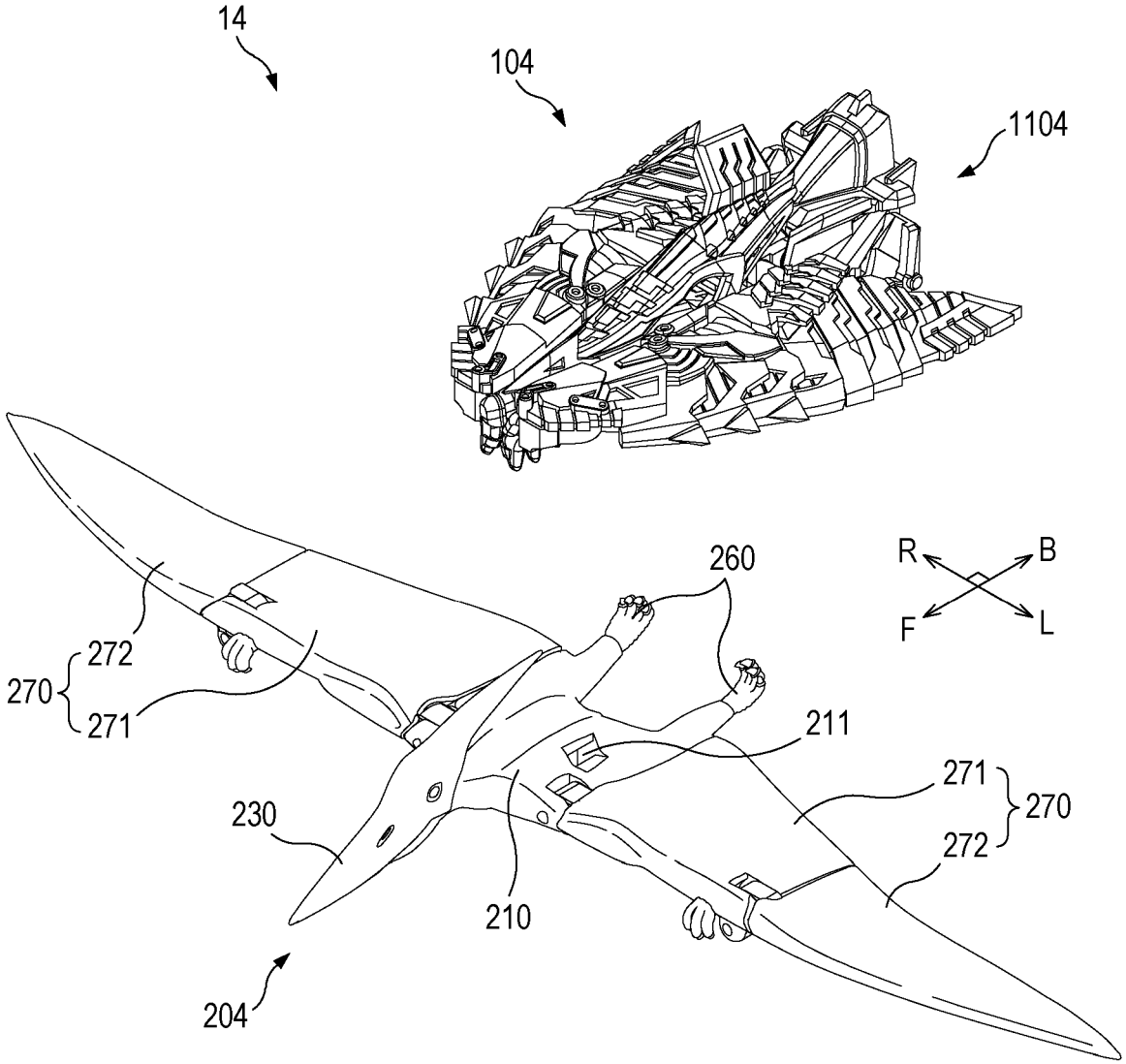
FIG. 50 is a perspective view showing a toy set according to a fourth embodiment of the present disclosure.
Figure 51:
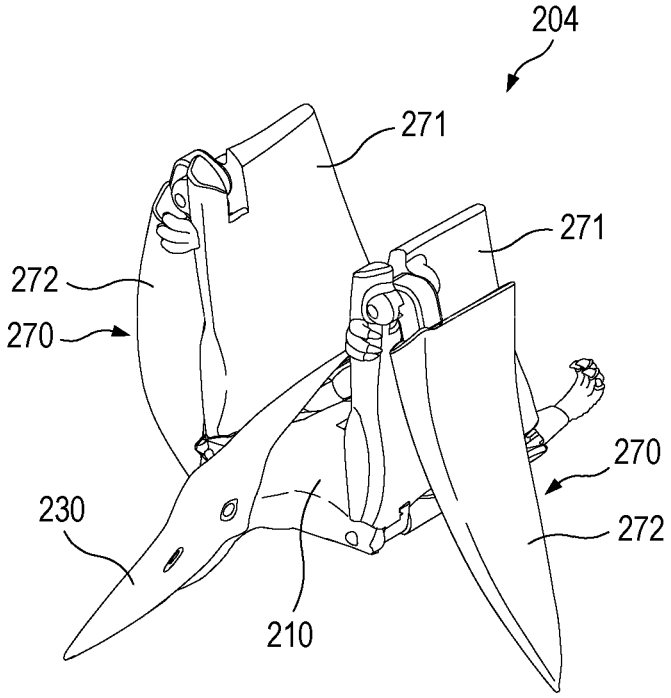
FIG. 51 is a perspective view showing a shape in which a model toy shown in FIG. 50 is transformed by manipulation.
Figure 52:
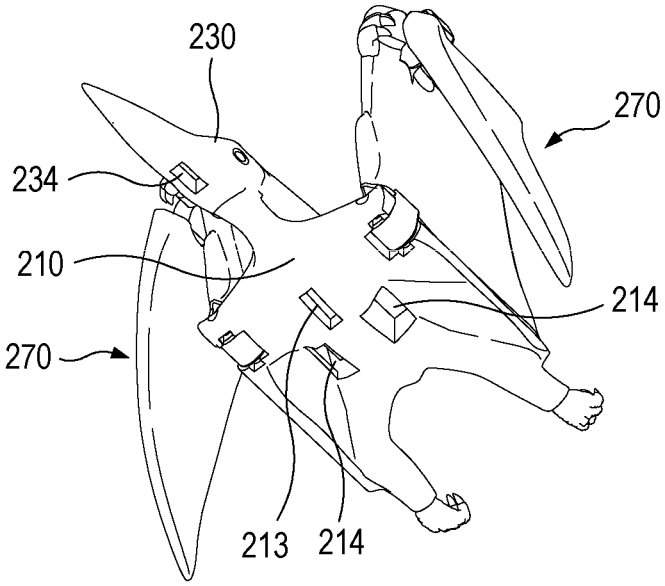
FIG. 52 is a lower perspective view of the model toy shown in FIG. 51.
Figure 53:
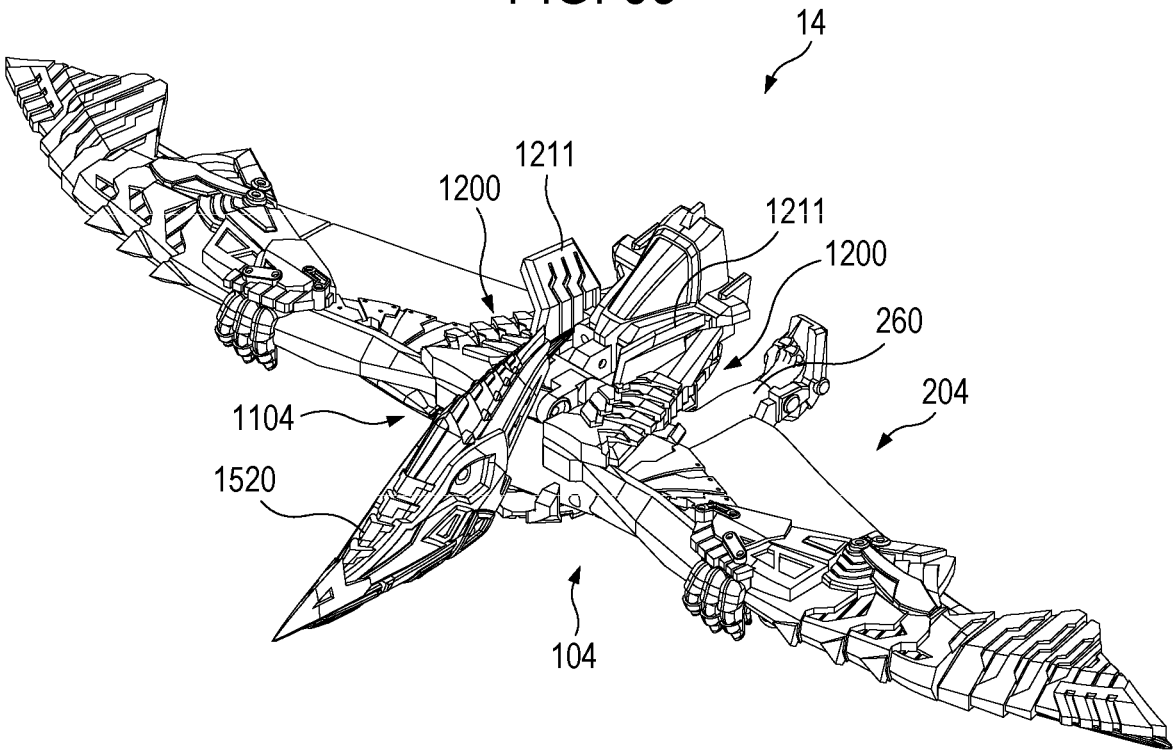
FIG. 53 is a perspective view showing a combination of the model toy and the transformable toy shown in FIG. 50.
Figure 54:
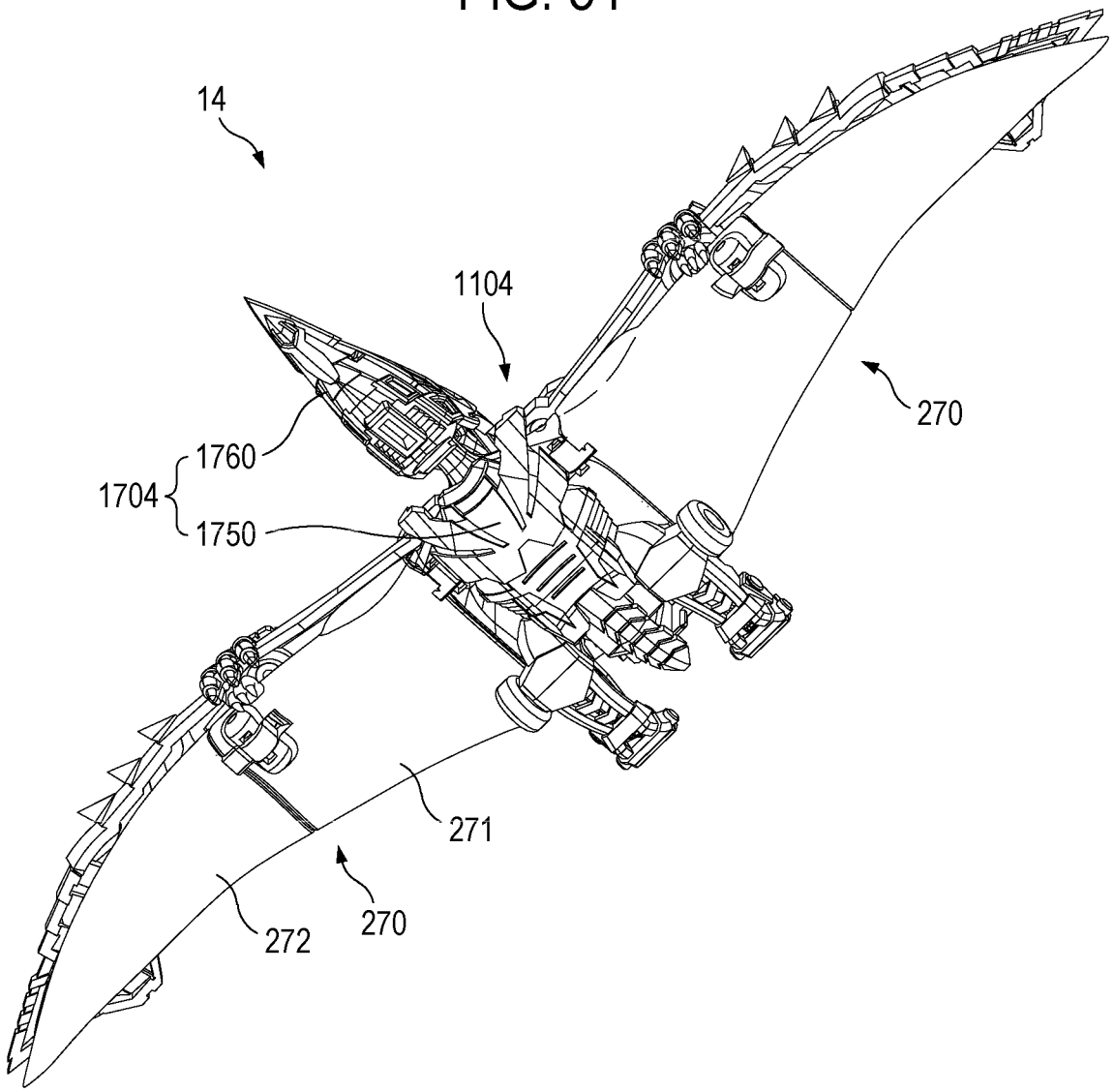
FIG. 54 is a lower perspective view showing the combination of the model toy and the transformable toy shown in FIG. 50.
Figure 55:
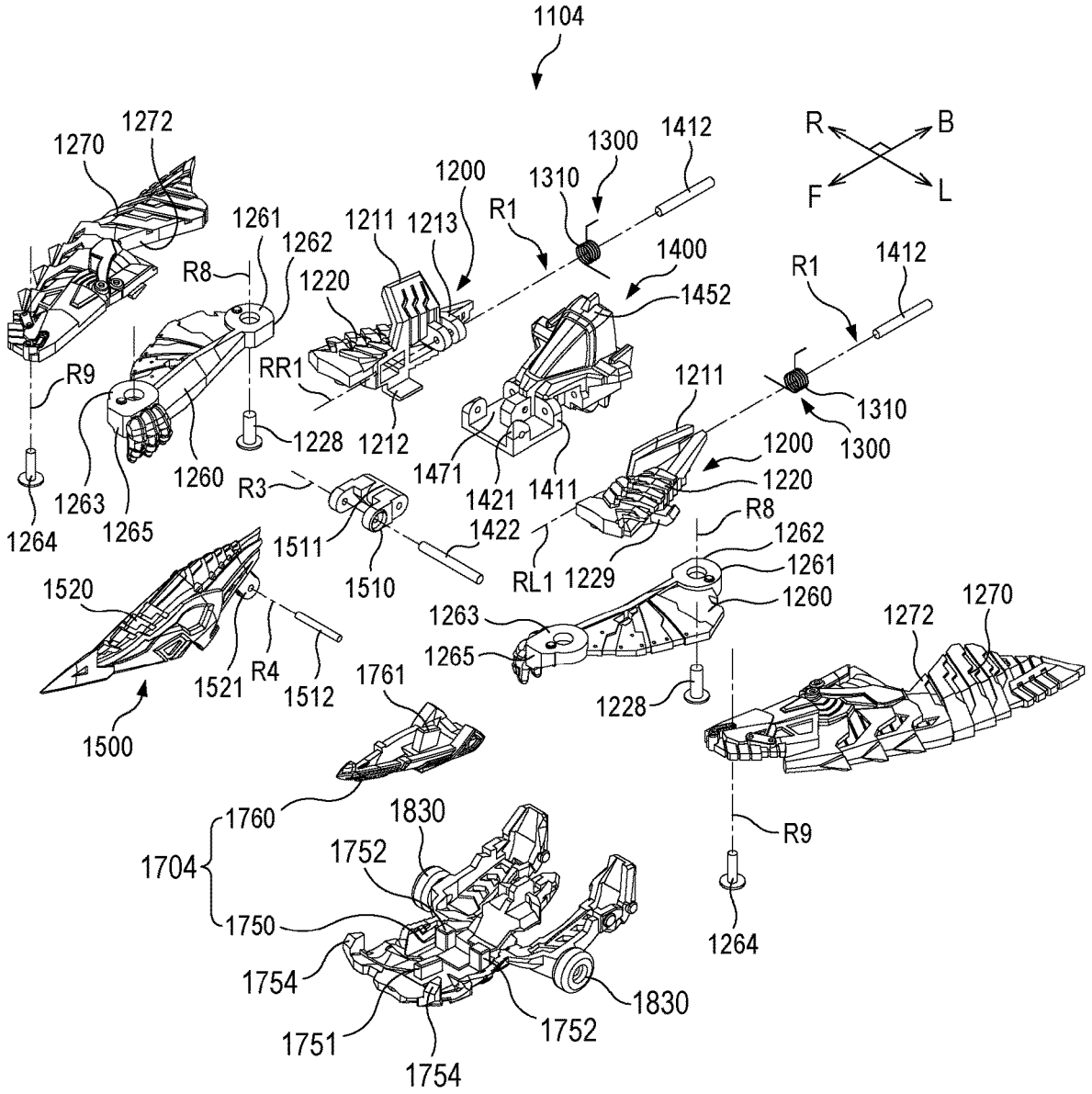
FIG. 55 is an exploded perspective view of the transformable toy shown in FIG. 50.
Figure 56:
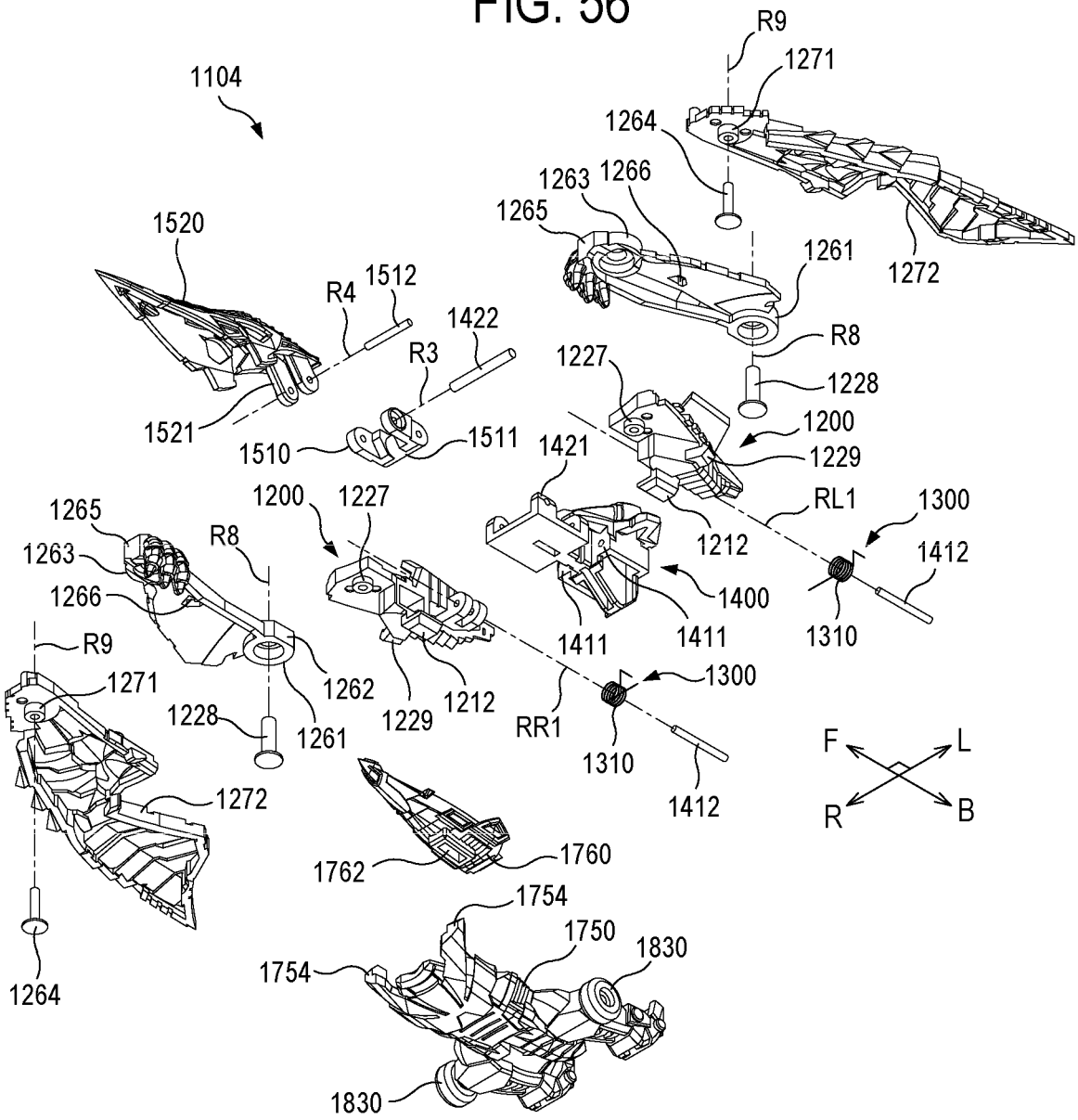
FIG. 56 is another exploded perspective view of the transformable toy shown in FIG. 50.
Figure 57:
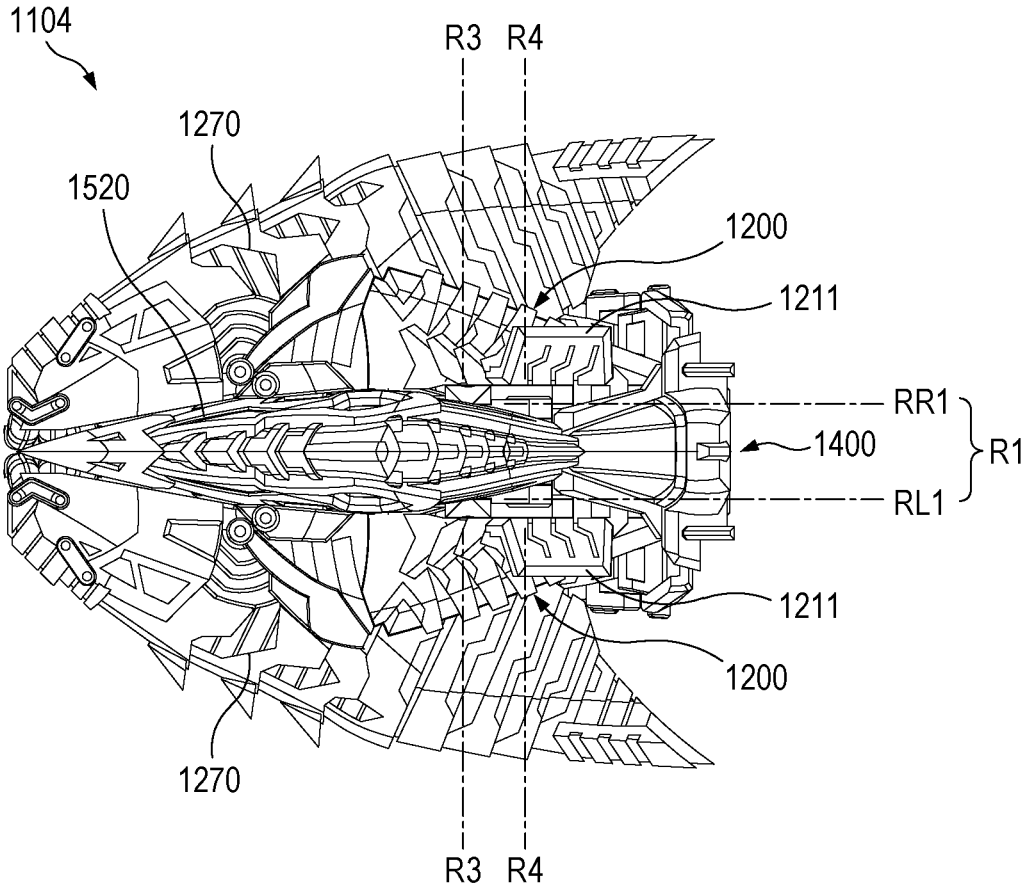
FIG. 57 is a plan view of the transformable toy shown in FIG. 50.
Figure 61:
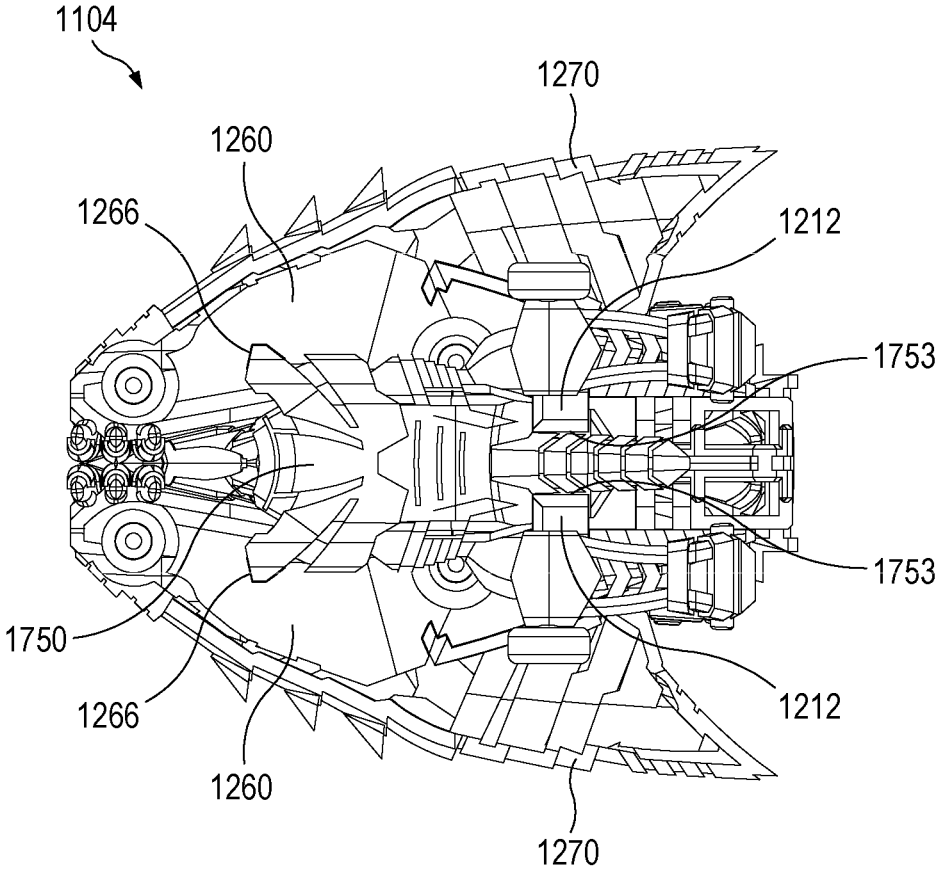
FIG. 61 is a bottom view of the transformable toy shown in FIG. 50.
Figure 62:
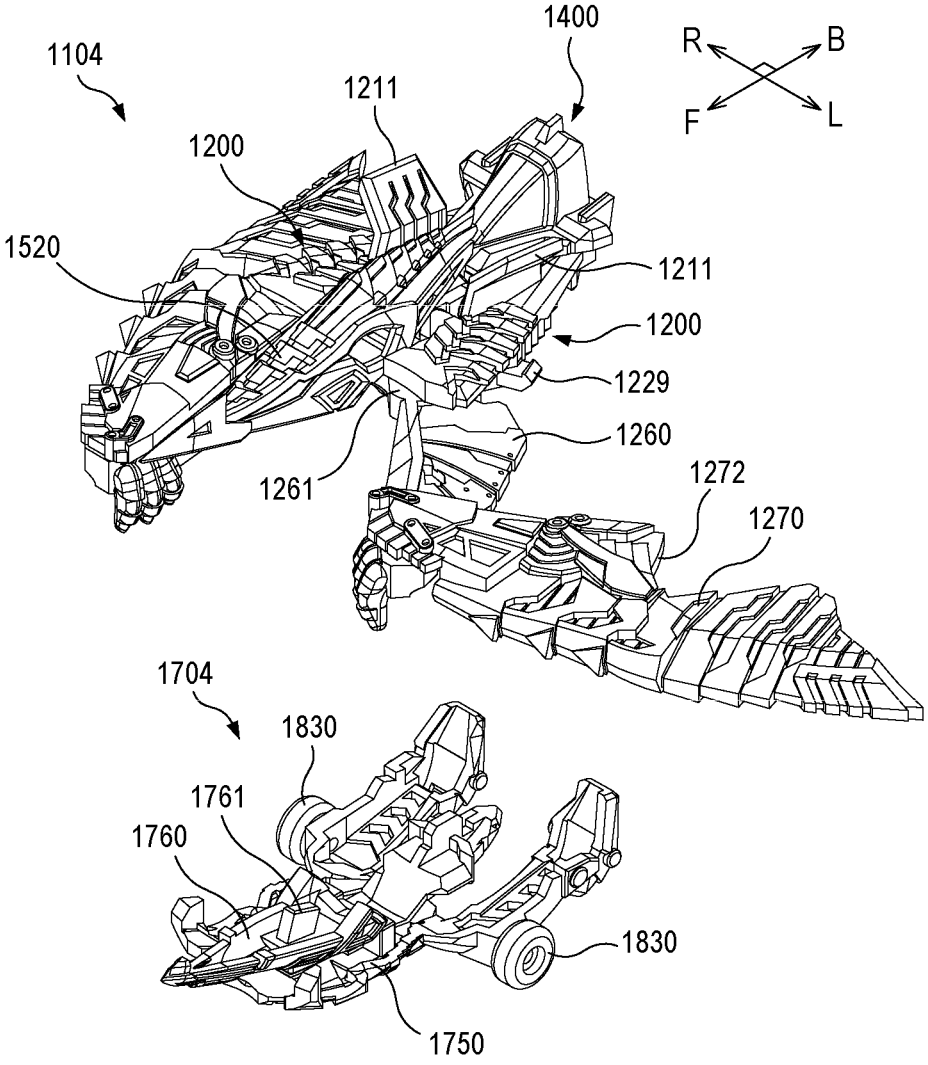
FIG. 62 is a perspective view showing a shape of one of the operations in which a rotation portion of a grip portion is rotated in the transformable toy according to the fourth embodiment.

Hereinafter, a transformable toy 104, a model toy 204 and a toy set 14 according to a fourth embodiment of the present disclosure are described with reference to FIGS. 50 to 68. FIGS. 50, 53 and 54 show a toy set and a transformable toy according to the fourth embodiment. FIGS. 51 and 52 show another shape of the model toy according to the fourth embodiment. FIGS. 55 and 56 are exploded perspective views of the transformable toy shown in FIG. 50. FIGS. 57 to 61 are a plan view, a side view, a front view, a rear view, and a bottom view of the transformable toy shown in FIG. 50, respectively. FIG. 62 shows an example where a rotation portion is rotated in the transformable toy according to the fourth embodiment. FIGS. 63 to 68 show examples where the transformable toy according to the fourth embodiment is transformed and examples where the transformable toy is coupled to the model toy.

In the following descriptions related to the fourth embodiment, components of the fourth embodiment equivalent or corresponding to those of the foregoing first embodiment are denoted by like reference numerals, and descriptions thereof may be omitted. The components of the fourth embodiment whose description is omitted can be understood by referring to the description of the first embodiment.

Referring to FIG. 50, the toy set 14 according to the fourth embodiment includes the transformable toy 104 and the model toy 204. The model toy 204 has an appearance corresponding to a shape of a flying animal, for example, an appearance corresponding to a shape of a dinosaur which may be called a pteranodon.

In the model toy 204, a counter engaging portion 211 is formed as a fitting groove in the left and right sides of a torso portion 210, and the counter engaging portions 211 function for releasably coupling the model toy 204 and the transformable toy 104. The model toy 204 may have a pair of leg extension portions 260 extending rearward from the torso portion 210, and the pair of leg extension portions 260 may have a shape of legs of a pteranodon.

As shown in FIGS. 50 to 51, the model toy 204 includes a pair of wing extension portions 270 extending laterally from the torso portion 210. The wing extension portions 270 may have a shape of wings of a pteranodon. The wing extension portions 270 are rotatably coupled to the torso portion 210 by hinge joints. As an alternative example, the wing extension portions 270 may be formed integrally with the torso portion 210. Each wing extension portion 270 includes a first wing extension portion 271 rotatably coupled to the torso portion 210 and a second wing extension portion 272 rotatably coupled to the first wing extension portion 271 by a hinge joint. Therefore, as shown in FIGS. 51 and 52, the first and second wing extension portions 271 and 272 of each wing extension portion 270 may take a folded form. As shown in FIG. 52, a fitting hole 213 and a fitting hole 214 are formed in a lower surface of the torso portion 210, and a fitting hole 234 is formed on a lower surface of a head extension portion 230. The fitting hole 213, the fitting hole 214, and the fitting hole 234 function for coupling the model toy 204 and the accessory body of the transformable toy 104.

Reference is made to FIGS. 50, 53 and 54. The transformable toy 104 shown in FIG. 50 is independent from the model toy 204. The transformable toy 104 is transformable so as to cover the model toy 204, and is releasably coupled to the model toy 204 in its transformed state. The transformable toy 104 includes a transformable body 1104 configured to be transformed and to be releasably coupled to the model toy 204. Referring to FIG. 54, the transformable toy 104 includes an accessory body 1704 removably coupled to the transformable body 1104 and configured to partially cover the model toy 204.

Referring to FIGS. 53 and 54, the transformable body 1104 and the accessory body 1704 of the transformable toy 104 are coupled to the model toy 204, thereby making a combination of the transformable toy and the model toy.

Therefore, the transformable body 1104 is configured to be transformed into a first state where the transformable body 1104 is independent from the model toy 204 (the state of the transformable body shown in FIG. 50) and a second state where the transformable body 1104 at least partially covers the model toy 204 and is releasably coupled to the model toy 204 (the state of the transformable body shown in FIGS. 53 and 54).

Referring to FIGS. 55 and 56, the transformable body 1104 includes a pair of grip portions 1200 configured to releasably grip the model toy. The pair of grip portions 1200 can releasably grip the torso portion of the model toy (see FIG. 50). The pair of grip portions 1200 are configured to be rotatable in opposite directions about a pair of rotation axes R1 (specifically, a first rotation axis RL1 and a second rotation axis RR1) (see FIG. 57). In the second state of the transformable body 1104, the pair of grip portions 1200 grip the torso portion of the model toy. Therefore, the transformable body 1104 can be coupled to the model toy while the pair of grip portions 1200 covers the torso portion of the model toy. The pair of grip portions 1200 may be configured to be rotated in opposite directions about one rotation axis in the transformable body 1104. The pair of grip portions 1200 can be rotated into an insertion position where the pair of grip portions 1200 are moved away from each other to allow a portion of the torso portion of the model toy to be inserted between the pair of grip portions 1200 and a grip position where the pair of grip portions 1200 are moved toward each other to releasably grip the torso portion of the model toy. A portion of each grip portion 1200 may be configured to partially cover one side surface of the torso portion of the model toy by being rotated about the first rotation axis RL1 and the second rotation axis RR1 in the second state of the transformable body 1104.

The pair of grip portions 1200 of the transformable body 1104 are biased toward each other, i.e., toward the grip position by at least one spring 1300. The pair of grip portions 1200 are biased so as to be moved toward each other by the spring 1300. The spring 1300 may be coupled to the pair of grip portions 1200 in the transformable body 1104. Alternatively, the transformable body 1104 may include a pair of springs disposed in the pair of rotation axes R1, respectively, and configured to bias one of the pair of grip portions 1200 toward the other of the pair of grip portions. The spring 1300 of this embodiment includes a pair of torsion springs 1310.

The pair of grip portions 1200 are biased so as to be moved toward each other by the biasing force of the torsion springs 1310. Accordingly, the transformable body 1104 may be stably coupled to the model toy in the state where the grip portions 1200 biased toward each other are coupled to the torso portion of the model toy. Further, the transformable body 1104 can be stably maintained in the first state by the biasing force of the torsion springs 1310.

The transformable body 1104 includes a pair of manipulation portions 1211 that can be manipulated to rotate the pair of grip portions 1200. The pair of manipulation portions 1211 may be configured to be moved toward each other when the pair of grip portions 1200 are rotated to be moved away from each other. When the transformable body 1104 has the spring, the manipulation portions 1211 may be manipulated to rotate the grip portions 1200 against the biasing force of the spring 1300. The pair of grip portions 1200 can be rotated about the rotation axes R1 in the direction of the force applied to the manipulation portions 1211. The pair of manipulation portions 1211 are formed as a protrusion that protrudes from the base end of each grip portion 1200 in an oblique direction between the lateral side and the upper side and has a shape of a wing. In the state where the pair of grip portions 1200 are moved away from each other by the pair of manipulation portions 1211, the torso portion of the model toy can be inserted between the pair of grip portions 1200. Thereafter, as the manipulation portions 1211 are released, the pair of grip portions 1200 are moved toward each other by the biasing force of the torsion springs 1310 and can grip the torso portion 210.

The pair of grip portions 1200 and the model toy may be releasably coupled to each other by engaging portions that are complementarily engaged with each other. Each grip portion 1200 includes an engaging portion 1212 configured to be engaged with the model toy, and the model toy includes, at the torso portion, counter engaging portions 211 (see FIG. 50) configured to be complementarily coupled to the engaging portions 1212. The engaging portion 1212 of each grip portion 1200 is formed so as to protrude toward the other of the pair of grip portions 1200 in the state where the pair of grip portions 1200 are moved toward each other. The engaging portions 1212 of the grip portions are formed as a male engaging portion that protrudes from the lower end of the grip portion 1200 and has a shape of a protrusion or a pin. The counter engaging portions 211 of the model toy are formed in the left and right sides of the torso portion of the model toy as a female engaging portion that releasably fits with the engaging portion 1212 and has a shape of a groove or hole. The engaging portions 1212 are fitted to the counter engaging portions 211 in the second state of the transformable body 1104, thereby coupling the transformable body 1104 transformed into the second state to the model toy 204.

The transformable body 1104 includes a frame portion 1400 capable of functioning as a base portion of the transformable body 1104, and at least one covering portion configured to partially cover the model toy in the second state of the transformable body 1104. The pair of grip portions 1200 releasably couple the transformable body 1104 transformed into the second state to the model toy, and the at least one covering portion covers a portion of the model toy. Accordingly, the user can have fun that the at least one covering portion covers the model toy and the model toy is wearing a protector (an armor).

The frame portion 1400 is configured to partially cover a back portion of the torso portion of the model toy (see FIG. 50) in the second state of the transformable body 1104. The pair of grip portions 1200 are rotatably coupled to the frame portion 1400. The pair of grip portions 1200 are rotatable about the first rotation axis RL1 and the second rotation axis RR1 that are spaced apart from each other and pass through the frame portion 1400 or the pair of grip portions 1200 in the front direction F and the rear direction B. Therefore, the pair of grip portions 1200 include a first grip portion coupled to the left side of the frame portion 1400 so as to be rotatable about the first rotation axis RL1, and a second grip portion coupled to the right side of the frame portion 1400 so as to be rotatable about the second rotation axis RR1.

The frame portion 1400 and each grip portion 1200 are connected by a first hinge joint in the transformable body 1104. The transformable body 1103 is provided with a pair of first hinge joints through which the first rotation axis RL1 and the second rotation axis RR1 pass respectively. The first hinge joint may be composed of a hinge portion 1411 provided in each side of the frame portion 1400, a counter hinge portion 1213 provided in the base end side of each grip portion 1200, and a hinge shaft 1412 passing through the hinge portion 1411 and the counter hinge portion 1213. Respective hinge shafts 1412 may correspond to the first rotation axis RL1 and the second rotation axis RR1. The frame portion 1400 has a protrusion 1452 protruding upward from the rear end thereof, and the protrusion 1452 may have a shape that can be recognized as a canopy covering a cockpit. The torsion spring 1310 is disposed between the frame portion 1400 and each grip portion 1200 such that the hinge shaft 1412 passes through the inside of the torsion spring 1310. One end of each of the torsion springs 1310 is engaged on the surface of the frame portion 1400, and the other end of each of the torsion springs 1310 is engaged on the counter hinge portion 1213 of each grip portion. The inner surfaces of the grip portions 1200 biased by the torsion springs 1310 make contact with the respective side surfaces of the frame portion 1400, whereby the inward rotation of the grip portions can be restricted.

The at least one covering portion of the transformable body 1104 may be configured to partially cover the model toy in the state where the at least one covering portion is fixed to a specific position in the second state of the transformable body 1104. The transformable body 1104 includes a first covering portion 1500 as a rotating covering portion of the at least one covering portion. The first covering portion 1500 is rotatably coupled to the front end of the frame portion 1400, and is configured to partially cover the head extension portion of the model toy (see FIG. 50). The first covering portion 1500 includes a link portion 1510 coupled to the frame portion 1400 so as to be rotatable about a third rotation axis R3 (see FIG. 57), and a distal end portion 1520 coupled to the vicinity of the front end of the link portion 1510 so as to be rotatable about a fourth rotation axis R4 (see FIG. 57). The distal end portion 1520 is configured to partially cover the head extension portion of the model toy (see FIG. 50). The distal end portion 1520 may have a shape that can be recognized as a helmet by the user.

The frame portion 1400 and the link portion 1510 are connected by the second hinge joint. In the first state of the transformable body 1104, the link portion 1510 of this embodiment can be inserted into a recess portion 1471 formed in the frame portion 1400. In the second state of the transformable body 1104, the link portion 1510 can be rotated so as to protrude from the recess portion 1471 to the front side of the frame portion 1400. Further, in the second state of the transformable body 1104, the link portion 1510 makes contact with the front end of the frame portion 1400, whereby the downward rotation of the link portion 1510 can be restricted. The link portion 1510 and the distal end portion 1520 are connected by the third hinge joint. In the first state of the transformable body 1104, the distal end portion 1520 is rotated such that its rear end makes contact with the protrusion 1452. In the second state of the transformable body 1104, the distal end portion 1520 is positioned more frontward than the position of the distal end portion 1520 in the first state of the transformable body 1104.

Each grip portion 1200 includes a support portion 1220 and a rotation portion rotatably coupled to the support portion 1220. The support portion 1220 is configured to cover a portion of the side surface of the torso portion of the model toy (see FIG. 50) in the second state of the transformable body 1104. The support portion 1220 constitutes a main body of each grip portion. One of the pair of rotation axes R1 (i.e., the first rotation axis RL1 or the second rotation axis RR1) may be disposed in the support portion 1220.

The rotation portion of each grip portion 1200 is configured to partially cover the wing extension portion of the model toy (see FIG. 50) in the second state of the transformable body 1104. The rotation portion of each grip portion 1200 includes a first rotation portion 1260 rotatably coupled to the support portion 1220 and a second rotation portion 1270 rotatably coupled to the first rotation portion 1260. The rotation portion of each grip portion 1200, which is composed of the first rotation portion 1260 and the second rotation portion 1270, can be rotated to a folded position shown in FIG. 57 and an unfolded position shown in FIG. 53. At the folded position, the first rotation portion 1260 and the second rotation portion 1270 overlap each other in the left direction or the right direction, and extend substantially in the direction of the rotation axes R1. At the unfolded position, as shown in FIG. 62, the first rotation portion 1260 protrudes from the support portion 1220 in the left or right direction, and the second rotation portion 1270 is rotated in the protruding direction of the first rotation portion 1260. When the first rotation portion 1260 and the second rotation portion 1270 are rotated to the unfolded position, the user can recognize that the first rotation portion 1260 and the second rotation portion 1270 are transformed into a shape of an unfolded wing.

The first rotation portion 1260 is disposed at the front end of each grip portion 1200 and is configured to partially cover the first wing extension portion of the model toy. The second rotation portion 1270 is disposed at the distal end of the first rotation portion 1260 and is configured to partially cover the second wing extension portion of the model toy.

Figure 58:
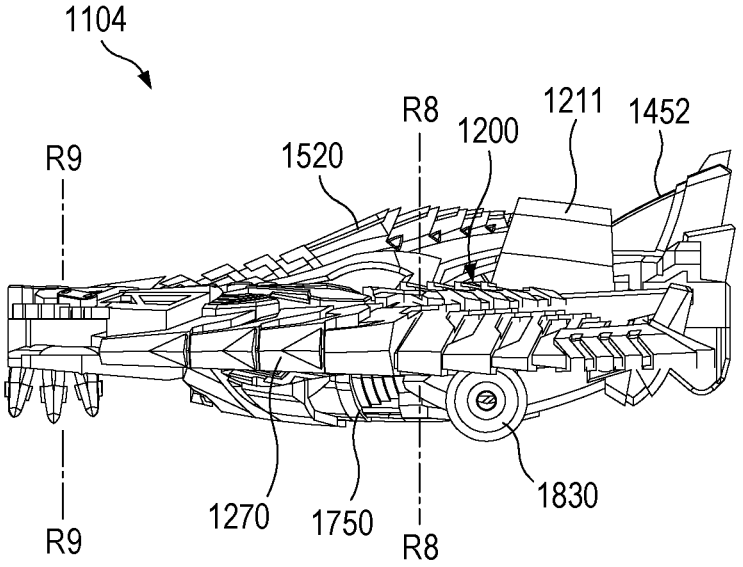
FIG. 58 is a side view of the transformable toy shown in FIG. 50.
Figure 59:
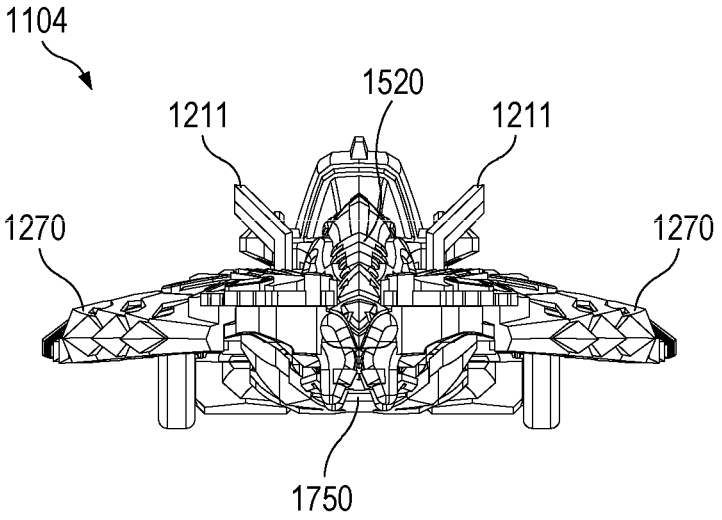
FIG. 59 is a front view of the transformable toy shown in FIG. 50.
Figure 60:
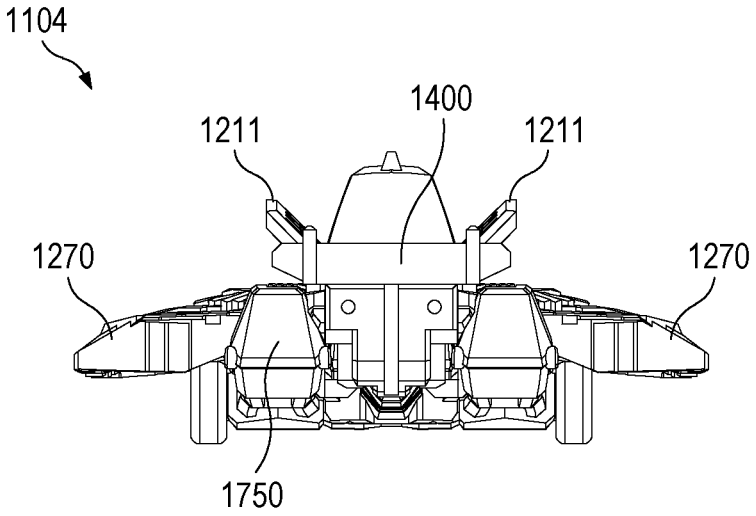
FIG. 60 is a rear view of the transformable toy shown in FIG. 50.

The first rotation portion 1260 is coupled to the support portion 1220 so as to be rotatable about an eighth rotation axis R8 (see FIG. 58). The support portion 1220 and the first rotation portion 1260 are connected by a seventh hinge joint. The seventh hinge joint may be composed of a hinge portion 1227 provided at the front end of the support portion 1220, a counter hinge portion 1261 provided at the base end of the first rotation portion 1260, and a hinge shaft 1228 coupled to the hinge portion 1227 and the counter hinge portion 1261. The support portion 1220 is provided with a stopper portion 1229 protruding outward from the lateral end of the support portion. The rear end of the first rotation portion 1260 makes contact with the stopper portion 1229, whereby the rearward rotation of the first rotation portion 1260 can be restricted. The counter hinge portion 1261 is provided with a stopper portion 1262. The stopper portion 1262 makes contact with the inner surface of the support portion 1220, whereby the frontward rotation of the first rotation portion 1260 can be restricted.

The second rotation portion 1270 is coupled to the first rotation portion 1260 so as to be rotatable about a ninth rotation axis R9 (see FIG. 58). The second rotation portion 1270 and the first rotation portion 1260 are connected by an eighth hinge joint. The eighth hinge joint may be composed of a hinge portion 1263 provided in the distal end of the first rotation portion 1260, a counter hinge portion 1271 provided in the base end of the second rotation portion 1270, and a hinge shaft 1264 coupled to the hinge portion 1263 and the counter hinge portion 1271. A stopper portion 1265 is provided in the hinge portion 1263. The stopper portion 1265 makes contact with the edge of the second rotation portion 1270 in the vicinity of the base end of the second rotation portion, whereby the frontward rotation of the second rotation portion 1270 can be restricted. A recessed portion 1272 is formed at the inner edge of the second rotation portion 1270. The recessed portion 1272 is concave so as to correspond to a shape of the front edge and the side edge of the support portion 1220. Therefore, in the first state of the transformable body 1104, the second rotation portion 1270 can be rotated to the folded position while accommodating the front edge and the side edge of the support portion 1220. Accordingly, the transformable body 1104 can have a reduced width dimension in the first state, and can be transformed into the first state more compactly.

The transformable toy 104 includes an accessory body 1704 which is removably coupled to a first position of the transformable body 1104 in the first state of the transformable body 1104 and is releasably coupled to a predetermined position of the model toy in the second state of the transformable body 1104.

The accessory body 1704 functions as the aforementioned accessory covering portion configured to cover a portion of the model toy in the second state of the transformable body 1104. The accessory body 1704 includes a first accessory covering portion 1750 and a second accessory covering portion 1760.

The first accessory covering portion 1750 is configured to cover an abdomen portion of the torso portion of the model toy and a lower surface of the leg extension portion of the model toy (see FIGS. 50 and 54). The first accessory covering portion 1750 has, at its upper surface, a fitting protrusion 1751 and a fitting protrusion 1752. The fitting protrusion 1751 is fitted into the fitting hole 213 (see FIG. 52) formed in the torso portion of the model toy. The fitting protrusion 1752 is fitted into the fitting hole 214 (see FIG. 52) formed in the torso portion of the model toy. Therefore, in the second state of the transformable body 1104, the first accessory covering portion 1750 can be releasably coupled to the model toy so as to cover the lower portion of the torso portion of the model toy and the leg extension portion of the model toy. The first accessory covering portion 1750 can be recognized as a protector (an armor) covering the abdomen and the legs of the model toy.

The second accessory covering portion 1760 is configured to cover the lower surface of the head extension portion of the model toy (see FIGS. 50 and 54). The second accessory covering portion 1760 has a fitting protrusion 1761 at its upper surface. The fitting protrusion 1761 is fitted into the fitting hole 234 (see FIG. 52) formed in the head extension portion of the model toy. Therefore, the second accessory covering portion 1760 can be recognized as a portion of a helmet covering the lower portion of the head of the model toy. Further, the second accessory covering portion 1760 is removably coupled to the first accessory covering portion 1750 in the first state of the transformable body 1104, and is located below the distal end portion 1520 in the first state of the transformable body 1104. A fitting hole 1762 is formed in the lower surface of the second accessory covering portion 1760, and the fitting protrusion 1751 of the first accessory covering portion 1750 is fitted into the fitting hole 1762. Therefore, the second accessory covering portion 1760 is coupled to the first accessory covering portion 1750 in the first state of the transformable body 1104 and is held in the transformable body 1104.

The accessory body 1704 is configured to be engaged with the pair of grip portions 1200 moved toward each other in the first state of the transformable body 1104. The first accessory covering portion 1750 has a pair of fitting grooves 1753 (see FIG. 61) at its lower surface in the vicinity of the rear end, and a pair of fitting protrusions 1754 (see FIG. 55) at its upper surface of the front end. As shown in FIG. 61, in the first state of the transformable body 1104, the engaging portion 1212 of each grip portion 1200 is engaged with the fitting groove 1753. The first rotation portions 1260 of the grip portions 1200 have fitting holes 1266 (see FIGS. 56 and 61) corresponding to the fitting protrusions 1754, respectively. In the first state of the transformable body 1104, the fitting protrusions 1754 of the first accessory covering portion 1750 are fitted into the fitting holes 1266 of the first rotation portions 1260. Therefore, in the first state of the transformable body 1104, the accessory body 1704 can be engaged with the grip portions 1200 moved toward each other, by virtue of the engagement between the engaging portions 1212 and the fitting grooves 1753 and the fitting between the fitting holes 1266 and the fitting protrusions 1754.

The first state of the transformable body 1104 takes a form different from the appearance of the model toy 204. The first state of the transformable body 1104 has a form corresponding to a shape of an airplane (see FIG. 50). Further, the transformable body 1104 can be moved on the ground in the first state. For the movable form of the transformable body 1104, the transformable body 1104 includes a plurality of wheels for movement on the ground in the first state. The transformable body 1104 includes wheels 1830 rotatably coupled to the respective lateral ends of the first accessory covering portion 1750. The accessory body 1704 can be coupled to the transformable body 1104 transformed into the first state, such that the wheels 1830 can be placed on the ground in the first state of the transformable body 1104. As another example of the transformable body 1104, the transformable body 1104 may further include wheels disposed at the front portion of the transformable body. Alternatively, the transformable body 1104 may further include wheels disposed in the rotation portions of the grip portions 1200.

Examples where the transformable toy according to this embodiment is transformed and examples where the transformable toy and the model toy are coupled to each other are described with reference to FIGS. 63 to 68.

Figure 63:
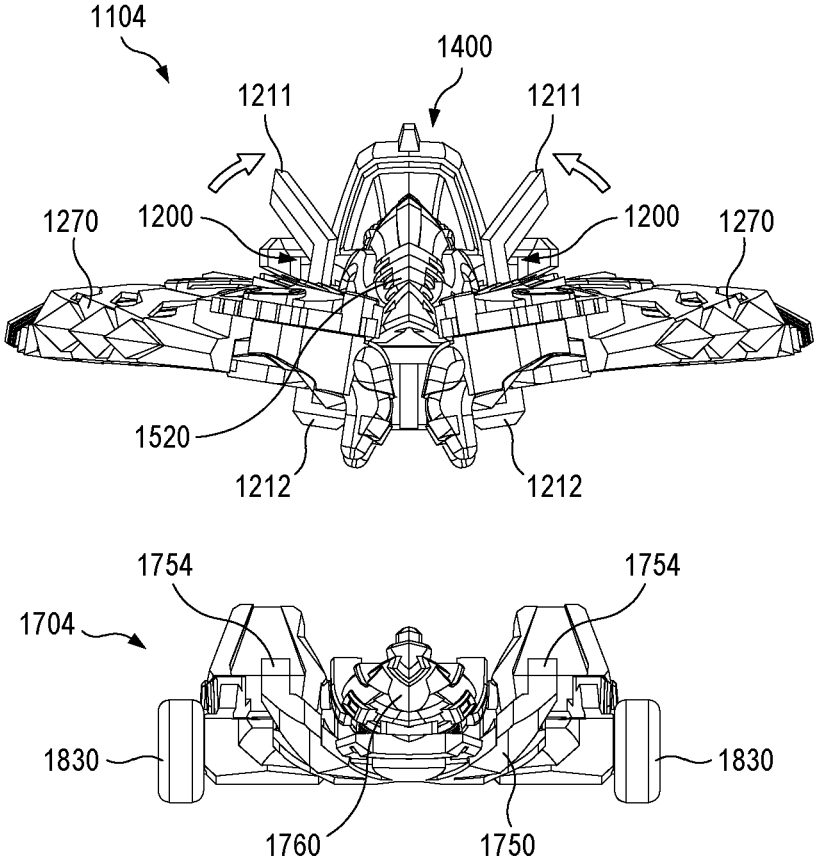
FIG. 63 is a front view showing a first example where the transformable body of the transformable toy according to the fourth embodiment is transformed.
Figure 64:
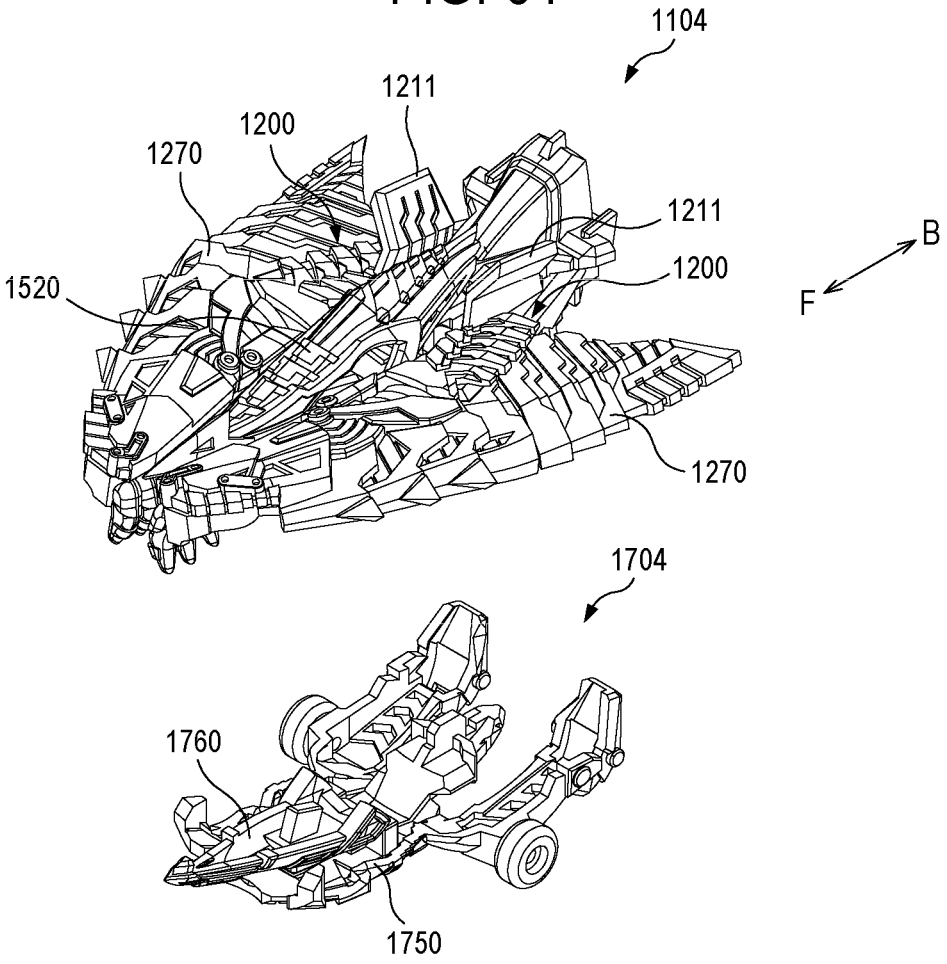
FIG. 64 is a perspective view of the transformable toy shown in FIG. 63.

Referring to FIGS. 63 and 64, in the first state of the transformable body 1104, if an external force is applied to the manipulation portions 1211 in a direction of moving the manipulation portions 1211 toward each other (i.e., if the user performs a motion of pinching the manipulation portions 1211), the pair of grip portions 1200 are rotated in opposite directions to the insertion position and are moved away from each other. Further, the accessory body 1704 is removed from the pair of grip portions 1200, which are moved away from each other. Furthermore, in the accessory body 1704, the second accessory covering portion 1760 is detached from the first accessory covering portion 1750. The accessory body 1704 removed from the pair of grip portions 1200 are kept in waiting to cover the abdomen portion of the torso portion of the model toy and the lower portion of the head extension portion of the model toy.

Figure 65:
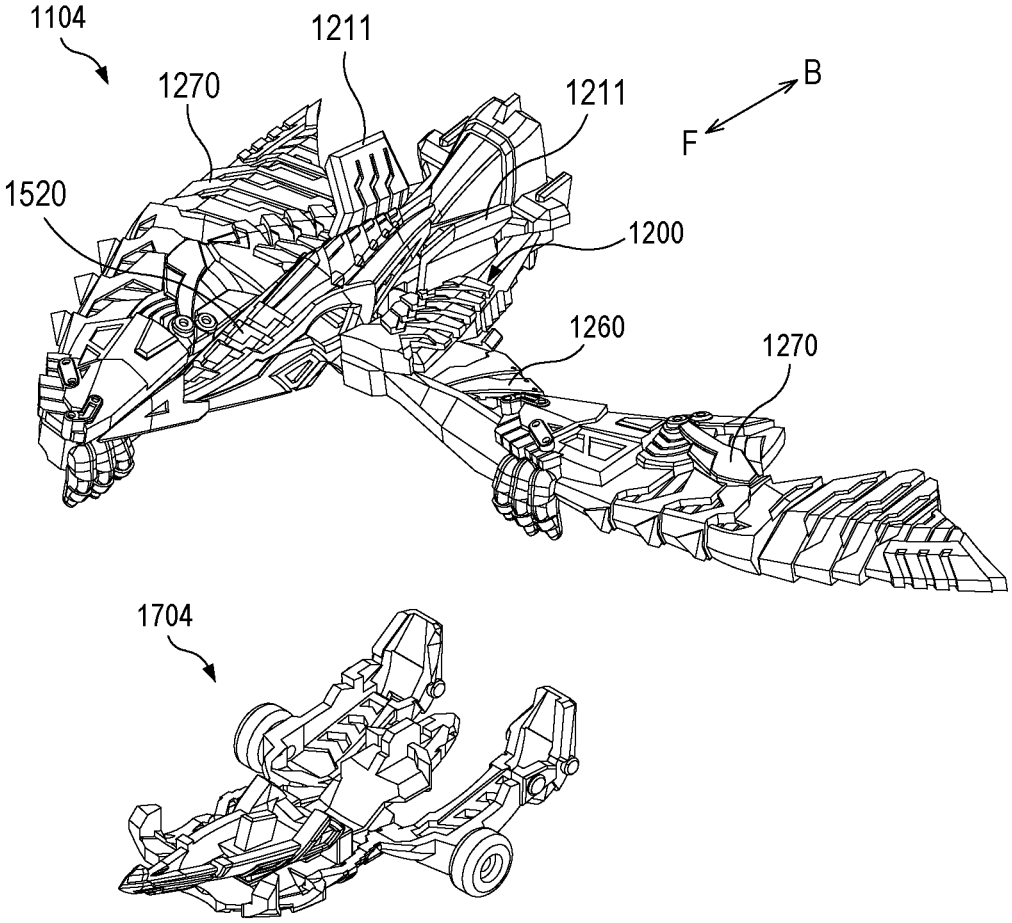
FIG. 65 is a perspective view showing a second example where the transformable body of the transformable toy according to the fourth embodiment is transformed.
Figure 66:
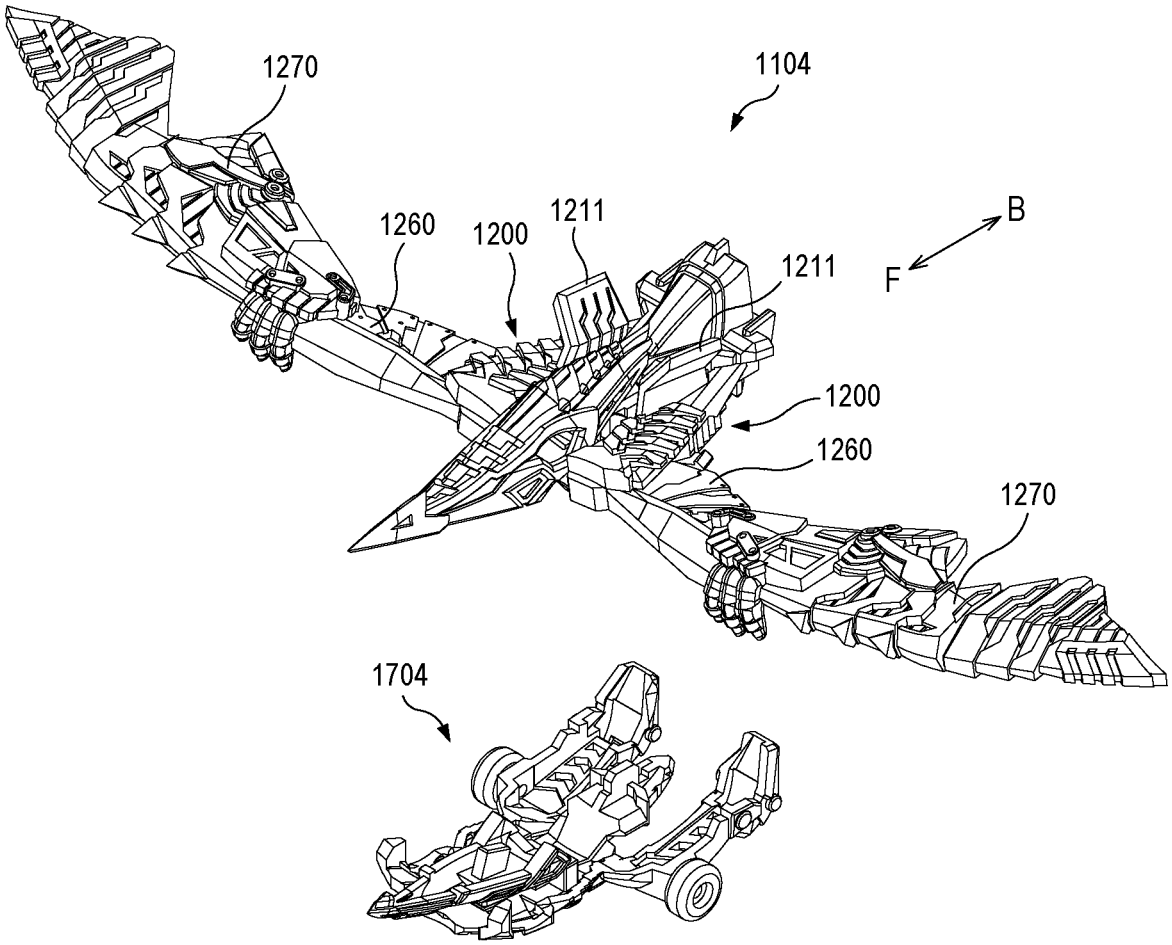
FIG. 66 is a perspective view showing a third example where the transformable body of the transformable toy according to the fourth embodiment is transformed.

Next, referring to FIGS. 65 and 66, the first rotation portion 1260 and the second rotation portion 1270 of one grip portion are sequentially rotated to the unfolded position, and the first rotation portion 1260 and the second rotation portion 1270 of the other grip portion are sequentially rotated to the unfolded position.

Figure 67:
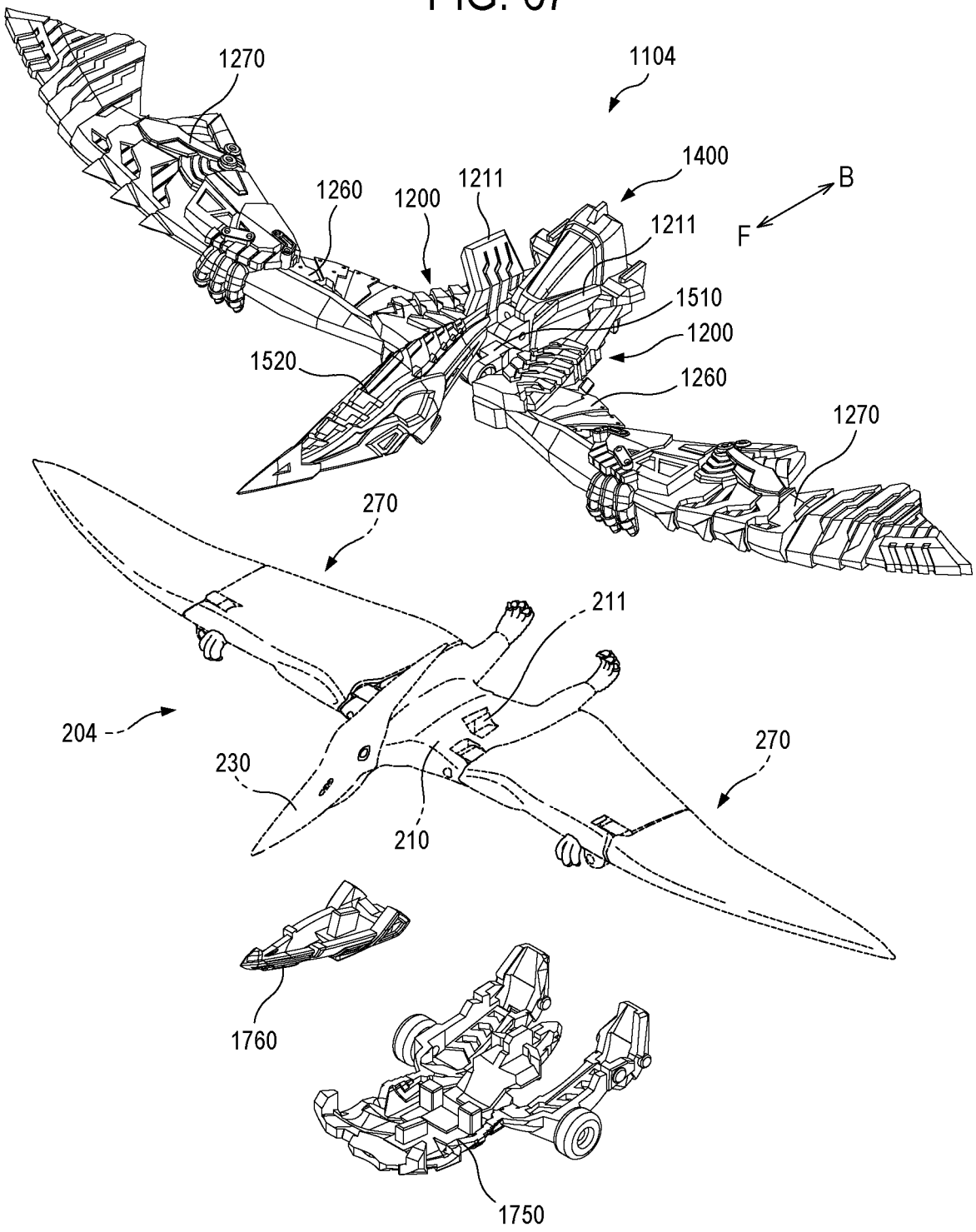
FIG. 67 is a perspective view showing that the transformable body and the accessory body of the transformable toy shown in FIG. 50 are arranged to be coupled to the model toy.
Figure 68:
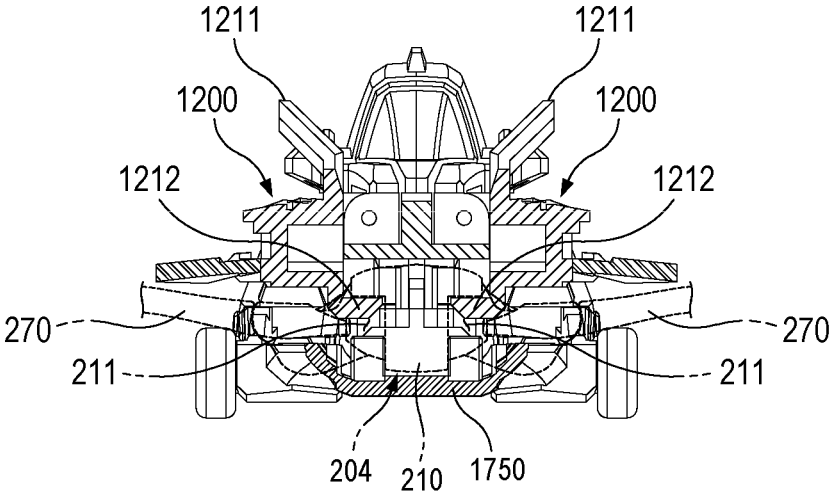
FIG. 68 is a partial cross-sectional view of the combination of the transformable toy and the model toy according to the fourth embodiment.

Next, referring to FIGS. 67 and 68, in the state where the first and second rotation portions 1260 and 1270 are unfolded to the unfolded position and the pair of grip portions 1200 are moved away from each other, the torso portion 210 of the model toy 204 is inserted between the pair of grip portions 1200 (i.e., between the engaging portions moved away from each other). At this time, the first rotation portion 1260 and the second rotation portion 1270, which are unfolded to the unfolded position, cover the wing extension portions 270 of the model toy 204. If the user releases the manipulation portions 1211, the pair of grip portions 1200 are rotated to the grip position by the biasing force of the torsion springs so as to be moved toward each other. Therefore, the transformable body 1104 can be temporarily fixed to the model toy 204. If the engaging portions 1212 of the pair of grip portions 1200 are engaged with the counter engaging portions 211 of the model toy 204, respectively, the transformable body 1104 can be releasably coupled to the torso portion 210 by the pair of grip portions 1200. Next, the link portion 1510 is rotated frontward with respect to the frame portion 1400, and the distal end portion 1520 is positioned more frontward than the distal end portion 1520 in the first state of the transformable body 1104 to cover the head extension portion of the model toy 204. If the distal end portion 1520 covers the head extension portion 230, the transformable body 1104 comes into the second state where the transformable body covers the model toy 204 by the distal end portion 1520 and the first and second rotation portions 1260 and 1270 and is releasably coupled to the model toy 204. Thus, the transformable body 1104 can be mounted on the model toy 204. In the state where the transformable body 1104 is mounted on the model toy 204, the first accessory covering portion 1750 is coupled to the torso portion 210 of the model toy 204 from below, and the second accessory covering portion 1760 is coupled to the head extension portion 230 of the model toy 204 from below. Therefore, the transformable toy 104 is releasably coupled to the model toy 204 while covering the model toy 204.

The procedures in which the first accessory covering portion 1750 and the second accessory covering portion 1760 are removed from the model toy 204 and the transformable body 1104 is transformed from the second state to the first state may be reversed from the above-described procedures. If the transformable body 1104 is transformed from the second state to the first state and the transformable body 1104 in the first state and the accessory body 1704 are coupled to each other, the transformable toy 104 including the transformable body 1104 and the accessory body 1704 takes the form of an airplane.

As shown in FIGS. 53, 54 and 67, in the state where the transformable body 1104 in the second state covers the model toy 204 and the accessory body 1704 is coupled to the model toy 204, the user can have fun, from the combination of the model toy 204 and the transformable toy 104, that the model toy 204 is wearing a protector (an armor and helmet). That is, the grip portions 1200, the first and second rotation portions 1260 and 1270 of the grip portions 1200, the first covering portion 1500, and the accessory body 1704 can be recognized as an armor and helmet for the model toy 204.

The transformable toy according to one embodiment can be transformed so as to be releasably coupled to the model toy while covering the model toy, and can be transformed so as to have a separate specific form in the state independent from the model toy. Accordingly, the user can have differentiated and creative experiences.

Further, the transformable toy according to one embodiment has a pair of grip portions. Accordingly, the user can easily mount the transformable toy to the model toy and can easily detach the transformable toy from the model toy.

Further, in the transformable toy according to one embodiment, a pair of grip portions grip other members of the transformable toy. Accordingly, the members constituting the transformable toy can be maintained with a compact structure in the transformed state where the transformable toy is independent from the model toy.

The technical idea of the present disclosure has been described heretofore with reference to some embodiments and examples shown in the accompanying drawings. However, it is to be understood that various substitutions, modifications and alterations may be made without departing from the technical idea and scope of the present disclosure that can be understood by those of ordinary skill in the technical field to which the present disclosure pertains. Further, it is to be understood that such substitutions, modifications and alterations fall within the appended claims.

What is claimed is:

1. A transformable toy comprising:

a transformable body configured to be transformable into a first state where the transformable body is independent from a model toy and a second state where the transformable body at least partially covers the model toy and is releasably coupled to the model toy, wherein the transformable body includes:

at least one covering portion configured to be rotated for transformation from the first state to the second state and configured to partially cover the model toy in the second state;

a pair of grip portions configured to be rotatable in opposite directions about one rotation axis or a pair of rotation axes, the pair of grip portions being configured to grip the at least one covering portion by being moved toward each other in the first state and configured to partially cover a torso portion of the model toy and to releasably grip the model toy by being moved toward each other in the second state; and at least one spring coupled to the pair of grip portions and configured to bias the pair of grip portions toward each other such that the pair of grip portions are moved toward each other in the first state and the second state, and wherein each of the pair of grip portions includes an engaging portion protruding toward the other of the pair of grip portions in a state where the pair of grip portions are moved toward each other, such that the engaging portion grips the at least one covering portion in the first state and is engaged with a counter engaging portion of the model toy in the second state.

2. The transformable toy of claim 1, wherein the at least one spring includes a pair of springs disposed in the pair of rotation axes, respectively, and configured to bias one of the pair of grip portions toward the other of the pair of grip portions.

3. The transformable toy of claim 1, wherein the transformable body further includes a pair of manipulation portions protruding from the pair of grip portions, respectively, and configured to be moved toward each other when the pair of grip portions are moved away from each other.

4. The transformable toy of claim 1, wherein the transformable body further includes a frame portion configured to partially cover the torso portion of the model toy in the second state, and wherein the pair of grip portions includes:

a first grip portion coupled to the frame portion so as to be rotatable about a first rotation axis which is one of the pair of rotation axes; and a second grip portion coupled to the frame portion so as to be rotatable about a second rotation axis which is the other of the pair of rotation axes.

5. The transformable toy of claim 1, wherein each of the pair of the grip portions includes:

a support portion, which is provided with the engaging portion and in which the one rotation axis or one of the pair of rotation axes is disposed; and a rotation portion rotatably coupled to the support portion and configured to partially cover the model toy in the second state.

6. The transformable toy of claim 1, wherein the transformable body further includes a frame portion configured to partially cover the torso portion of the model toy in the second state, and wherein the at least one covering portion includes a rotating covering portion rotatably coupled to the frame portion.

7. The transformable toy of claim 1, wherein the at least one covering portion includes an accessory covering portion removably coupled to the transformable body.

8. The transformable toy of claim 1, further comprising an accessory body removably coupled to a first position of the transformable body in the first state and releasably coupled to a second position of the transformable body different from the first position or a predetermined position of the model toy in the second state.

9. The transformable toy of claim 8, wherein the accessory body is configured to be engaged with the pair of grip portions moved toward each other in the first state.

10. The transformable toy of claim 8, wherein the accessory body is configured to cover a portion of the model toy in the second state.

11. A toy set comprising:

a model toy; and the transformable toy of claim 1, which is releasably coupled to the model toy.

* * * * *